US012550969B2

(12) United States Patent
Bidal et al.

(10) Patent No.: US 12,550,969 B2
(45) Date of Patent: Feb. 17, 2026

(54) GOLF SHOES HAVING MULTI-SURFACE TRACTION OUTSOLES

(71) Applicant: Acushnet Company, Fairhaven, MA (US)

(72) Inventors: Jean-Marie Bidal, Marlborough, MA (US); John F. Swigart, Plymouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/922,538

(22) Filed: Oct. 22, 2024

(65) Prior Publication Data

US 2025/0049170 A1 Feb. 13, 2025

Related U.S. Application Data

(63) Continuation-in-part of application No. 18/407,895, filed on Jan. 9, 2024, which is a continuation of application No. 17/552,391, filed on Dec. 16, 2021, now Pat. No. 12,075,887, which is a continuation-in-part of application No. 17/024,250, filed on Sep. 17, 2020, now Pat. No. 11,490,689, which is a continuation-in-part of application No. 16/814,685, filed on Mar. 10, 2020, now Pat. No.

(Continued)

(51) Int. Cl.

| | |
|---|---|
| ***A43B 5/00*** | (2022.01) |
| ***A43B 13/14*** | (2006.01) |
| ***A43B 13/22*** | (2006.01) |
| ***A43C 15/16*** | (2006.01) |

(52) U.S. Cl.
CPC ..... *A43B 5/001* (2013.01); *A43B 13/14* (2013.01); *A43B 13/223* (2013.01); *A43C 15/162* (2013.01)

(58) Field of Classification Search
CPC ..... A43B 3/0036; A43B 5/001; A43B 5/02; A43B 13/22; A43B 13/223; A43C 15/16; A43C 15/162; A43C 15/165; A43C 15/18
See application file for complete search history.

(56) References Cited

U.S. PATENT DOCUMENTS

D259,595 S * 6/1981 Famolare, Jr. ..... D2/955
4,571,852 A * 2/1986 Lamarche ..... A43B 13/223 D2/951

(Continued)

FOREIGN PATENT DOCUMENTS

EP 1234516 8/2002
WO 2014167713 10/2014

*Primary Examiner* — Sharon M Prange

(57) ABSTRACT

A golf shoe comprising an upper, a midsole, and an outsole comprising a first set of spiral pathways with a first plurality of spiral segments radiating from a first point of origin and a second set of spiral pathways with a second plurality of spiral segments radiating from a second point of origin. The first set of spiral pathways and the second set of spiral pathways are inversely related and superimposed to form a plurality of tiles across the outsole, the plurality of tiles having a plurality of sides or edges formed by a plurality of sub-segments associated with the first plurality of spiral segments and the second plurality of spiral segments. The outsole may comprise a plurality of traction members with sidewalls extending from the sides or edges of the tiles to form a ground contacting or ground penetrating portion of the traction members.

20 Claims, 60 Drawing Sheets

Related U.S. Application Data

11,497,272, which is a continuation-in-part of application No. 16/745,525, filed on Jan. 17, 2020, now Pat. No. 11,490,677, which is a continuation-in-part of application No. 16/226,861, filed on Dec. 20, 2018, now Pat. No. 11,019,874, which is a continuation-in-part of application No. 29/662,673, filed on Sep. 7, 2018, now Pat. No. Des. 894,563.

(56) References Cited

U.S. PATENT DOCUMENTS

| | | | | |
|---|---|---|---|---|
| 6,016,613 | A | 1/2000 | Campbell et al. | |
| 6,665,961 | B2 * | 12/2003 | Kobayashi | A43B 5/001 D2/954 |
| 6,705,027 | B1 * | 3/2004 | Campbell | A43C 15/162 36/59 C |
| 6,792,698 | B2 * | 9/2004 | Kobayashi | A43B 5/001 D2/951 |
| D605,838 | S * | 12/2009 | Foust | D2/951 |
| 7,762,009 | B2 * | 7/2010 | Gerber | A43B 13/26 36/59 C |
| 8,256,146 | B2 * | 9/2012 | Loverin | A43B 3/30 D2/954 |
| 9,332,803 | B2 * | 5/2016 | Kasprzak | A43C 15/167 |
| 9,883,716 | B2 | 2/2018 | Jones | |
| 10,004,294 | B2 * | 6/2018 | Swegle | A43B 3/0078 |
| 10,786,040 | B2 * | 9/2020 | Madore | A43B 13/188 |
| 11,206,893 | B2 * | 12/2021 | Winskowicz | A43B 7/20 |
| 11,206,897 | B2 | 12/2021 | Bell et al. | |
| 11,751,639 | B2 | 9/2023 | Ekstrom et al. | |
| 11,974,632 | B2 | 5/2024 | Bidal | |
| 2018/0242688 | A1 | 8/2018 | Madore | |
| 2020/0315285 | A1 | 10/2020 | Winskowicz et al. | |

* cited by examiner

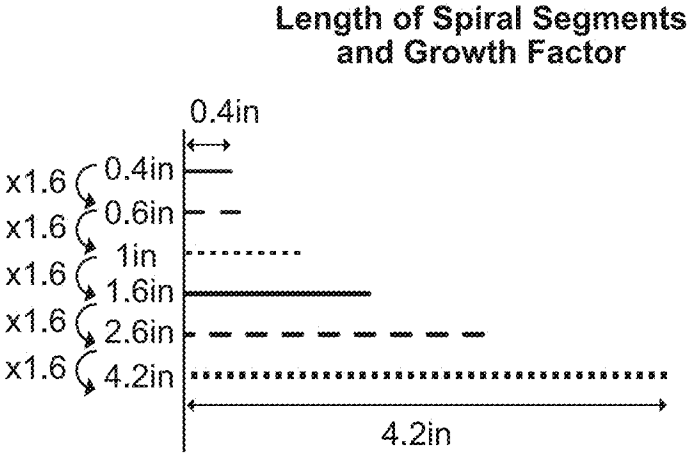
FIG. 4B (TABLE 1)
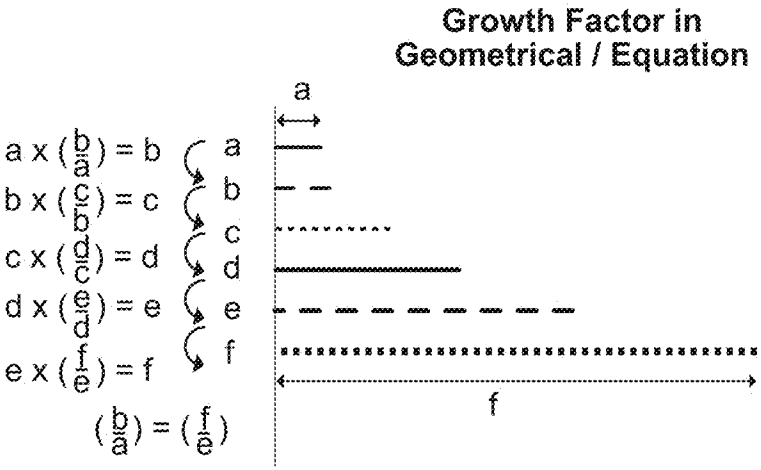
FIG. 4C (TABLE 2)
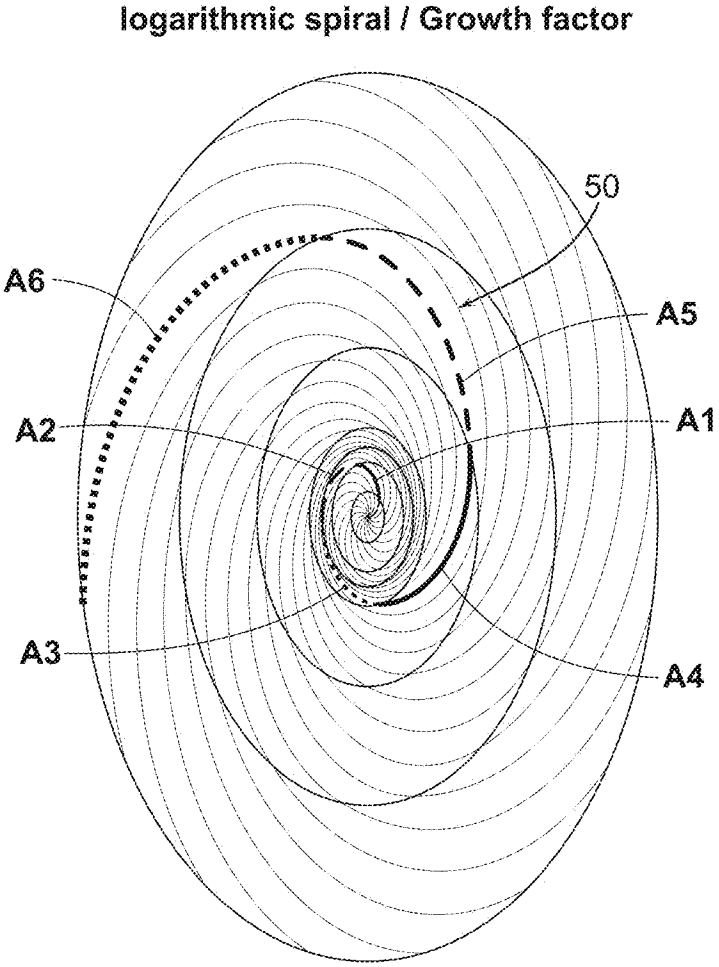
FIG. 4A

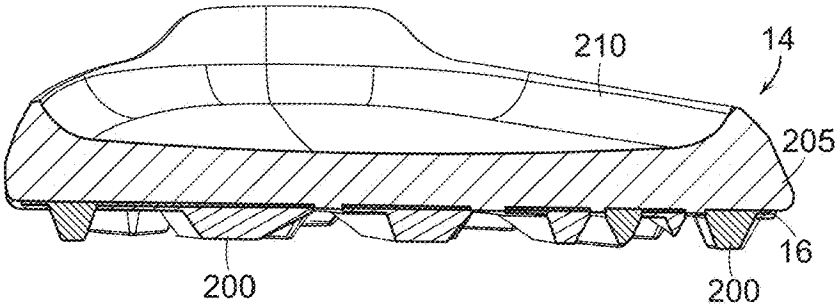
FIG. 26 B-B'
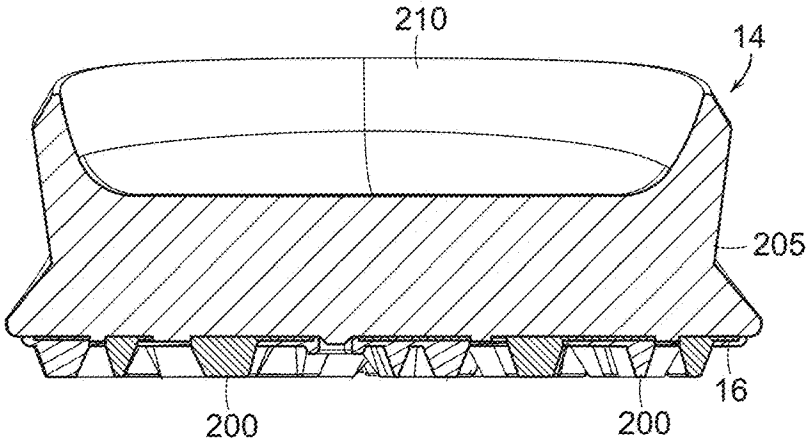
FIG. 25 A-A'

C-C'

Horizontal sidewalls configuration on Heel area provide resistance/traction while walking Down the Golf slopes or simply walking.

Vertical sidewalls disposition 1 provides Horizontal forces management resulting on more ground resistance/traction during a golf UP swing. (Right foot for right golfer)

Horizontal sidewalls configuration on Toe area provide resistance/traction while walking Up the Golf slopes or simply walking.

Vertical sidewalls disposition 2 provides Horizontal forces management resulting on more ground resistance/traction during a golf Down swing. (Right foot for right golfer)

GOLF SHOES HAVING MULTI-SURFACE TRACTION OUTSOLES

CROSS-REFERENCE TO RELATED APPLICATIONS

This application is a continuation-in-part of U.S. patent application Ser. No. 18/407,895 filed on Jan. 9, 2024, which is a continuation of co-assigned U.S. patent application Ser. No. 17/552,391 filed on Dec. 16, 2021, now issued as U.S. Pat. No. 12,075,887, which is a continuation-in-part of co-assigned U.S. patent application Ser. No. 17/024,250 filed on Sep. 17, 2020, now issued as U.S. Pat. No. 11,490,689, which is a continuation-in-part of co-assigned U.S. patent application Ser. No. 16/814,685 filed on Mar. 10, 2020, now issued as U.S. Pat. No. 11,497,272, which is a continuation-in-part of co-assigned U.S. patent application Ser. No. 16/745,525 filed on Jan. 17, 2020, now issued as U.S. Pat. No. 11,490,677, which is a continuation-in-part of co-assigned U.S. patent application Ser. No. 16/226,861 filed on Dec. 20, 2018, now issued as U.S. Pat. No. 11,019,874, which is a continuation-in-part of co-assigned U.S. patent application Ser. No. 29/662,673, filed on Sep. 7, 2018, now issued as U.S. Pat. No. D894,563, the entire disclosures of which are hereby incorporated by reference.

BACKGROUND OF THE INVENTION

The present invention relates generally to shoes and more particularly to golf shoes having improved outsoles. The outsole has different regions or zones of traction members that provide traction for on-course and off-course activities. The traction members are arranged on the outsole in a non-channeled pattern. The traction members and their distinct pattern on the outsole help provide a shoe with high traction and low turf-trenching properties. The outsole further minimizes damage to putting greens for the given amount of traction.

Both professional and amateur golfers use specially designed golf shoes today. Typically, the golf shoe includes an upper portion and outsole portion along with a mid-sole connecting the upper to the outsole. The upper has a traditional shape for inserting a user's foot and thus covers and protects the foot in the shoe. The upper is designed to provide a comfortable fit around the contour of the foot. The mid-sole is relatively lightweight and provides cushioning to the shoe. The outsole is designed to provide stability and traction for the golfer. The bottom surface of the outsole may include spikes or cleats designed to engage the ground surface through contact with and penetration of the ground. These elements help provide the golfer with better foot traction as he/she walks and plays the course.

Often, the terms, "spikes" and "cleats" are used interchangeably in the golf industry. Some golfers prefer the term, "spikes," since cleats are more commonly associated with other sports such as baseball, football, and soccer. Other golfers like to use the term, "cleats" since spikes are more commonly associated with non-turf sports such as track or bicycling. In the following description, the term, "spikes" will be used for convenience purposes. Golf shoe spikes can be made of a metal or plastic material. However, one problem with metal spikes is they are normally elongated pieces with a sharp point extending downwardly that can break through the surface of the putting green thereby leaving holes and causing other damage. These metal spikes also can cause damage to other ground surfaces at a golf course, for example, the carpeting and flooring in a clubhouse. Today, most golf courses require that golfers use non-metal spikes. Plastic spikes normally have a rounded base having a central stud on one face. On the other face of the rounded base, there are radial arms with traction projections for contacting the ground surface. Screw threads are spaced about the stud on the spike for inserting into a threaded receptacle on the outsole of the shoe as discussed further below. These plastic spikes, which can be easily fastened and later removed from the locking receptacle on the outsole, tend to cause less damage to the greens and clubhouse flooring surfaces.

If spikes are present on the golf shoe, they are preferably detachably fastened to receptacles (sockets) in the outsole. The receptacles may be located in a molded pod attached to the outsole. The molded pods help provide further stability and balance to the shoe. The spike may be inserted and removed easily from the receptacle. Normally, the spike may be secured in the receptacle by inserting it and then slightly twisting it in a clockwise direction. The spike may be removed from the receptacle by slightly twisting it in a counter-clockwise direction.

In recent years, "spikeless" or "cleatless" shoes have become more popular. These shoe outsoles contain rubber or plastic traction members but no spikes or cleats. These traction members protrude from the bottom surface of the outsole to contact the ground. The shoes are designed for on the golf course and off the course. That is, the shoes provide good stability and traction for the golfer playing the course including on the tees, fairways, and greens. Furthermore, the shoes are lightweight, and comfortable and can be used off the golf course. The shoes can be worn comfortably in the clubhouse, office, or other off-course places.

When a golfer swings a club and transfers his/her weight, their foot absorbs tremendous forces. For example, when a right-handed golfer is first planting his/her feet before beginning any club swinging motion (that is, when addressing the ball), their weight is evenly distributed between their front and back feet. As the golfer begins their backswing, their weight shifts primarily to their back foot. Significant pressure is applied to the back foot at the beginning of the downswing. Thus, the back foot can be referred to as the driving foot and the front foot can be referred to as the stabilizing foot. As the golfer follows through with their swing and drives the ball, their weight is transferred from the driving foot to the front (stabilizing) foot. During the swinging motion, there is some pivoting at the back and front feet, but this pivoting motion must be controlled. It is important the feet do not substantially move or slip when making the shot. Good foot traction is important during the golf shot cycle. Thus, traditional golf shoes have traction members and spikes positioned at different locations across the outsole.

For example, Bacon et al., U.S. Pat. No. 8,677,657 discloses a golf shoe outsole having hard thermoplastic polyurethane pods molded to a relatively soft and flexible thermoplastic polyurethane in the forward section and molded to a relatively hard TPU in the heel section. Each pod contains a cleat receptacle for inserting and removing cleats. Robinson, Jr. et al., U.S. Pat. No. 7,895,773 discloses a golf shoe having a collapsible and supportable gel pad contained in a recess of the outsole proximate to the metatarsal bone. The shoe includes relatively soft plastic spikes that can be replaced and relatively hard rubber cleats that cannot be replaced. After a given time period (for example, 3 months), and the replacement spikes have worn down, the golfer can replace them to restore traction. If the golfer wishes, he/she can choose the height of the replacement spike to match the height of the non-replaceable cleats which also may have worn down.

In other examples, the outsole may contain traction members, spikes, and/or cleats that are arranged in linear patterns with transverse and longitudinal rows extending across the outsole. For instance, Wen-Shown, U.S. Pat. No. 4,782,604 discloses a golf shoe outsole having multiple removable metal spikes (nails) and multiple soft cleats arranged in a linear pattern. The metal cleats are positioned in the ball portion and heel portion of the outsole. The soft cleats are positioned around the sole for the purpose of positioning, bearing load, and providing elasticity.

Kasprzak, U.S. Pat. No. 9,332,803 discloses a golf shoe outsole having cleats distributed along the forefoot and heel areas. The cleats are arranged in transverse rows along a longitudinal length of the outsole. The cleats are essentially cross-shaped. The forefoot includes a ball area and toe area. The ball area and the heel area have cleats with greater heights and widths than other areas of the sole. The cleats along the ball area and the heel area are substantially equal in height.

In another version, the traction members are arranged in circular patterns, where each traction element that is positioned in a ring has substantially the same radius and center as the other traction element in the ring. For example, Gerber, U.S. Pat. No. 8,011,118 discloses a shoe having an outsole with a circular tread pattern. The circular tread pattern includes a first circular tread having a first radius, wherein the first circular tread extends less than 360 degrees in a circumferential direction around a center of the circular tread pattern. The circular tread pattern also includes a second circular tread having a second radius greater than the first; and where the second circular tread also extends less than 360 degrees in a circumferential direction around a center of the circular tread. According to the '118 Patent, the circular tread pattern provides sufficient traction in all directions but also allows the wearer to pivot about a pivot portion.

However, one drawback with some conventional golf shoes is these shoes can damage the golf course turf. For example, the traction members, spikes, and cleats can drag along the surface damaging grass blades and roots. This damage can be referred to as a trenching effect. This tearing-up of the grass and roots makes the putting green and other course surfaces uneven. There are relatively raised and lowered surfaces and this leads to discoloration and browning of the turf. The penetration of the ground surface and trenching of the turf by the shoe outsole causes problems for the golfer in all phases of the game. For example, turf-trenching can affect the golfer when he/she is driving the ball from the tee, making shots on the fairway, and putting on the greens, and even when walking the course. Even if golfers are careful, they can cause damage to the greens when walking and putting. Particularly, this is a problem when the putting greens are wet. The trenching of grass and soil can slow the overall flexibility and pivoting action of the shoe. Also, the digging-up and clogging of turf in the outsole can make the golfer feel awkward and uncomfortable when walking the course or swinging the club to make a shot. When traction members and cleats are arranged in a linear configuration across the outsole, this turf-trenching effect occurs in both the 90 degree and 0 degree directions as discussed in further detail below. On the other hand, when cleats are arranged in overlapping circular patterns (double-radial configuration), there tends to be little turf-trenching in the 90 degree directions, but there is more turf-trenching in the 0 degree directions. In yet another embodiment, when the cleats are arranged in a concentric circular pattern, there can be trenching in various directions including the rotational direction as also discussed in further detail below.

Thus, there is a need for a golf shoe having an improved outsole that can provide a high level of stability and traction. The shoe should hold and support the medial and lateral sides of the golfer's foot as they shift their weight when making a golf shot. The shoe should provide good traction so there is no slipping and the golfer can stay balanced. At the same time, the outsole of the shoe should have minimal turf-trenching properties. A golfer wearing the shoe should be able to comfortably walk and play the course with minimal damage to the course turf. The present invention provides new golf shoe constructions that provide improved traction to the golfer as well as other advantageous properties, features, and benefits including minimal turf trenching properties.

SUMMARY OF THE INVENTION

The present invention provides a golf shoe having an outsole comprising different zones of tiles. Each zone contains different traction members for gripping both golf course and off-golf course surfaces. The traction members are arranged on the outsole in a non-channeled pattern. The traction members and their distinct pattern on the outsole help provide a shoe with high traction and minimal turf-trenching properties. The outsole further minimizes damage to putting greens and other surfaces such as clubhouse flooring. The shoes provide less damage to the golf course for a given amount of traction.

The shoe includes an upper portion and outsole portion along with a midsole connecting the upper to the outsole. Looking at the bottom surface of the outsole, it contains sets of spiral pathways that intersect each other. For example, one set of spiral pathways can be referred to as Set A; and the other set can be referred to as Set B. Each spiral pathway in Set A has a common point of origin and contains a plurality of spiral segments radiating from that point. Each spiral segment in Set A has a different degree of curvature. Similar to the A set of spiral pathways, each spiral pathway in set B has a common point of origin and contains a plurality of spiral segments radiating from that point. Each spiral segment in Set B also has a different degree of curvature. The first set of spiral pathways (A) is logarithmic or normal, and the second set of spiral pathways (B) is an inverse of the first set (A). Thus, the sets of spiral pathways (A) and (B) can be superposed over each other. When the spiral pathways in sets (A) and (B) are superposed over each other, the curved sub-segments of spiral segments from set A and the curved sub-segments of spiral segments from set B are pieced together to create four-sided tile pieces. The intersecting points between the superposed sets of spiral pathways (A) and (B) form the corners of these tile pieces. In the outsole of this invention, these tile pieces contain projecting traction members.

For example, looking at the outsole of a right shoe, the forefoot region of the outsole includes a first (lateral) zone of tiles containing protruding traction members extending along the periphery of the forefoot region. These traction members in the lateral zone are primarily used for golf-specific traction, that is, these traction members help control forefoot lateral traction, and prevent the foot from slipping during a golf shot. A third (medial) zone of tiles contains protruding traction members extending along the opposing periphery of the forefoot region. These traction members in the medial zone provide a high contact surface area to prevent slipping on hard, wet, and smooth surfaces. All of the traction members provide maximum contact with the ground surface for the given amount of traction member material (for example, rubber) in that specific zone. A second (middle) zone of tiles containing protruding traction members is disposed between the first and third zones. These traction members in the middle zone are relatively softer and more compliant than the traction members in the neighboring lateral and medial zones. These traction members provide comfort and tend to distribute pressure from the middle (second) zone out to the periphery of the sole, that is, toward the lateral (first) and medial (third) zones. Thus, the middle zone acts as a comfort zone relieving the pressure placed on the center of the sole and pushing it to the lateral and medial sides of the sole. The pattern of the traction members in the lateral and medial zones provides improved traction on both hard and soft surfaces as discussed further below. In one preferred embodiment, the traction members are made from a rubber material and the traction members in all of the zones provide maximum gripping power per volume of rubber material used. The mid-foot and rear-foot regions of the outsole include similar zones and traction members as discussed further below.

There also can be an oval pattern (OV1) having a center point superposed on the spiral pathways, the center point of the oval pattern (OV1) and the point of origin of the first set of spiral pathways (A) being the same fixed point; wherein the first segment in each spiral pathway has a proximal end and distal end, and the oval pattern intersects the distal ends of the first segments. There also can be an oval pattern (OV2) having a center point superposed on the spiral pathways, the center point of the oval pattern (OV2) and the point of origin of the second set of spiral pathways (B) being the same fixed point; wherein the second segment in each spiral pathway has a proximal end and distal end, and the oval pattern intersects the distal ends of the second segments.

In one embodiment, the tile pieces contain traction members, wherein a plurality of tile pieces comprise a first protruding traction member, an opposing second protruding traction member, and a non-protruding segment disposed between the first and second traction members. first traction member has a hardness greater than the second traction. Preferably, the first and second traction members each comprise a thermoplastic polyurethane composition. In one embodiment, the first and second traction members have different hardness values. In another embodiment, the first and second traction members have substantially the same hardness. Also, the first and second traction members can have different or substantially the same heights. The non-protruding segment (window) disposed between the first and second traction members preferably comprises an ethylene vinyl acetate composition.

In the forefoot region, the outsole may comprise a first zone of tiles containing protruding traction members extending along the anterior portion of the forefoot region; a second zone of tiles containing protruding traction members extending along the periphery of the forefoot region; and a third zone of tiles containing protruding traction members extending along the opposing periphery of the forefoot region, the second and third zones being adjacent to the first zone and the traction members in the first, second, and third zones having different dimensions. The outsole also may comprise a zone of tiles containing protruding traction members extending along the mid-foot region. Further, in the rear-foot region, the outsole may comprise a first zone of tiles containing protruding traction members extending along the posterior portion of the rear-foot region; a second zone of tiles containing protruding traction members extending along the periphery of the rear-foot region; and a third zone of tiles containing protruding traction members extending along the opposing periphery of the rear-foot region, the second and third zones being adjacent to the first zone and the traction members in the first, second, and third zones having different dimensions.

The traction members in the zones may have different structures, geometric shapes and dimensions. In one embodiment, the traction members have a triangular-shaped, non-recessed top surface that forms a ground contacting surface, and wherein the total ground contact surface area is in the range of about 10 to about 70% based on total surface area of the tile.

The outsole may have a longitudinal flex groove and may have different zones of traction members. For example, four different zones comprising different materials have a different hardness. Preferably, the hardness of the medial forefoot region zone has a similar hardness to the lateral rear-foot region zone and the lateral forefoot region zone has a similar hardness as the medial rear-foot region zone.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

FIG. 4A is a top plan view of one example of a first set of logarithmic (normal) spiral pathways (A) showing a spiral pathway containing different spiral pathway segments, wherein the length of the spiral segments increases by a growth factor;

FIG. 4B is Table 1 showing the length of the spiral pathway segments as shown in FIG. 4A, and their respective growth factor;

FIG. 4C is Table 2 showing the length of the spiral pathway segments as shown in FIG. 4A, and their respective growth factor in a geometrical equation;

FIG. 25 is a cross-sectional view of the outsole in FIG. 24 along Line A-A';

FIG. 26 is a cross-sectional view of the outsole in FIG. 24 along Line B-B';

DETAILED DESCRIPTION OF THE INVENTION

Figure 1:
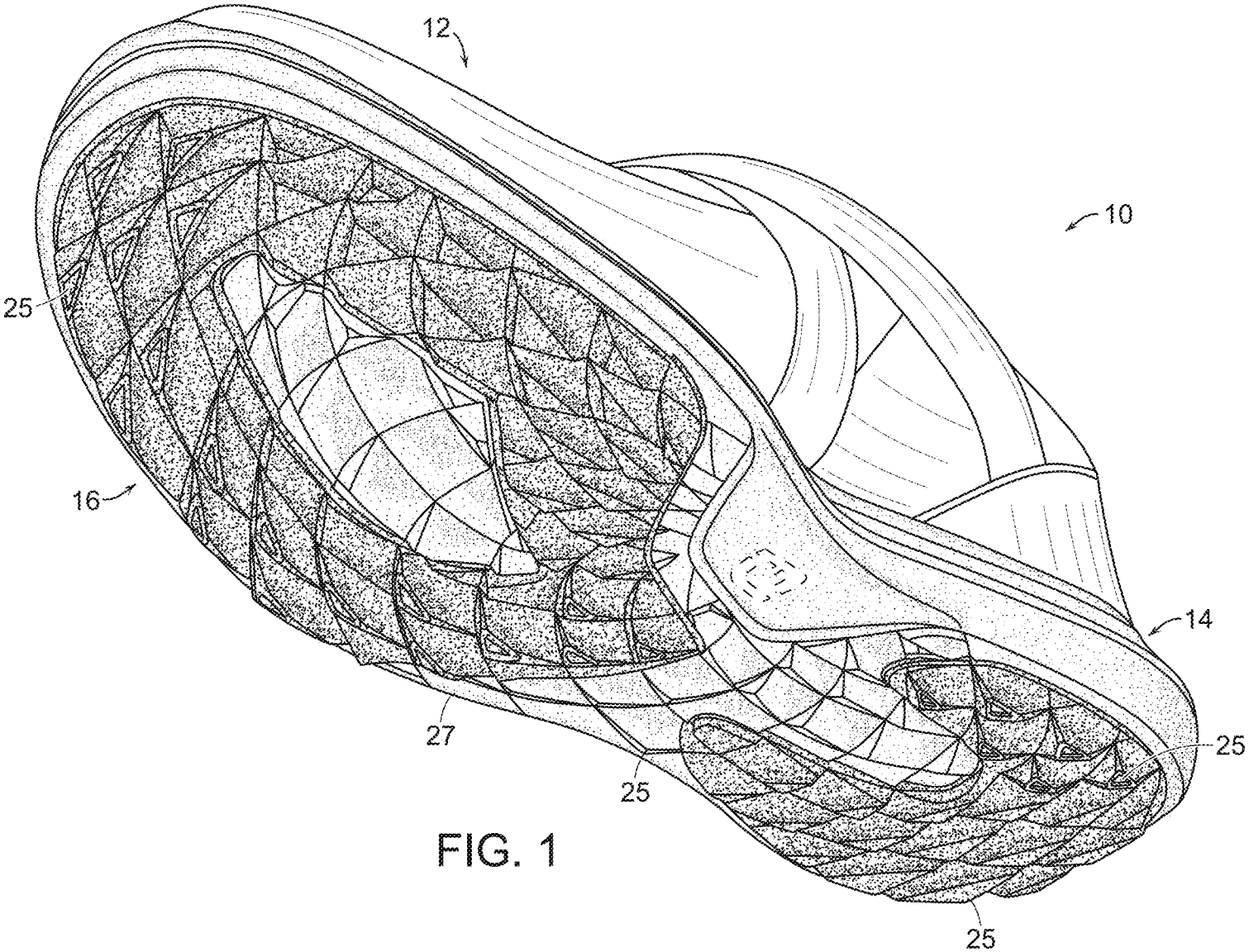
FIG. 1 is a perspective view of one embodiment of a golf shoe of the present invention showing the outsole in detail.

Referring to the Figures, where like reference numerals are used to designate like elements, and particularly FIG. 1, one embodiment of the golf shoe (10) of this invention is shown. The shoe (10) includes an upper portion (12) and outsole portion (16) along with a midsole (14) connecting the upper (12) to the outsole (16). The views shown in the Figures are of a right shoe and it is understood the components for a left shoe will be mirror images of the right shoe. It also should be understood that the shoe may be made in various sizes and thus the size of the components of the shoe may be adjusted depending upon the shoe size.

Figure 1A:
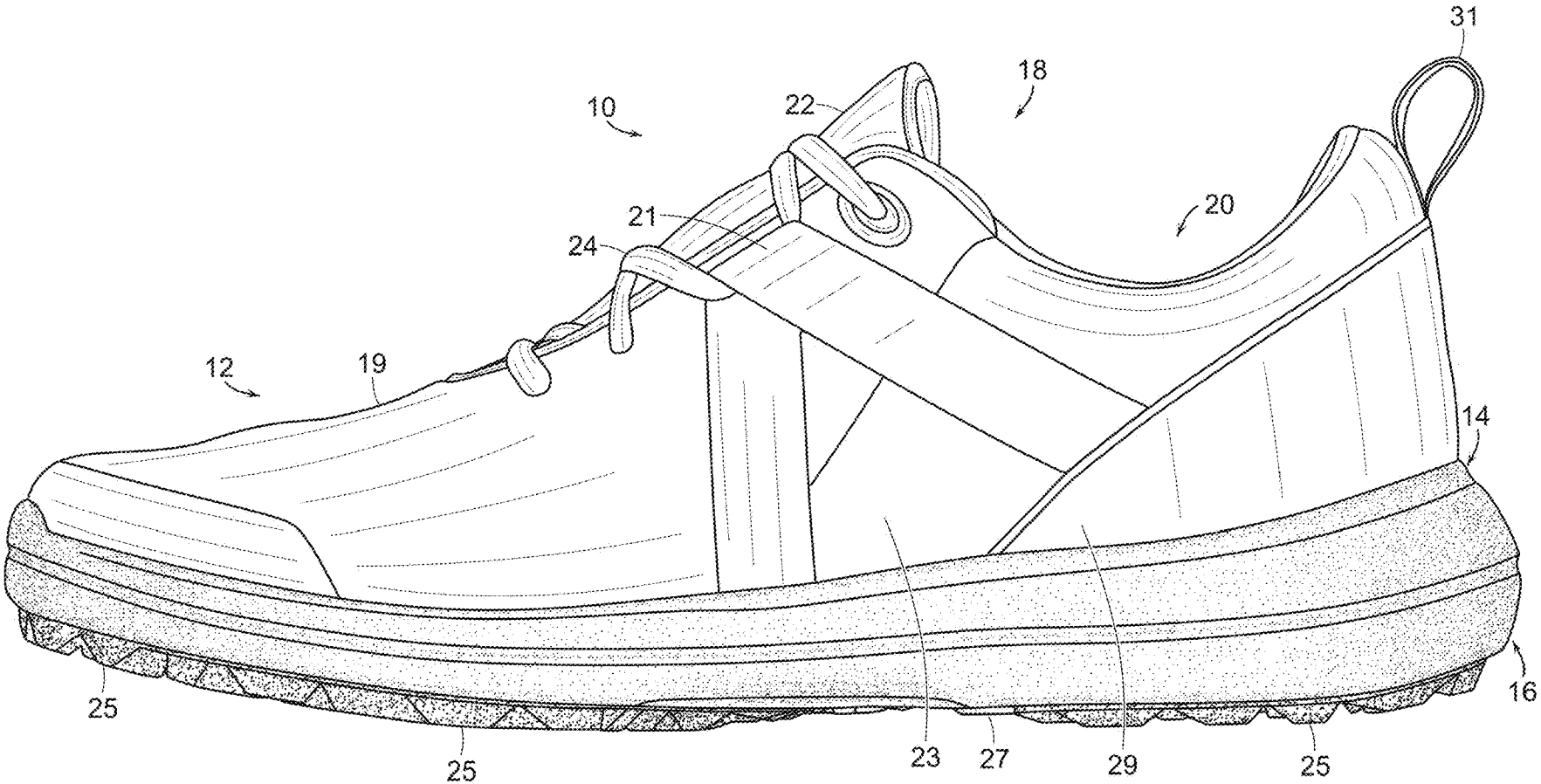
FIG. 1A is a medial side view of one embodiment of a golf shoe of the present invention showing the upper in detail.

The upper (12) has a traditional shape and is made from a standard upper material such as, for example, natural leather, synthetic leather, knits, non-woven materials, natural fabrics, and synthetic fabrics. For example, breathable mesh, and synthetic textile fabrics made from nylons, polyesters, polyolefins, polyurethanes, rubbers, and combinations thereof can be used. The material used to construct the upper is selected based on desired properties such as breathability, durability, flexibility, and comfort. In one preferred example, the upper (12) is made of a mesh material. The upper material is stitched or bonded together to form an upper structure. Referring to FIG. 1A, the upper (12) generally includes an instep region (18) with an opening (20) for inserting a foot. The upper includes a vamp (19) for covering the forepart of the foot. The instep region includes a tongue member (22) and a saddle strip (21) overlying the quarter section (23) of the upper and attached to the foxing (29) in the heel region. The upper (12) may include an optional ghillie strip (31) extending from the rear area of the instep region (18). Normally, laces (24) are used for tightening the shoe around the contour of the foot. However, other tightening systems can be used including metal cable (lace)-tightening assemblies that include a dial, spool, and housing and locking mechanism for locking the cable in place. Such lace tightening assemblies are available from Boa Technology, Inc. It should be understood that the above-described upper (12) shown in FIGS. 1 and 1A represents only one example of an upper design that can be used in the shoe construction of this invention and other upper designs can be used without departing from the spirit and scope of this invention.

The midsole (14) is relatively lightweight and provides cushioning to the shoe. The midsole (14) can be made from a standard midsole material such as, for example, foamed ethylene vinyl acetate copolymer (EVA) or polyurethane. In one manufacturing process, the midsole (14) is molded on and about the outsole. Alternatively, the midsole (14) can be molded as a separate piece and then joined to the top surface (not shown) of the outsole (16) by stitching, adhesives, or other suitable means using standard techniques known in the art. For example, the midsole (14) can be heat-pressed and bonded to the top surface of the outsole (16).

In general, the outsole (16) is designed to provide stability and traction for the shoe. The bottom surface (27) of the outsole (16) includes multiple traction members (25) to help provide traction between the shoe and grass on the course. The bottom surface of the outsole and traction members can be made of any suitable material such as rubber or plastics and combinations thereof. Thermoplastics such as nylons, polyesters, polyolefins, and polyurethanes can be used. Suitable rubber materials that can be used include, but are not limited to, polybutadiene, polyisoprene, ethylene-propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers, butyl rubber, nitrile rubber, and blends of two or more thereof. The structure and functionality of the outsole (16) of the present invention is described in further detail as follows.

Figures 2A, 2B, 2C:
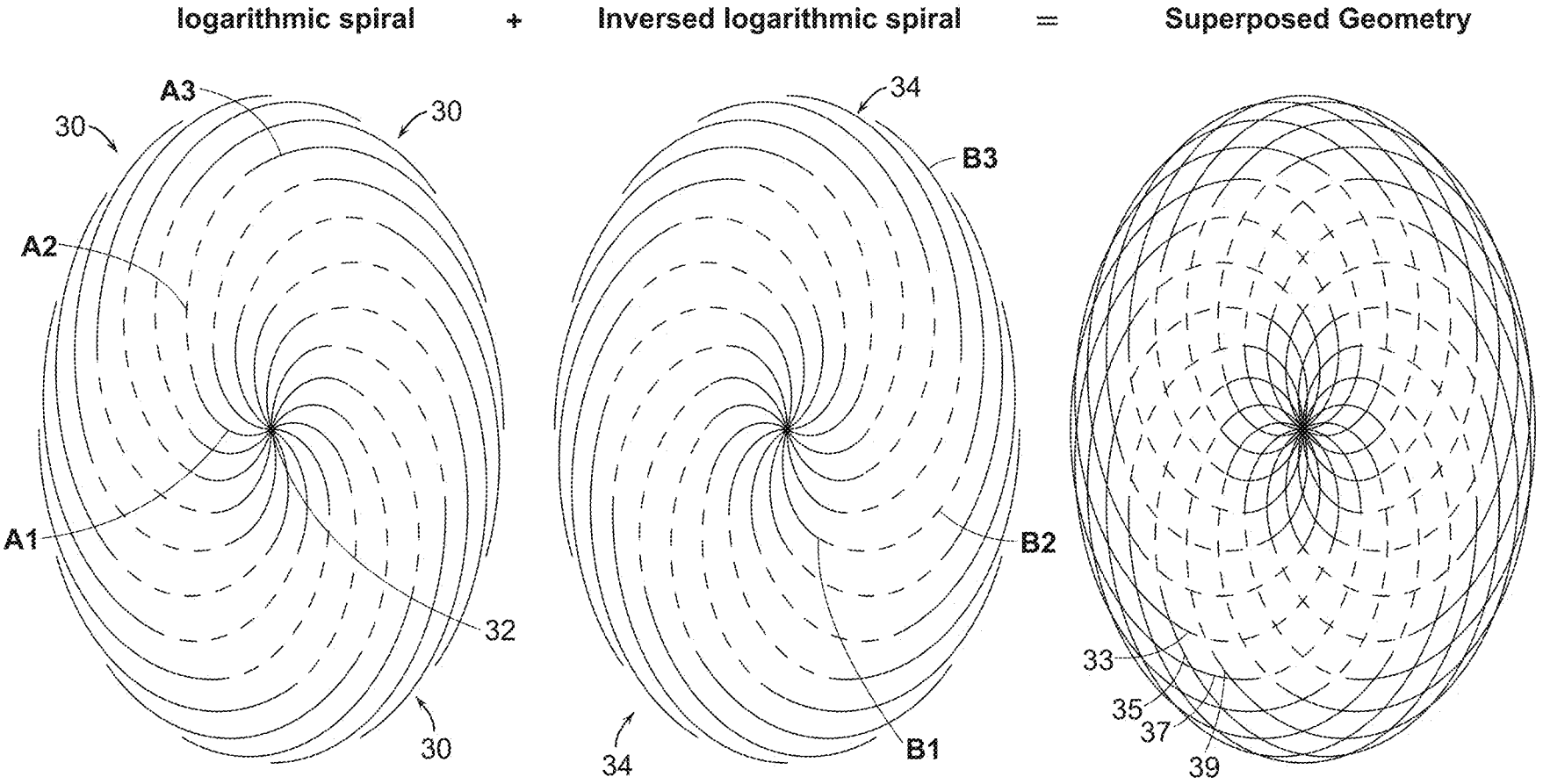
FIG. 2A is a top plan view of a first set of logarithmic (normal) spiral pathways (A) for one embodiment of a golf shoe of the present invention.
FIG. 2B is a top plan view of a second set of logarithmic (inversed) spiral pathways (B) and is an inverse of the first set of logarithmic (normal) spiral pathways (A) shown in FIG. 2A.
FIG. 2C is a top plan view of the second set of logarithmic (inversed) spiral pathways (B) shown in FIG. 2B superposed over the first set of logarithmic (normal) spiral pathways (A) shown in FIG. 2A.

In FIG. 2A, a first set of spiral pathways (A) is shown. Each spiral pathway (30) has a common point of origin (32) and contains a plurality of spiral segments (for example, A1, A2, and A3) radiating from that point (32). Each segment (A1, A2, and A3) has a different degree of curvature. Turning to FIG. 2B, a second set of spiral pathways (B) is shown. Similar to the (A) set of spiral pathways, each spiral pathway (34) in set (B) has a common point of origin (36) and contains a plurality of spiral segments (for example, B1, B2, and B3) radiating from that point (36). Each segment (B1, B2, and B3) has a different degree of curvature. The first set of spiral pathways (A) is logarithmic or normal, and the second set of spiral pathways (B) is an inverse of the first set (A). Thus, the sets of spiral pathways (A) and (B) can be superposed over each other as shown in FIG. 2C.

When the spiral pathways in sets (A) and (B) are superposed over each other, the curved sub-segments of spiral segments from set A and the curved sub-segments of spiral segments from set B are pieced together to create four-sided tile pieces. In FIG. 2C, a four-sided tile having spiral sub-segment sides (33, 35, 37, and 39) is shown. The intersecting points between the superposed sets of spiral pathways (A) and (B) form the corners of these tile pieces. In the shoe of this invention, these tile pieces are positioned on the outsole and contain projecting traction members—they are described in further detail below.

Figure 3B:
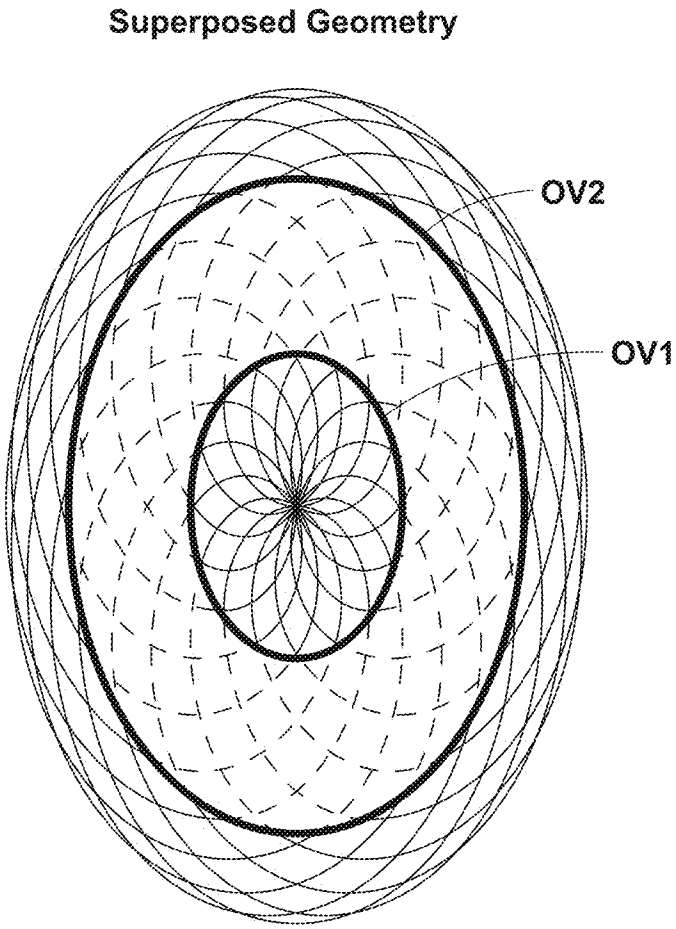
FIG. 3B is a top plan view of the superposed first set of logarithmic (normal) spiral pathways (A) and second set of logarithmic (inversed) spiral pathways (B) as shown in FIG. 2C with oval pattern (OV1) and oval pattern (OV2) overlying the superposed spiral pathways with the understanding that these oval patterns are for illustration purposes only and do not appear as visible marks or indicia on the outsole of the shoe.
Figure 3A:
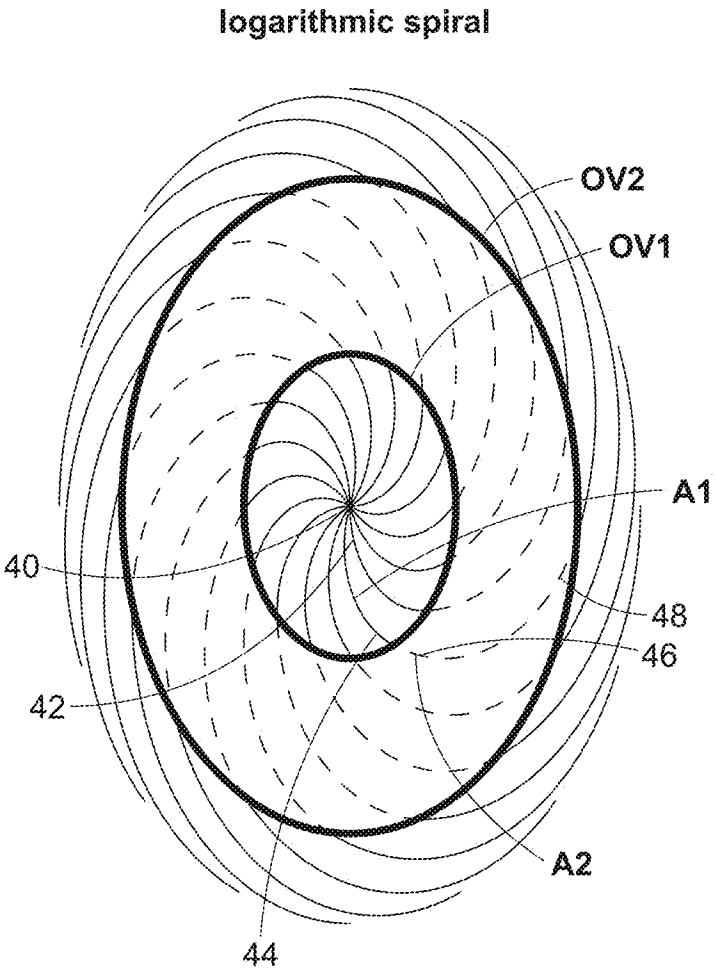
FIG. 3A is a top plan view of a first set of logarithmic (normal) spiral pathways (A) shown in FIG. 2A with oval pattern (OV1) and oval pattern (OV2) overlying the spiral pathways with the understanding that these oval patterns are for illustration purposes only and do not appear as visible marks or indicia on the outsole of the shoe.

The geometry of the spiral pathways is shown in further detail in FIG. 3A. In this view, the first set of logarithmic (normal) spiral pathways (A) (FIG. 2A) includes oval pattern (OV1) and oval pattern (OV2) intersecting the different spiral pathways. It should be understood that the oval patterns (OV1 and OV2) are used herein to further describe the spiral pathways (A and B) and are intended for illustration purposes only. The oval patterns (OV1 and OV2) do not appear as visible marks or indicia on the outsole of the shoe. More particularly, the oval pattern (OV1) has a center point (40), and, as shown in FIG. 3A, the center point (40) of the oval pattern (OV1) and point of origin (32) of the first segment (A1) of spiral pathway (A) are the same fixed point. The first segment (A1) in each spiral pathway (A) also has a proximal end (42) and distal end (44). The oval pattern (OV1) intersects the distal ends (44) of the first segments (A1) of spiral pathway (A).

As further shown in FIG. 3A, an oval pattern (OV2) having the same center point (40) also overlies the spiral pathways (A). The center point of the oval pattern (OV2) and the point of origin (32) of the second segment (A2) of spiral pathway (A) are the same fixed point. The second segment (A2) in each spiral pathway (B) also has a proximal end (46) and distal end (48). The oval pattern (OV2) intersects the distal ends (48) of the second segments (A2) of the spiral pathways (A).

The first set of logarithmic (normal) spiral pathways (A) and second set of logarithmic (inversed) spiral pathways (B), which are superposed over each other as shown in FIG. 2C, are shown with overlying and intersecting oval patterns (OV1 and OV2) for illustration purposes in FIG. 3B. It should be understood that the number of spiral pathways in the pattern and number of spiral segments in a given spiral pathway is unlimited. In FIGS. 3A and 3B, a spiral pathway containing three spiral segments (A1, A2, and A3) is shown for illustration purposes, but there can be an ad infinitum number of segments and these segments can be scaled to any size as described further below.

Referring to FIGS. 4A-4C, the path lengths of some exemplary spiral segments comprising the spiral pathways are shown in more detail. In FIG. 4A, one example of a first set of logarithmic (normal) spiral pathways (A) with a spiral pathway containing multiple spiral segments is shown. The length of the spiral path segments increases by a constant growth factor. In particular, for this example, the spiral pathway (50) comprises a first spiral segment (A1); a second spiral segment (A2); a third spiral segment (A3); a fourth spiral segment (A4); a fifth spiral segment (A5); and a sixth spiral segment (A6). These spiral segments increase by a constant growth factor along the entire spiral pathway. For example, if the length of the spiral segment A1 is 0.4 inches; and the length of spiral segment A2 is 0.6 inches; and the length of spiral segment A3 is 1 inch, the growth factor is 1.6. This growth factor of the different segments stays the same as the spiral pathway continues to grow as shown in Table 1 of FIG. 4B. That is, the growth factor stays consistent (for example, the growth factor can be 1.6) throughout the full spiral pathway. This example of a growth factor can be expressed in a geometrical equation as shown in Table 2 of FIG. 4C. As shown in FIGS. 4A-4C, there can be multiple spiral segments and there can be multiple oval patterns intersecting the different segments of the spiral pathways.

Figure 5B:
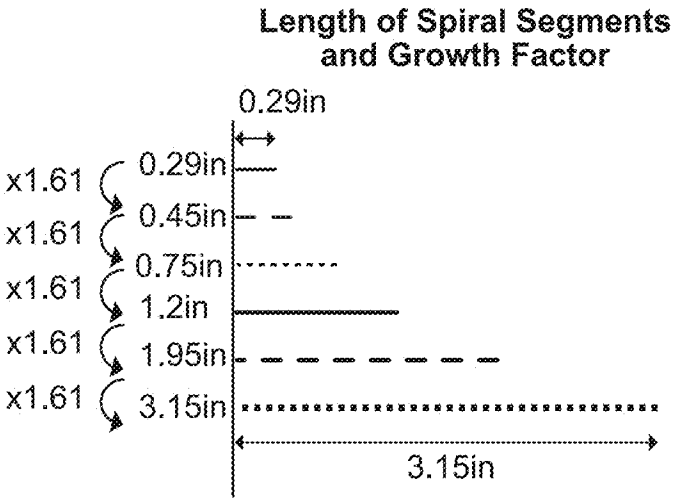
FIG. 5B is Table 3 showing the length of the spiral pathway segments as shown in FIG. 5A, and their respective growth factor.
Figure 5C:
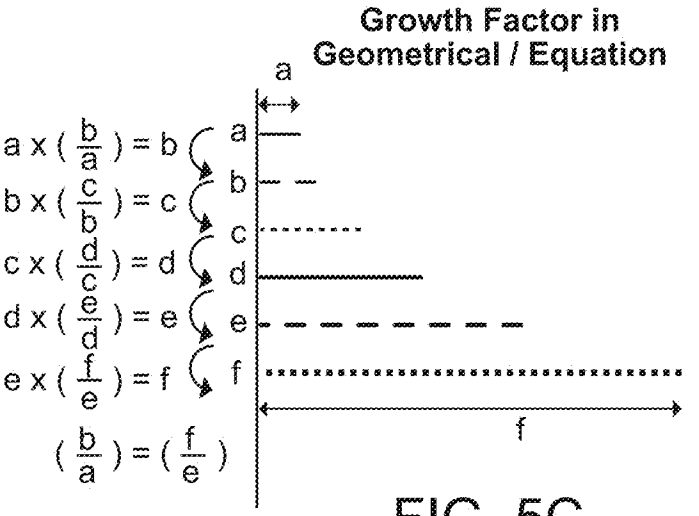
FIG. 5C is Table 4 showing the length of the spiral pathway segments as shown in FIG. 5A, and their respective growth factor in a geometrical equation.
Figure 5A:
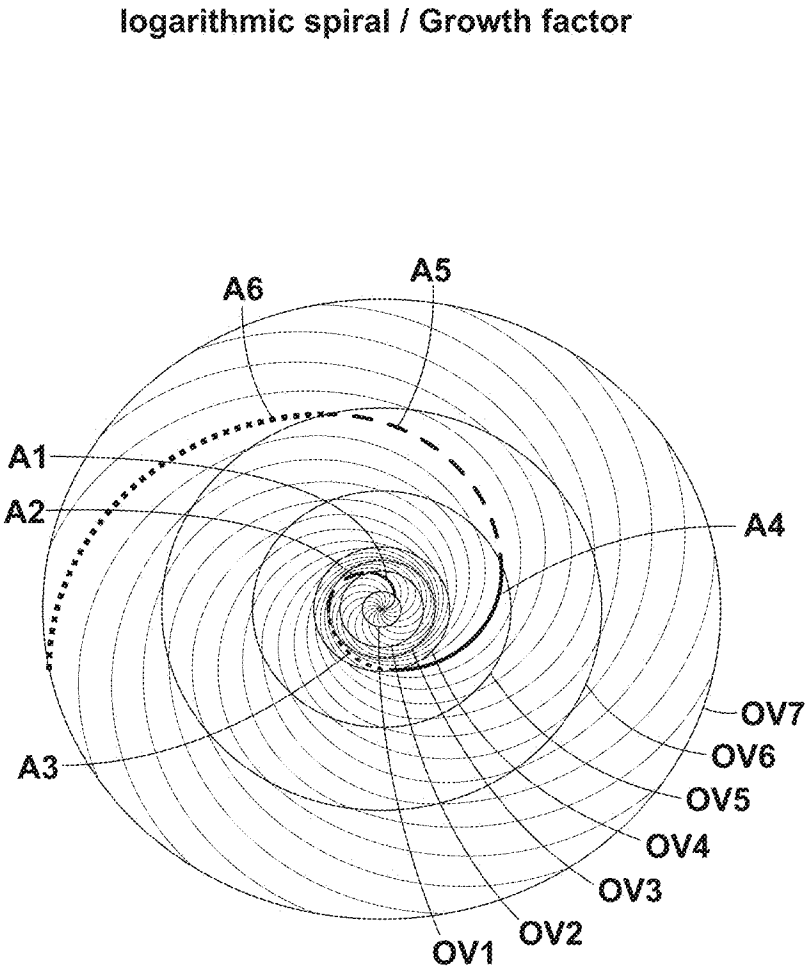
FIG. 5A is a top plan view of a second example of a first set of logarithmic (normal) spiral pathways (A) showing a spiral pathway containing different spiral pathway segments, wherein the length of the spiral segments increases by a growth factor.

In FIGS. 5A-5C, another example of a spiral pathway containing multiple spiral pathway segments (A1, A2, A3, A4, A5, and A6) with a different growth factor is shown. In this example, the length of the spiral segment A1 is 0.29 inches; and the length of spiral segment A2 is 0.45 inches; and the length of spiral segment A3 is 0.75 inches, with a growth factor is 1.61. This growth factor of the different segments stays the same as the spiral pathway grows and extends outwardly as shown in Table 3 of FIG. 5B. That is, the growth factor stays consistent (in this example, the growth factor is 1.61) throughout the spiral pathway. This growth factor can be expressed in a geometrical equation as shown in Table 4 of FIG. 5C. Thus, the growth of the spiral pathways is organic and clean and can be expressed in mathematical equations as shown in the examples of FIGS. 4A-4C and FIGS. 5A-5C. The spiral pathways provide the outsole of the shoe with a natural and organic look.

Figure 6D:
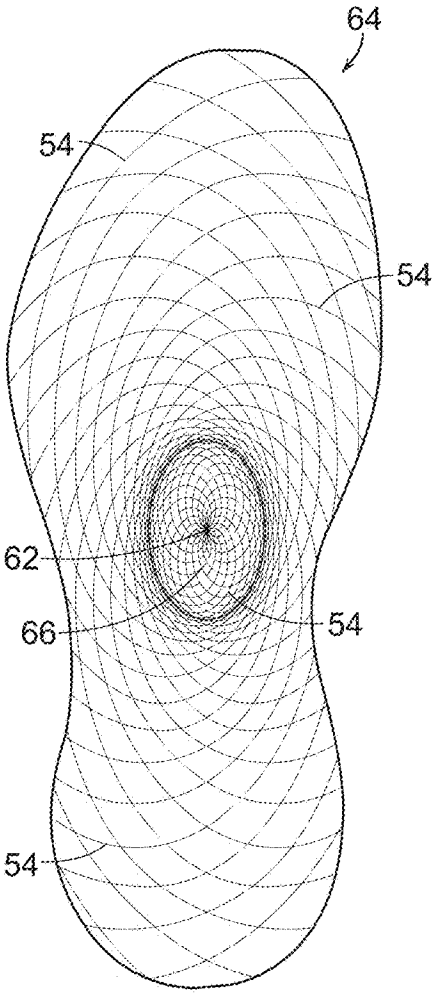
FIG. 6D is a bottom plan view of one example of an outsole of the present invention showing the point of origin of the spiral pathways in the central mid-foot region of the outsole, wherein the spiral pathways are on a smaller scale than the spiral pathways shown in FIGS. 6A-6C.
Figure 6C:
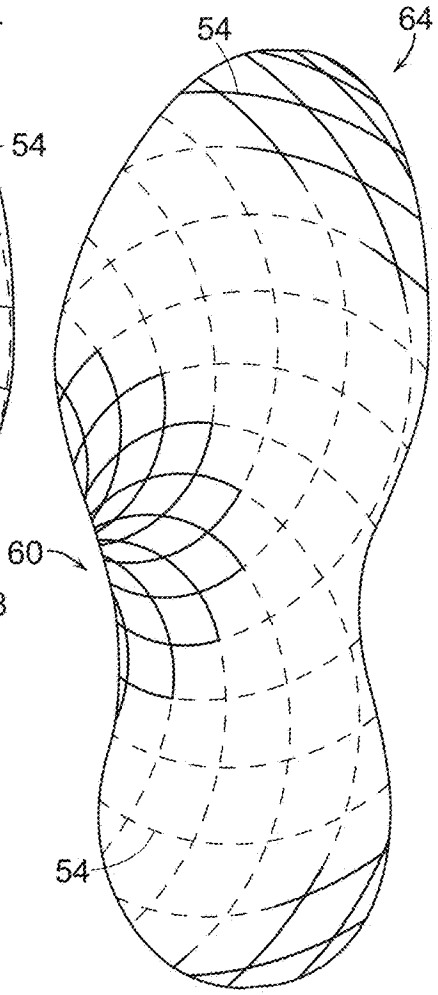
FIG. 6C is a bottom plan view of one example of an outsole of the present invention showing the point of origin of the spiral pathways outside the lateral mid-foot region of the outsole.
Figure 6B:
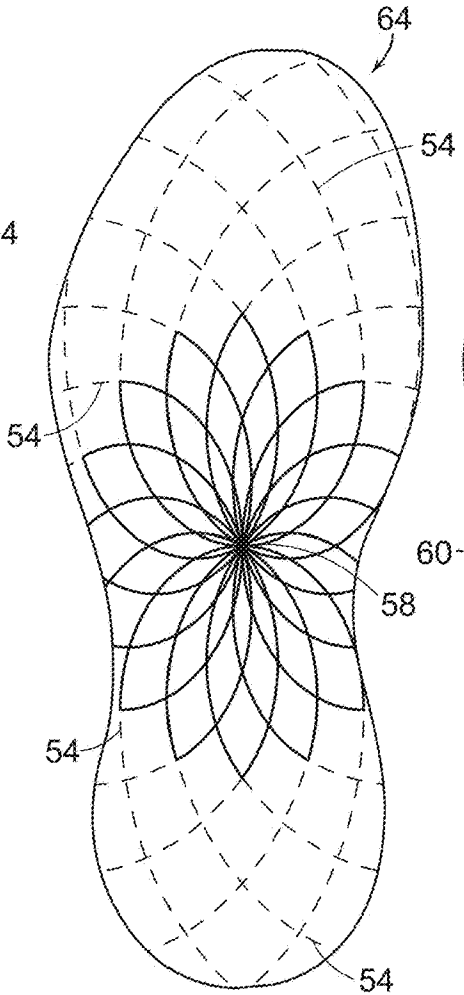
FIG. 6B is a bottom plan view of one example of an outsole of the present invention showing the point of origin of the spiral pathways in the central mid-foot region of the outsole.
Figure 6A:
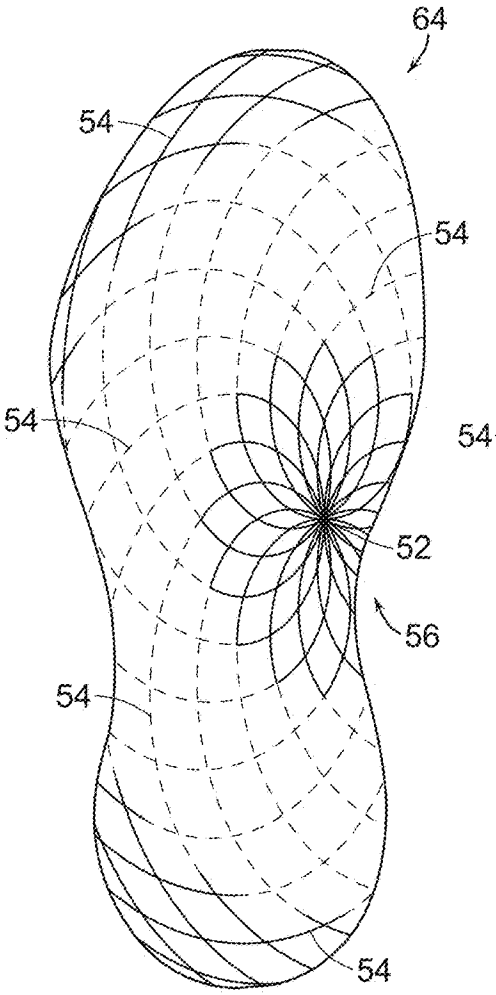
FIG. 6A is a bottom plan view of one example of an outsole of the present invention showing the point of origin of the spiral pathways in the arch area of the outsole.

It should be understood that the point of origin of the spiral pathways can be at various locations. Referring to FIGS. 6A-6D, an outsole of a right shoe (64) is shown containing the spiral pathways superposed over each other as discussed above. In FIG. 6A, the point of origin (52) of the spiral pathways (54) is shown in the arch area (56) of the outsole. In FIG. 6B, the point of origin (58) of the spiral pathways (54) is shown in the central mid-foot region of the outsole. In FIG. 6C, the point of origin of the spiral pathways (54) is outside the lateral edge (60) of the mid-foot region of the outsole; and in FIG. 6D, the point of origin (62) is shown in the central mid-foot region of the outsole, wherein the lengths of the spiral segments and spiral pathways are miniaturized (66). The spiral segments and spiral pathways shown in FIG. 6D are on a much smaller scale than the spiral segments and spiral pathways shown in FIGS. 6A-6C.

Figure 7:
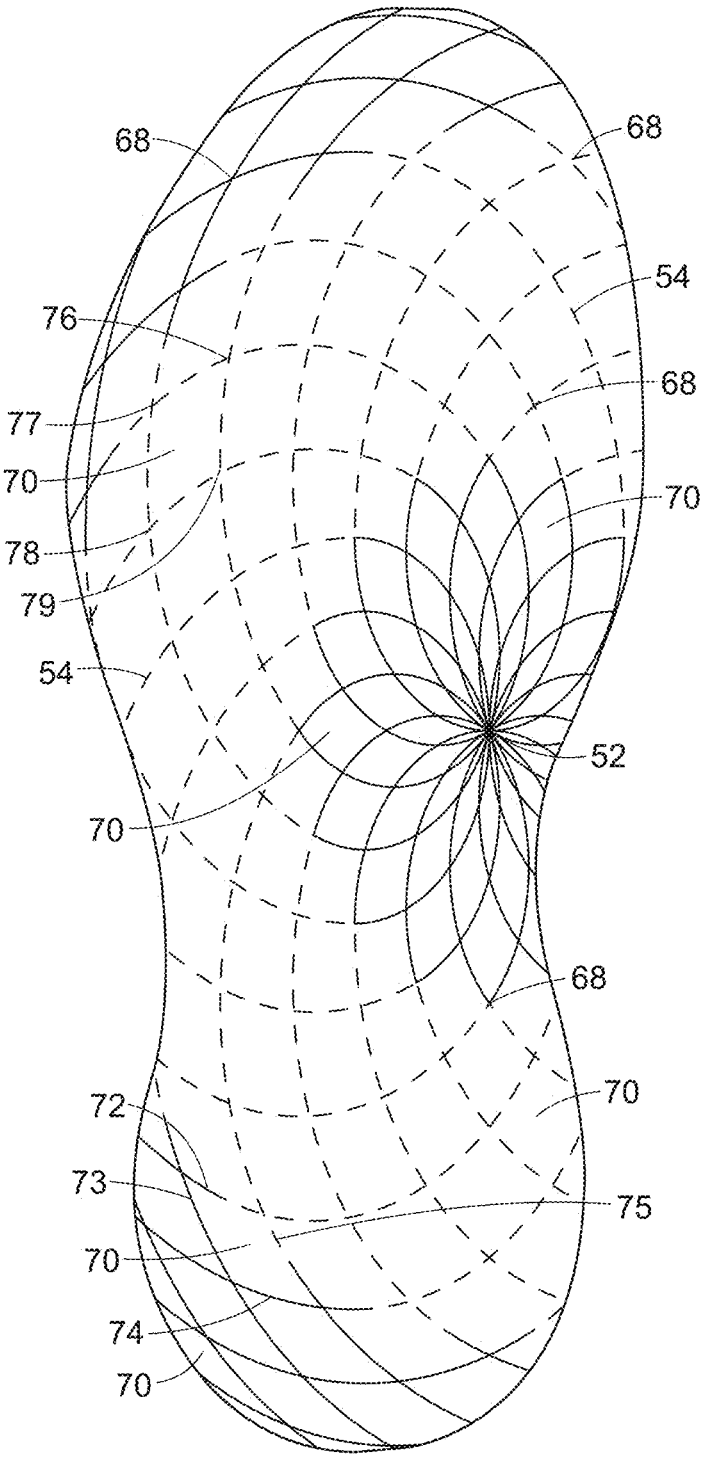
FIG. 7 is a close-up view of the outsole shown in FIG. 6A, where the focal point of the spiral pathways is on the medial side and in the arch area of the outsole.

Referring to FIG. 7, the outsole of FIG. 6A, where the focal point (52) of the spiral pathways (54) is on the medial side and in the arch area of the outsole is shown in more detail. Here, the intersecting points (68) between the different arc pathways (54) and the generation of the four-side tile pieces (70) is shown in more detail. The curved sub-segments (72, 73, 74, and 75) of a spiral segment are pieced together to create substantially four-sided tile pieces (70) on the outsole of the shoe. The intersecting points between the superposed sets of spiral pathways (A) and (B) form the corners of these tile pieces (for example, the corners can be seen as 76, 77, 78, and 79.) These individual tile pieces (70) contain different traction members (not shown in FIG. 7) as discussed further below.

As described above, in one example, the outsole comprises a first set of arc pathways having a center point located on the medial side of the forefoot region and extending along the forefoot region in a generally longitudinal direction. The radius of each arc pathways increases from the center point as the arcs extend along the forefoot region. A second set of arc pathways have a center point located on the posterior end of the forefoot region and extend along the forefoot region in a generally transverse direction. The radius of each arc pathway increases from the center point as the arcs extend along the forefoot region.

When the first and second arc pathways are superposed over each other, four-sided tile pieces are formed on the surface of the forefoot region. In one embodiment, the first and second arc pathways with their varying radii and their intersection points can be limited to the forefoot region. That is, in one embodiment, only the forefoot region may contain the four-sided tile pieces with the projecting traction members. The other regions (for example, the mid-foot and rear-foot regions) may contain no traction members or different configurations of traction members. In other embodiments, as discussed above, the entire outsole may contain the arc pathways, intersecting points, and resulting four-sided tiles. In still other embodiments, select regions of the outsole other than the forefoot region may contain the arc pathways, intersecting points, and tile pieces.

For example, the outsole may comprise a first set of arc pathways having a center point located on the medial side of the rear-foot region and extending along the rear-foot region in a generally longitudinal direction. The radius of each arc pathways increases from the center point as the arcs extend along the rear-foot region. A second set of arc pathways have a center point located on the posterior end of the rear-foot region and extend along the rear-foot region in a generally transverse direction. The radius of each arc pathway increases from the center point as the arcs extend along the rear-foot region. When the first and second arc pathways are superposed over each other, intersecting points between the first and second set of arc pathways are formed. The intersecting points form four-sided tile pieces on the surface of the rear-foot region.

In general, the anatomy of the foot can be divided into three bony regions. The rear-foot region generally includes the ankle (talus) and heel (calcaneus) bones. The mid-foot region includes the cuboid, cuneiform, and navicular bones that form the longitudinal arch of the foot. The forefoot region includes the metatarsals and the toes. Referring back to FIG. 1, the outsole (16) has a top surface (not shown) and bottom surface (27). The midsole (14) is joined to the top surface of the outsole (16). The upper (12) is joined to the midsole (14).

Figure 8:
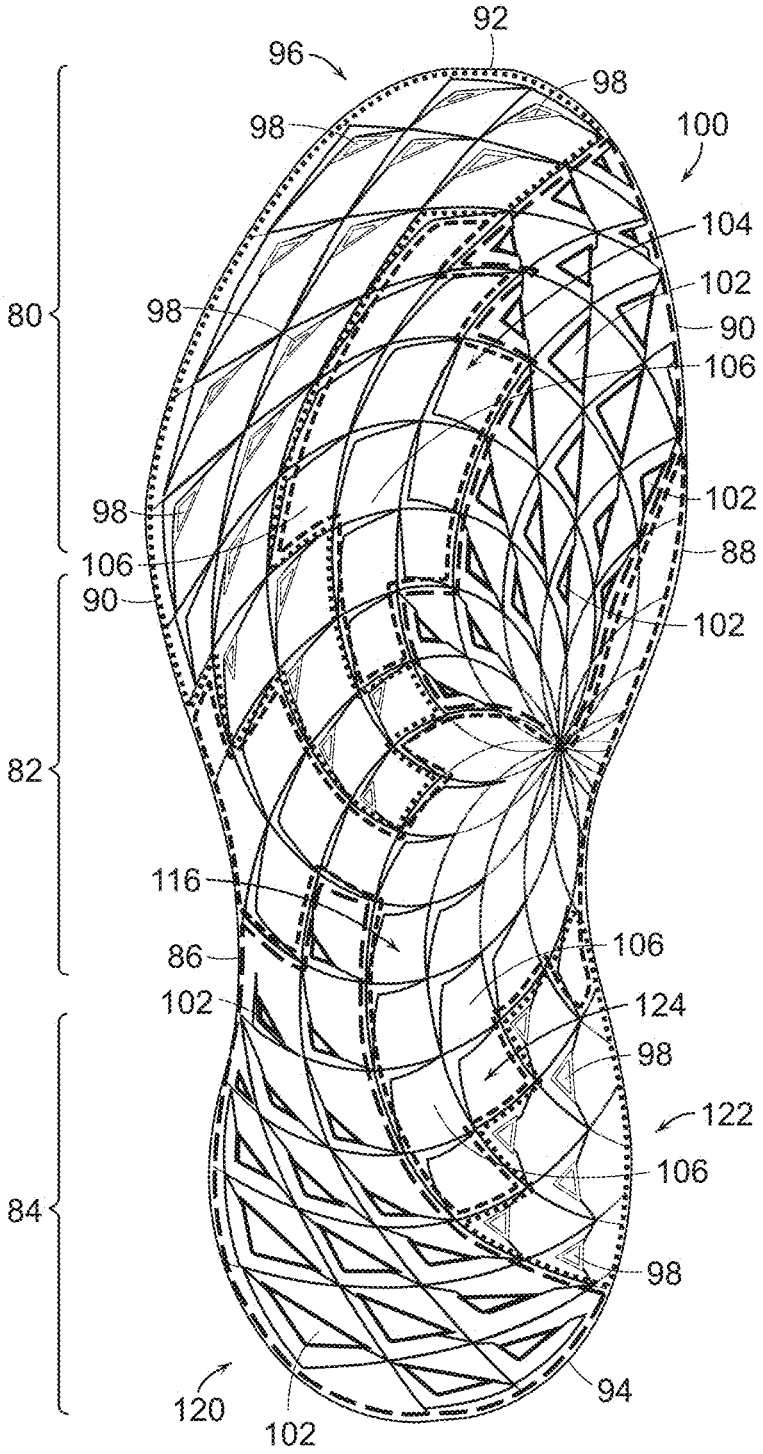
FIG. 8 is a bottom plan view of one example of an outsole of the present invention showing tiles containing different traction members, wherein the tiles are arranged in different zones on the outsole.

Turning to FIG. 8, the outsole (16) generally includes a forefoot region (80) for supporting the forefoot area; a mid-foot region (82) for supporting the mid-foot including the arch area; and rearward region (84) for supporting the rear-foot including heel area. In general, the forefoot region (80) includes portions of the outsole corresponding with the toes and the joints connecting the metatarsals with the phalanges. The mid-foot region (82) generally includes portions of the outsole corresponding with the arch area of the foot. The rear-foot region (84) generally includes portions of the outsole corresponding with rear portions of the foot, including the calcaneus bone.

The outsole also includes a lateral side (86) and a medial side (88). Lateral side (86) and medial side (88) extend through each of the foot regions (80, 82, and 84) and correspond with opposite sides of the outsole. The lateral side or edge (86) of the outsole is the side that corresponds with the outer area of the foot of the wearer. The lateral edge (86) is the side of the foot of the wearer that is generally farthest from the other foot of the wearer (that is, it is the side closer to the fifth toe [little toe].) The medial side or edge (88) of the outsole is the side that corresponds with the inside area of the foot of the wearer. The medial edge (88) is the side of the foot of the wearer that is generally closest to the other foot of the wearer (that is, the side closer to the hallux [big toe].)

More particularly, the lateral and medial sides extend around the periphery or perimeter (90) of the outsole (16) from the anterior end (92) to the posterior end (94) of the outsole. The anterior end (92) is the portion of the outsole corresponding to the toe area, and the posterior end (94) is the portion corresponding to the heel area. Measuring from the lateral or medial edge of the outsole in a linear direction towards the center area of the outsole, the peripheral area generally has a width of about 3 to about 6 mm. The width of the periphery may vary along the contour of the outsole and change from the forefoot to mid-foot to rear-foot regions (80, 82, and 84).

The regions, sides, and areas of the outsole as described above are not intended to demarcate precise areas of the outsole. Rather, these regions, sides, and areas are intended to represent general areas of the outsole. The upper (12) and midsole (14) also have such regions, sides, and areas. Each region, side, and area also may include anterior and posterior sections.

Forefoot Region

As further shown in FIG. 8, the forefoot region (80) of the outsole includes a first (lateral) zone of tiles (96) containing protruding traction members (98) extending along the periphery of the forefoot region; a third (medial) zone of tiles (100) containing protruding traction members (102) extending along the opposing periphery of the forefoot region; and a second (middle) zone of tiles (104) containing protruding traction members (106) disposed between the first and third zones.

Figure 9A:
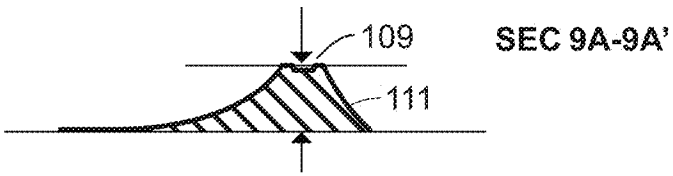
FIG. 9A is a cross-sectional view of the traction member in FIG. 9 along Line A-A'.
Figure 9:
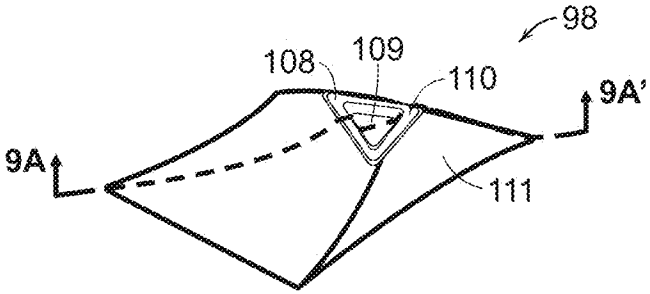
FIG. 9 is a perspective view of one example of a traction member shown in the outsole of FIG. 8.

Referring to FIGS. 8, 9, and 9A, the traction members (98) in the first (lateral) zone of tiles (96) have sloping sides with a triangular-shaped top surface (108) containing recessed (109) and non-recessed areas (110), the non-recessed areas (110) forming a ground contacting surface, and wherein the total ground contact surface area is in the range of about 10 to about 35% based on total surface area of the tile (70). In one preferred embodiment, the total ground contact surface area is in the range of about 17 to about 28%. These traction members (98) are primarily used for golf-specific traction, that is, these traction members help control forefoot lateral traction, and prevent the foot from slipping during a golf shot.

For example, during normal golf play, a golfer makes shots with a wide variety of clubs. As the golfer swings a club when making a shot and transfers their weight, the foot absorbs tremendous forces. In many cases, when a right-handed golfer is addressing the ball, their right and left feet are in a neutral position. As the golfer makes their back-swing, the right foot presses down on the medial forefoot and heel regions, and, as the right knee remains tucked in, the right foot creates torque with the ground to resist external foot rotation. Following through on a shot, the golfer's left shoe rolls from the medial side (inside) of their left foot toward the lateral side (outside) of the left foot. Meanwhile, their right shoe simultaneously flexes to the forefoot and internally rotates as the heel lifts. As discussed above, significant pressure is applied to the exterior of the foot at various stages in the golf shot cycle. In the present invention, the first zone of the outsole is designed to provide support and stability to the sides of the foot. That is, the first zone provides support around the lateral edges of the outsole. This first zone helps hold and support the lateral side of the golfer's foot as he/she shifts their weight when making a shot. The shoe provides good traction and control of lateral movement. Thus, the golfer has better stability and balance in all phases of the game.

Figure 10A:
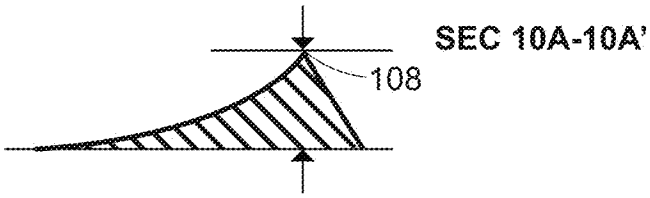
FIG. 10A is a cross-sectional view of the traction member in FIG. 10 along Line A-A'.
Figure 10:
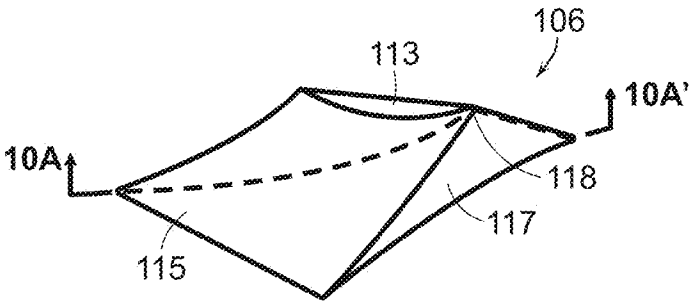
FIG. 10 is a perspective view of a second example of a traction member shown in the outsole of FIG. 8.

Next, referring to FIGS. 8, 10, and 10A, the traction members (106) in the second (middle) zone of tiles (104) have a three-sided pyramid-like shape with three sloping surfaces (113, 115, 117) extending from a pyramid-like base and an apex (118), and wherein the total ground contact surface area is in the range of about 5 to about 40% based on total surface area of the tile (70). In one preferred embodiment, the total ground contact surface area is in the range of about 12 to about 33%. Only one edge or apex (118) of the traction member (106) is in contact with the ground so the gripping power per volume of tile (70) is maximized. These traction members (106) provide comfort and tend to distribute pressure from the middle (second) zone out to the periphery of the sole, that is, to the lateral (first) and medial (third) zones. These traction members (106) in the middle zone are relatively softer and more compliant than the traction members in the neighboring lateral and medial zones. Thus, the middle zone acts as a comfort zone relieving the pressure placed on the center of the outsole and pushing it to the lateral and medial sides of the outsole. Also, if sufficient shoe pressure is applied and the traction members (106) in the middle zone are compressed and flattened to a certain degree, they will make relatively good contact with the ground and provide some grip.

Figure 11A:
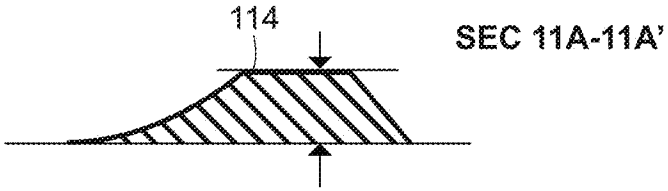
FIG. 11A is a cross-sectional view of the traction member in FIG. 11 along Line A-A'.
Figure 11:
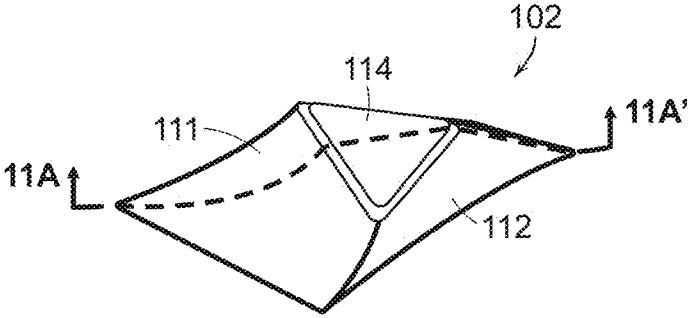
FIG. 11 is a perspective view of a third example of a traction member shown in the outsole of FIG. 8.

Lastly, referring to FIGS. 8, 11, and 11A, the traction members (102) in the third (medial) zone of tiles (100) have two sloping surfaces 111 or sloping sides 112 with a triangular-shaped, non-recessed top surface (114) that forms a ground contacting surface, and wherein the total ground contact surface area is in the range of about 20 to about 60% based on total surface area of the tile (70). In one preferred embodiment, the total ground contact surface area is in the range of about 27 to about 53%. These traction members (102) provide a high contact surface area to prevent slipping on hard, wet, and smooth surfaces. Maximum contact by the traction members (102) is maintained in this third zone of tiles (100). The traction members (102) also help to push water away from the shoe as a person follows their normal walking gait cycle.

Typically, when a person starts naturally walking, the outer part of his/her heel strikes the ground first with the foot in a slightly supinated position. As the person transfers his/her weight to the forefoot, the arch of the foot is flattened, and the foot is pressed downwardly. The foot also starts to roll slightly inwardly to a pronated position. In some instances, the foot may roll inwardly to an excessive degree and this is type of gait is referred to as over-pronation. In other instances, the foot does not roll inwardly to a sufficient degree and this is referred to as under-pronation. Normal foot pressure is applied downwardly and the foot starts to move to a normal pronated position and this helps with shock absorption. After the foot has reached this neutral (mid-stance) position, the person pushes off on the ball of his/her foot and continues walking. At this point, the foot also rolls slightly outwardly again. The above-described traction members in the third (medial) zone of tiles are particularly effective in providing maximum contact with the ground to help prevent a person from slipping and losing their balance when walking.

Mid-Foot Region

As also shown in FIG. 8, the mid-foot region (82) of the outsole further comprises a zone of tiles (116) containing protruding traction members (106) extending along the mid-foot region, and wherein the traction members have a three-sided pyramid-like shape with three sloping surfaces (113, 115, 117) extending from a pyramid-like base and an apex (118) (See FIGS. 10 and 10A), and wherein the total ground contact surface area is in the range of about 5 to about 40% based on total surface area of the tile (70). Thus, the traction members (106) in the mid-foot region zone of tiles (116) are similar to the traction members (106) found in the second (middle) zone of tiles (104) located in the forefoot region (80). In one preferred embodiment, the total ground contact surface area is in the range of about 12 to about 33%. As discussed above, these traction members (106) provide comfort and tend to distribute pressure from the central area of the mid-foot region toward the peripheral edges of the outsole.

Rear-Foot Region

Turning to the rear-foot region (84) and FIG. 8, the traction members found in this region (84) are similar to the traction members found in the forefoot region (80). However, the zones in the rear-foot region (84) are reversed from the zones in the forefoot region (80). Thus, as shown in FIG. 8, there is a first (lateral) zone of tiles (120) containing protruding traction members (102) extending along the periphery of the rear-foot region (84); a third (medial) zone of tiles (122) containing protruding traction members (98) extending along the opposing periphery (medial side) of the rear-foot region (84); and a second (middle) zone of tiles (124) containing protruding traction members (106) disposed between the rear-foot first (120) and third (122) zones.

First, the traction members (102) in the rear-foot first (lateral) zone of tiles (120) have sloping sides (111, 112) with a triangular-shaped, non-recessed top surface (114) that forms a ground contacting surface, and wherein the total ground contact surface area is in the range of about 20 to about 60% based on total surface area of the tile (70). (See FIGS. 11 and 11A.) Thus, the traction members (102) in the rear-foot first (lateral) zone of tiles (120) are similar to the traction members (102) found in the third (medial) zone of tiles (100) located in the forefoot region (80). As discussed above, these traction members (102) provide a high contact surface area to prevent slipping on hard, wet, and smooth surfaces. Further, the horizontal-facing sidewalls of the traction members help prevent the golfer from slipping when he/she is walking downwardly on golf course slopes. Maximum contact by the traction members (102) is maintained in this rear-foot first (lateral) zone of tiles (120) and the forefoot third (medial) zone of tiles (100).

Meanwhile, as also shown in FIG. 8, the traction members (106) in the rear-foot second (middle) zone of tiles (124) have a three-sided pyramid-like shape with three sloping surfaces 113, 115, 117 extending from a pyramid-like base and an apex (118) (See FIGS. 10 and 10A), and wherein the total ground contact surface area is in the range of about 5 to about 40% based on total surface area of the tile (70). Thus, the traction members (106) in the rear-foot second (middle) zone of tiles (124) are similar to the traction members (106) found in the second (middle) zone of tiles (104) located in the forefoot region (80). As discussed above, these traction members (106) provide comfort and tend to distribute pressure from the middle zone in the rear-foot region out to the periphery of the sole.

Finally, in FIG. 8, the traction members (98) in the rear-foot third (medial) zone of tiles (122) have a triangular-shaped top surface (108) containing recessed (109) and non-recessed (110) areas, the non-recessed areas forming a ground contacting surface (See FIGS. 9 and 9A), and wherein the total ground contact surface area is in the range of about 10 to about 35% based on total surface area of the tile (70). As discussed above, these traction members (98) are primarily used for golf-specific traction, that is, these traction members help control forefoot and rear-foot lateral traction, and prevent the foot from slipping while playing.

Figure 12:
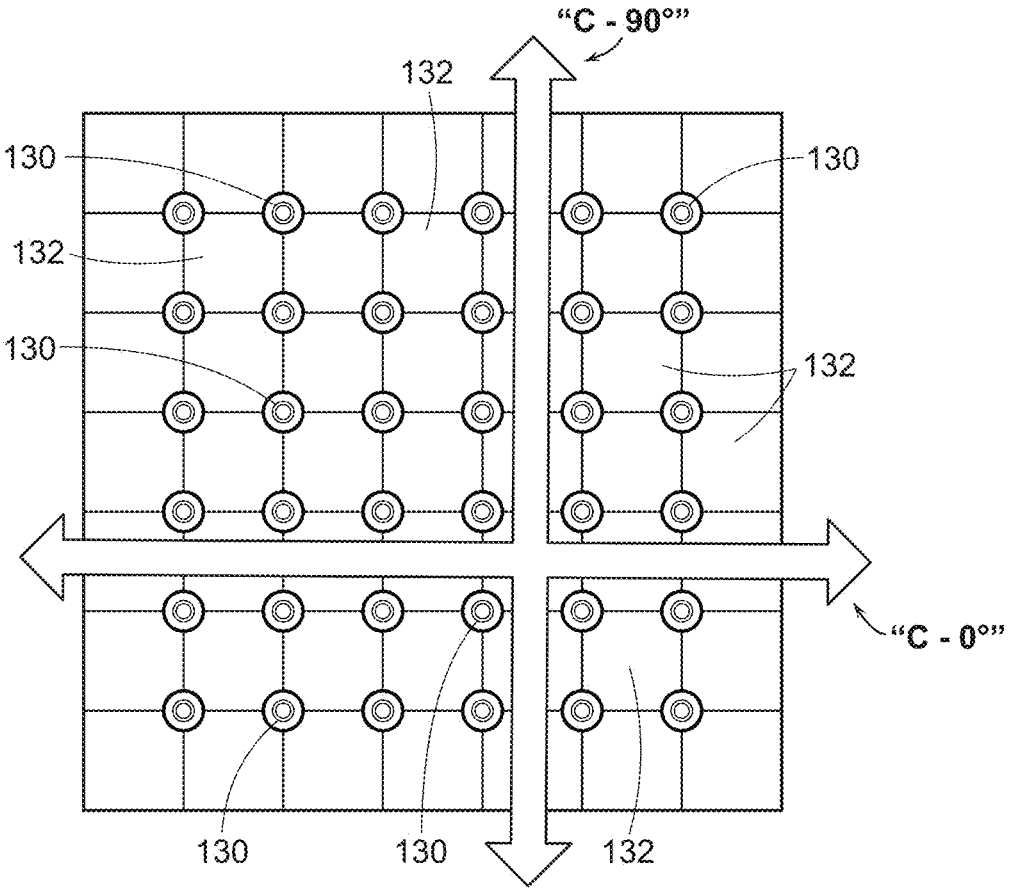
(PRIOR ART) FIG. 12
FIG. 12 is a bottom plan view of an outsole of the prior art, wherein the traction members are arranged in a linear configuration with channels and showing that a turf-trenching effect occurs in the 90 degree and 0 degree directions.
Figure 13:
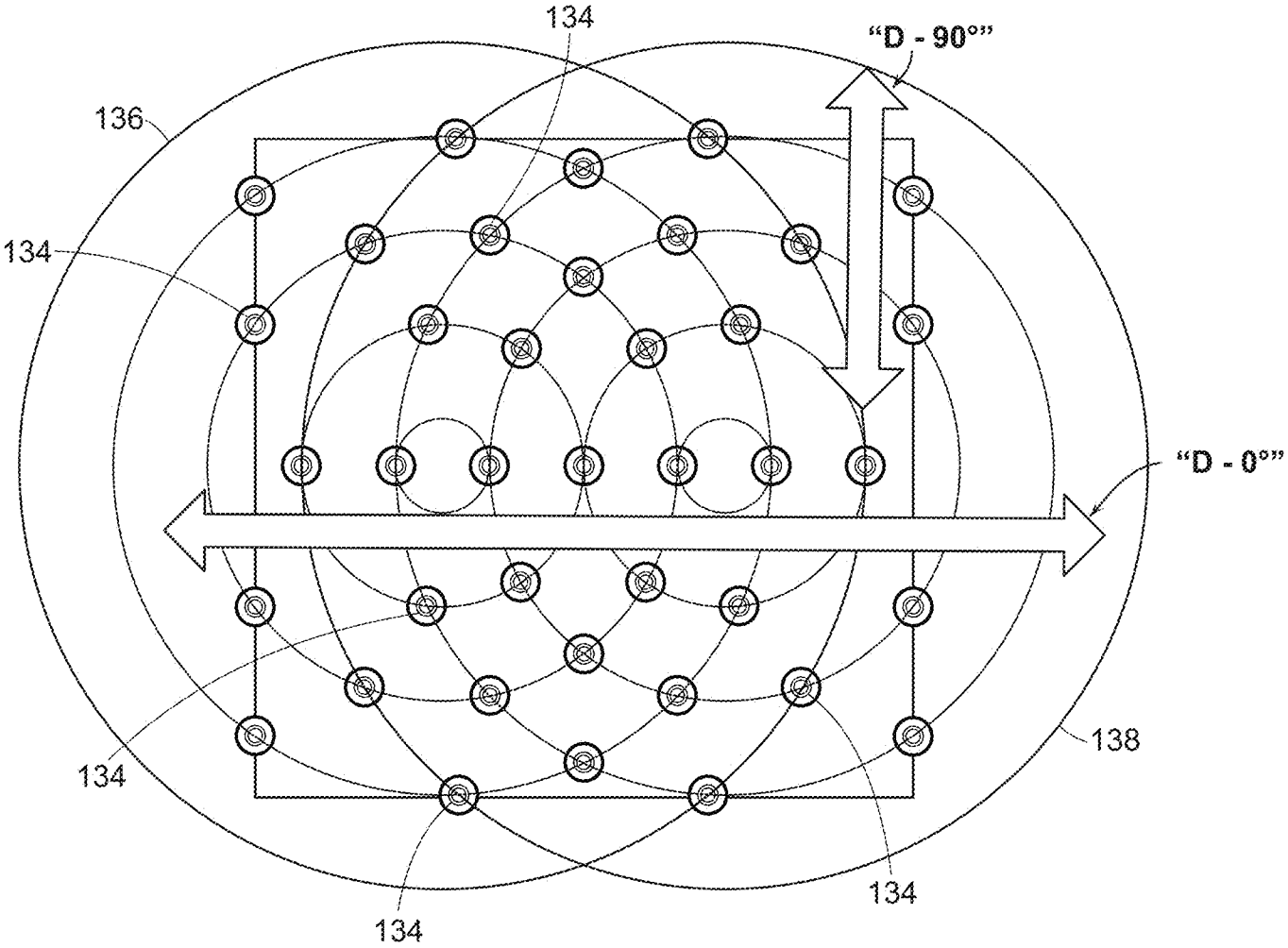
(PRIOR ART) FIG. 13
FIG. 13 is a bottom plan view of an outsole of the prior art, wherein the traction members are arranged in a double-radial configuration with channels, and showing that a turf-trenching effect occurs in the 90 degree and 0 degree directions.
Figure 14:
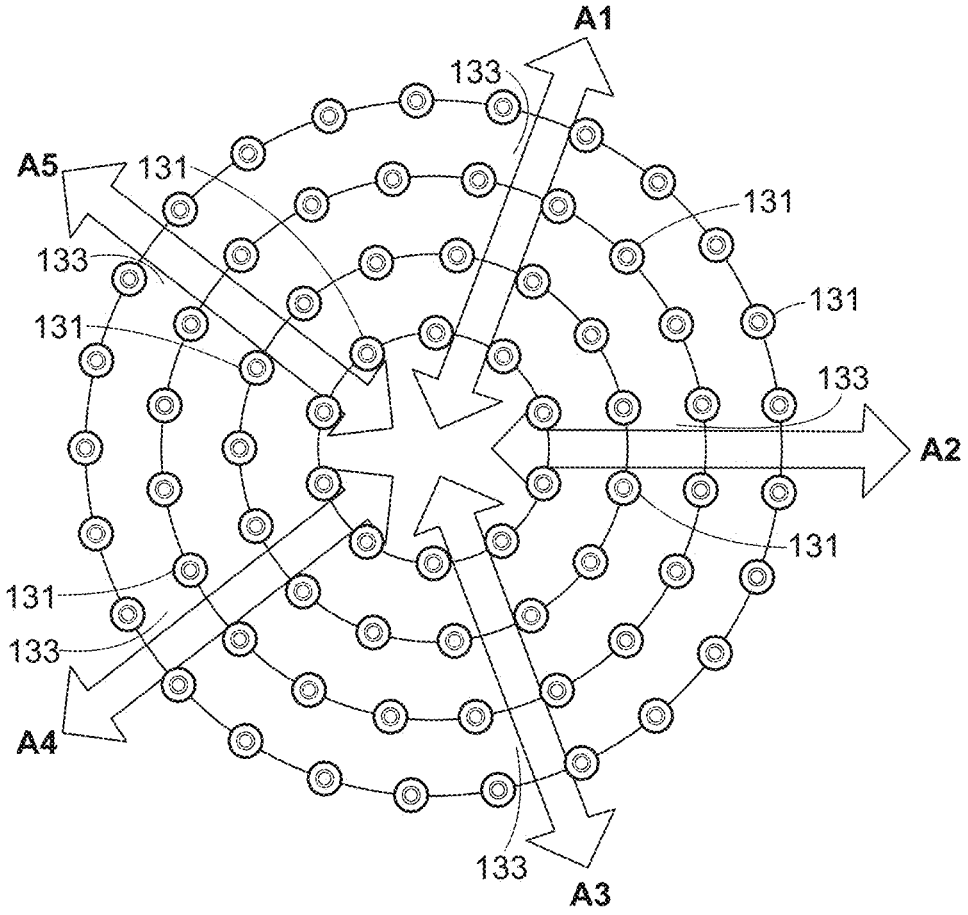
FIG. 14 is a bottom plan view of an outsole of the prior art, wherein the traction members are arranged in a circular configuration with channels; and showing that a turf-trenching effect occurs in various directions including a rotational direction.
Figure 15:
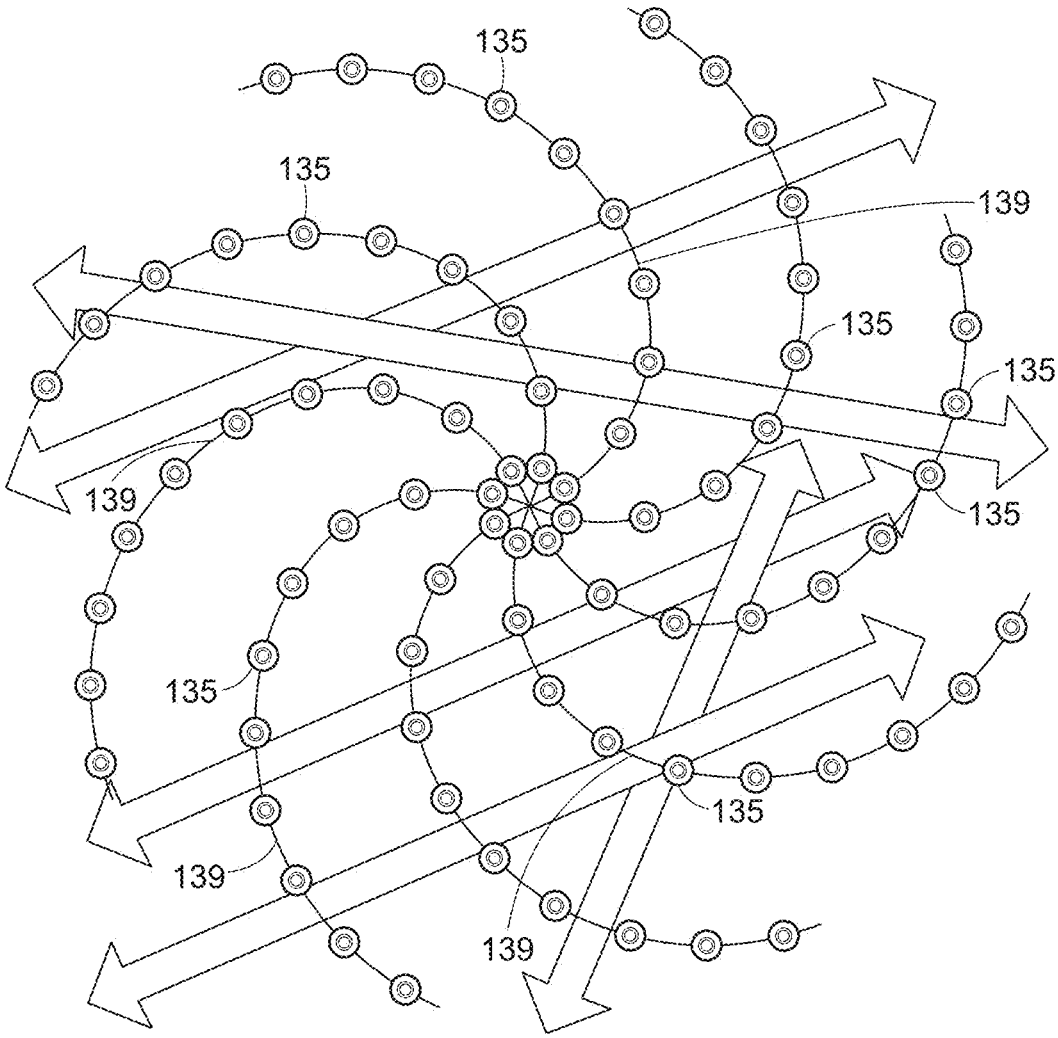
FIG. 15 is a bottom plan view of an outsole of the prior art, wherein the traction members are arranged in a single logarithmic spiral configuration with channels; and showing that a turf-trenching effect occurs in the 90 degree and 0 degree directions.

The above-described traction zones in the shoe outsoles of this invention help provide improved traction on all surfaces. Furthermore, these shoes are optimally suited for use on the golf course, because they reduce turf-trenching per the amount of traction provided. The shoes of this invention help prevent damage to the course turf, particularly to putting greens. In contrast, many prior art golf shoes contain traction members arranged in a linear or double-radial configuration. These traditional channeled outsole structures provide less traction per total traction member penetration area; and this can result in more turf damage per amount of traction. In addition, these conventional shoe outsoles may not have good traction on all surfaces. Such channeled outsoles can provide less than optimum traction for the damage that they create on the course. As shown in FIG. 12, this turf-trenching effect for prior art outsoles containing traction members (130) and channels (132) in a linear configuration (transverse rows along a longitudinal length of the outsole) occurs substantially in both the 90 degree (Arrow C-90°) and 0 degree (Arrow C-0°) directions. Next, as shown in FIG. 13, with traction members (134) arranged in overlapping circular patterns 136, 138 (double-radial configuration) on prior art outsoles, there can be low turf-trenching in the 90 degree directions (Arrow D-90°), but there is substantial turf-trenching in the 0 degree directions (Arrow D-0°). Turning to FIG. 14, with traction members (131) arranged in a concentric circular pattern, there are still channels (133) in this geometric configuration, and there can be trenching in various directions. For example, there can be trenching in linear directions (Arrows D-x°); and rotational directions (Arrows D-y°). Thus, as shown in FIG. 14, trenching can occur in both linear and arcing patterns. In yet another example of a prior art outsole, as shown in FIG. 15, traction members (135) can be arranged in a single logarithmic spiral and channels (139) are still created. With this geometric configuration, trenching occurs substantially in both the 90 degree (Arrow D-90°) and 0 degree (Arrow D-0°) directions.

More particularly, as shown in FIG. 12, when the traction members (130) are arranged in a co-linear pattern and there is close proximity between the members, this tends to cause turf-trenching. Secondly, the outsole structure in FIG. 12 contains linear channels (132), where no traction members are located, and these channeled areas provide no traction. Turf-trenching causes concentrated damage to the turf, while poor traction causes no damage to the turf. But, turf-trenching and traction properties are related. If the shoe slips enough so that one traction member reaches the position of the neighboring traction member, then traction will drop-off due to the traction members pushing through weakened or damaged turf. This slipping of multiple traction members through the same turf causes turf-trenching. Meanwhile, the linear channels do not provide any traction. Since these linear channels do not contain any traction members, the outsole (for example, rubber material) directly contacts the ground surface and there is no gripping strength.

Figure 16:
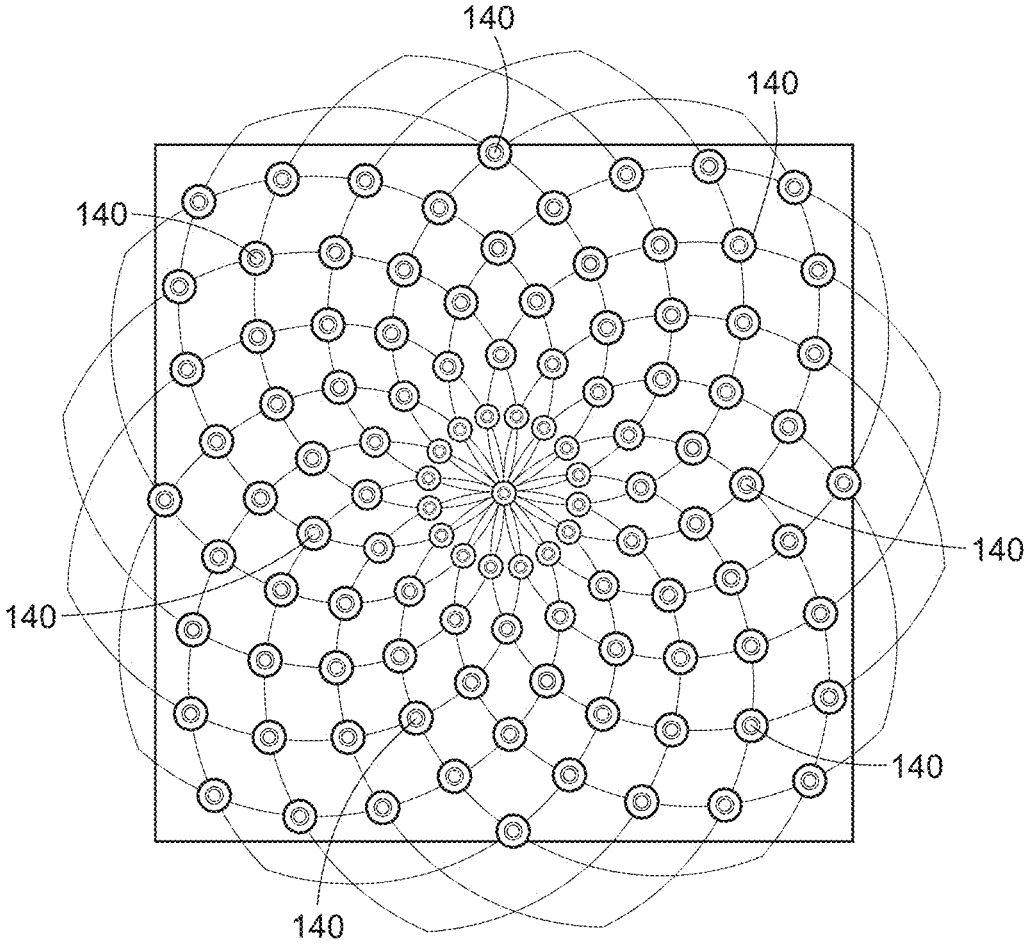
FIG. 16 is a bottom plan view of one example of an outsole of the present invention, wherein the traction members are arranged in different arc pathways with no channeling, and showing that there is no turf-trenching effect.

In the present invention, as shown in FIG. 16 and discussed above, the traction members (140) of the outsole are arranged in an eccentric configuration and each adjacent traction member is positioned at a different radius from a given center of rotation. This results in improved traction for the shoe on all surfaces—there is no channeling and little or no trenching of the turf for the amount of traction provided. The shoe outsoles of this invention do not have a linear channel configuration with closely spaced-apart traction members that can cause turf-trenching. Rather, the shoe outsoles of this invention have traction members that provide optimal traction given the number of traction members in the outsole. That is, these outsoles impart less damage to the golf course for a given amount of traction.

Another advantage of the shoe of this invention is it can be worn when engaging in activities off the golf course. For example, the shoes can be worn as a casual, "off-course" shoe in the clubhouse, office, home, and other ordinary places. On all flooring and other surfaces, the outsole construction has a high traction per volume of traction members for the amount of traction provided. Furthermore, the shoe is lightweight and comfortable so it can be worn easily while walking and in other activities. For example, the shoe can be worn while playing recreational sports such as tennis, squash, racquetball, street hockey, softball, soccer, football, rugby, and sailing. Thus, shoe can be worn when engaging in many different activities on many different surfaces. The shoe provides unique traction and gripping strength on both firm and soft surfaces.

It should be understood that the above-described outsole which generally includes: a) a forefoot region containing first, second (middle), and third zone of tiles with traction members; b) a mid-foot region containing a zone of tiles with traction members; and c) a rear-foot region containing first, second (middle), and third zone of tiles with traction members represents only one example of an outsole structure that can be used in the shoe construction of this invention. As discussed above, the unique pattern of the traction members in the lateral, medial, and middle zones provides improved traction on both hard and soft surfaces. This geometric configuration of traction members helps provide a shoe with high traction per volume of traction members and minimal turf-trenching properties for the amount of traction provided. However, it is recognized that other patterns of traction members can be used without departing from the spirit and scope of this invention.

Furthermore, the traction members disposed on the outsole can have different shapes than the shapes described above to provide optimal traction given the number of traction members. That is, the outsoles can contain a wide variety of traction members so that the gripping power for a particular surface is maximized and less damage is done to that surface for the amount of traction provided. The traction members can have many different shapes including for example, but not limited to, annular, rectangular, triangular, square, spherical, elliptical, star, diamond, pyramid, arrow, conical, blade-like, and rod shapes. Also, the height and area of the traction members and volume of traction member per given tile on the outsole can be adjusted as needed. As discussed above, these different-shaped traction members are arranged on the outsole in a non-channeled pattern. The different traction members and their distinct pattern on the outsole, with no channeling, help provide a shoe with high traction and low turf-trenching properties.

Figure 17B:
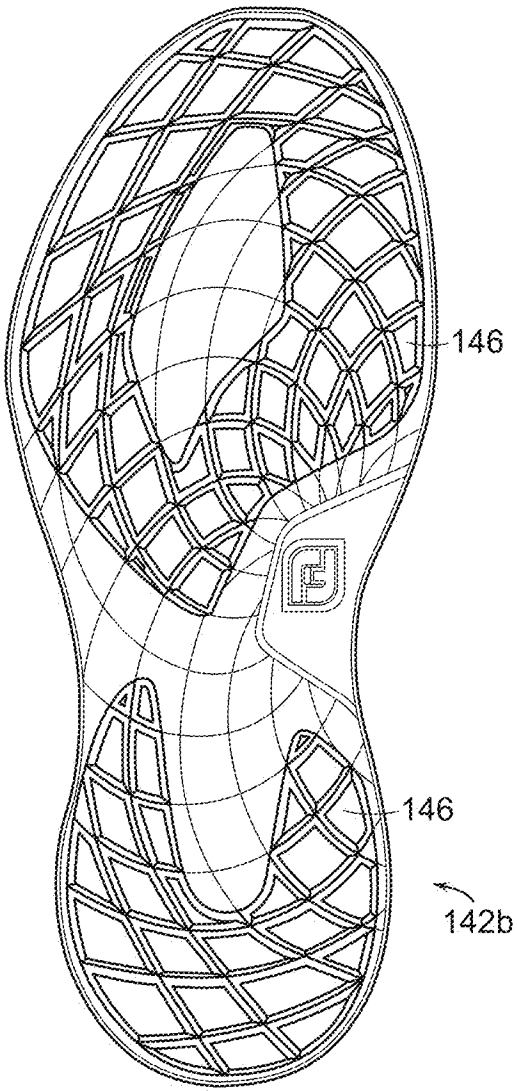
FIG. 17B is a bottom plan view of a third example of an outsole of the present invention, containing different types of traction members than the members found in the outsole of FIGS. 16 and 17A, but wherein the members are arranged in a similar configuration with no channeling, and no turf-trenching effect.
Figure 17A:
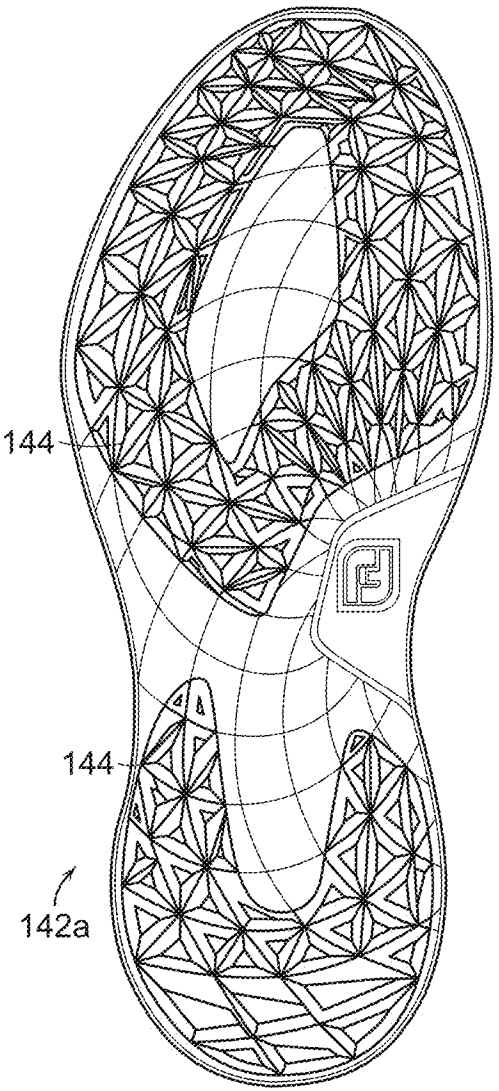
FIG. 17A is a bottom plan view of a second example of an outsole of the present invention, containing different types of traction members than the members found in the outsole of FIG. 16, but wherein the members are arranged in a similar configuration with no channeling, and no turf-trenching effect.

For example, referring to FIGS. 17A and 17B, two outsole constructions (142*a*, 142*b*) having different sets of traction members are shown. In FIG. 17A, the outsole construction (142*a*) has a set of traction members (144) designed particularly for providing good traction on soft surfaces such as a soccer pitch, and lacrosse, rugby, and football fields, and the like. These traction members (144) have specific shapes and dimensions for providing a high level of stability and traction on the course. This outsole construction helps hold and support the medial and lateral sides of the golfer's foot as he/she shifts their weight when making a golf shot. This shoe outsole construction (142*a*) provides good traction so there is no slipping and the golfer can stay balanced.

Turning to FIG. 17B, the outsole construction (142*b*) has a set of traction members (146) designed particularly for providing high traction on firm and particularly smooth and even more particularly hard, wet, and smooth surfaces such as boat decks, polished concrete and marble flooring in sidewalks, painted surfaces of sidewalks, and the like. These traction members (146) have specific shapes and dimensions for providing good gripping strength and traction on a variety of surfaces. For example, the shoes can be worn while walking, in the clubhouse, office, and at home, or in various recreational activities as described above. The traction members (146) maintain high contact with the surface and provide stability. The traction members (146) help prevent slipping on hard, wet, and smooth surfaces.

It should be understood that the outsoles (142*a*, 142*b*) can have different traction members (144, 146), as shown in FIGS. 17A and 17B, to optimize the outsole for either on-course or off-course wear, that is, for both firm and soft surfaces. However, in both outsole constructions (142*a*, 142*b*), the outsoles generally have a tread pattern as described above: a) a forefoot region containing first, second (middle), and third zone of tiles with traction members; b) a mid-foot region containing a zone of tiles with traction members; and c) a rear-foot region containing first, second (middle), and third zone of tiles with traction members. That is, the type of traction members (144, 146) in the outsoles is different; however, the geometric configuration of traction members is similar to the non-channeled pattern described above. Non-channeling patterns. This pattern helps provide a shoe with a high traction per volume of traction members and minimal turf-trenching properties for the amount of traction provided.

As discussed above, there is a need to provide outsole structures that can achieve high traction on firm and particularly hard, wet, and smooth surfaces such as boat decks, polished concrete and marble flooring, painted surfaces of sidewalks, and the like. These surfaces can be referred to as "off-course" surfaces. At the same time, there is need for outsole structures that provide high traction on various natural turf surfaces, particularly golf courses. These shoes can be referred to as "on-course" surfaces. The present invention provides such multi-surface traction (MST) outsole structures.

More particularly, for multi-surface traction (MST) shoes, the Horizontal Contact Area Ratio (HCAR) and the Vertical Contact Area Ratio (VCAR) of the outsole structures should be considered. These ratios can be applied to any portion of the net outsole area. For this discussion the "net" area refers to the area of a specified portion of outsole normally projected on to the surface of the substratum. The HCAR refers to the ratio of the sum horizontal surface contact area between the traction members and the hard, flat surface with regard to any specified portion of outsole area divided by the total net area of that same specified portion of outsole area. The VCAR refers to the ratio of the sum vertical surface contact area between the ground and the portion of each traction member area that penetrates into the substratum and that is normal to the direction of horizontal ground reaction force divided by the total net area of that same specified portion of outsole area. As the traction members of the outsole penetrate the ground (for example, natural soft and firm grasses, soil, sand, clay and the like), a vertical contact area is generated between the sides of the traction members and the ground.

HCAR

In some instances, it is desirable to maximize the HCAR of a shoe. For example, the "off-course" shoes can have a high HCAR. These outsole structures attempt to maximize contact with typically smoother, firmer surfaces and thus provide greater surface area and friction between the outsole and surface. This helps improve the slip-resistance properties of the outsole. For example, outsoles containing block-like traction members are known in the art. Typically, these block-like traction members have a relatively large width and a relatively low height so they can better grip a hard surface. They are closely packed with little space separation from neighboring traction members. Such outsole structures and traction members are normally composed of a rubber material. These block-like traction members are not easily compressed and generally have good bending-resistance so they do not fold over when horizontal force is generated between the footwear and the substratum. In a sense, these block-like traction members make contact and "ride" on the hard surface to provide gripping strength between the shoe and surface.

VCAR

In some instances, it is desirable to maximize the VCAR of a shoe. These outsole structures attempt to maximize penetration of the ground surface and thus provide greater traction. For example, outsoles containing thin, peg-like cleats are known in the art. Typically, these peg-like traction members have a relatively large height and a relatively small cross-sectional area so they can better penetrate the ground. Such outsole structures and traction members are often composed of a thermoplastic polyurethane material.

For illustration purposes, the VCAR of any given traction member can be considered a rectangle. First, if the traction member has a relatively large length (height), then it will penetrate the ground surface more deeply and provide more traction than a traction member having a relatively short length (height). The length of the rectangle has increased and thus the VCAR has increased. In general, longer, thinner peg-like traction members will penetrate the ground more easily than the shorter, wider, blade-like traction members. This is due to greater pressure acting on the small cross-sectional surface areas of the long, thin peg-like traction members.

A high HCAR outsole tread pattern typically is not a high VCAR outsole tread pattern and vice-versa. Many conventional golf shoes either emphasize on-course playability and sacrifice off-course slip-resistance or emphasize better suitability for off-course traction but sacrifice on-course performance. It is common knowledge that conventional golf shoes are not highly capable of both on-course playability and off-course grip.

In contrast to such conventional on-course and off-course shoes that trade-off certain properties for others, the inventors have built a balanced shoe that optimally combines high slip-resistance surface and high ground-penetration/traction properties. The shoes of this invention have both desirable on-course and off-course properties. Moreover, the shoes of this invention do not severely damage the turf grasses of golf courses, particularly putting greens as discussed further below.

Geometric Pattern of Outsole

The outsoles of this invention are optimized for multi-surface traction by providing regional outsole tread patterns that align with functional foot anatomy and the requirements of swinging a golf club as well as walking on smooth, hard, wet surfaces. The outsoles generally have a tread pattern with (a) a forefoot region containing first, second (middle), and third zone of tiles with traction members; (b) a mid-foot region containing a zone of tiles with traction members; and (c) a rear-foot region containing first, second (middle), and third zone of tiles with traction members.

The traction members are arranged in an eccentric arcing configuration and each adjacent traction member is positioned at a different radius from a given center of rotation. This results in improved traction for the shoe on all surfaces (MST)—there is no channeling and little or no trenching of the turf for the amount of traction provided as discussed above. Different types of traction members can be used, for example, the traction members can have a relatively short, wide, blade-like structure. However, the geometric pattern of the traction members is similar to the non-channeled pattern described above. The shoe outsoles of this invention do not have a linear channel configuration with closely spaced-apart traction members that can cause turf-trenching. This non-channeled pattern helps provide a shoe with high traction per volume of traction members and minimal turf-trenching properties for the amount of traction provided.

Material Properties and Geometry of Traction Members

Figure 30:
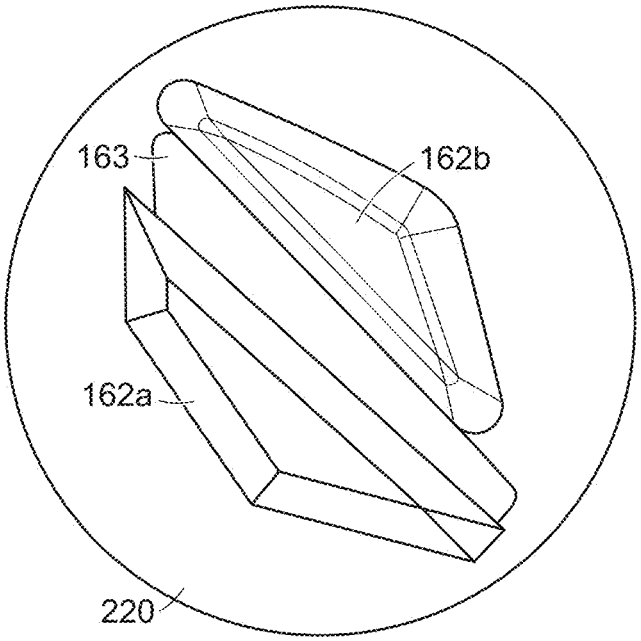
FIG. 30 is a perspective view of an example of a tile piece in the outsole of the present invention showing two traction members and a flat segment (window) disposed between the traction members.

Referring to FIG. 30, one embodiment of the traction members of this invention is shown. In this embodiment, the tile structure (154) located on the outsole (16) comprises a first protruding traction member (162*b*); an opposing second protruding traction member (162*a*); and a non-protruding, base segment (window) (163) disposed between the first and second traction members (162*b*, 162*a*).

The traction members of this invention can have various sizes, shapes, and/or material properties. For example, the different traction members can have separate and distinct material properties so that some traction members are relatively hard and rigid; and other traction members are relatively soft and flexible. The traction members also can have different dimensions (for example, the length or height of the traction members can vary); and the traction members can have different shapes and geometries.

For example, the first traction members (162*b*) can be made from a relatively hard, first thermoplastic polyurethane composition having a hardness of greater than 80 Shore A; and the second traction members (162*a*) can be made from a relatively soft, second thermoplastic polyurethane composition having a hardness of 80 Shore A or less. Such first and second traction members (162*b*, 162*a*) can be made from commercially-available polyurethane compositions such as, for example, Estane® TRX thermoplastic polyurethanes, available from the Lubrizol Corporation.

By varying the hardness of the different traction members, each traction member may be tuned so that it responds differently upon contacting a ground surface. The traction members are configured so they deform differently when pressed against a ground surface. For example, one traction member may have a relatively low hardness that is optimal for maximizing traction with a hard, wet surface; and a second traction member may have a relatively high hardness making it optimal for maximizing traction with soft natural grass. The hardness of the second traction members is preferably greater than the hardness of the first traction members. For example, the hardness of the second traction members can be at least 5% greater than the hardness of the first traction members. In some embodiments, the hardness of the second traction members can be at least 10% or 15% greater; and in other embodiments, at least 20% or 25% greater.

Figure 29:
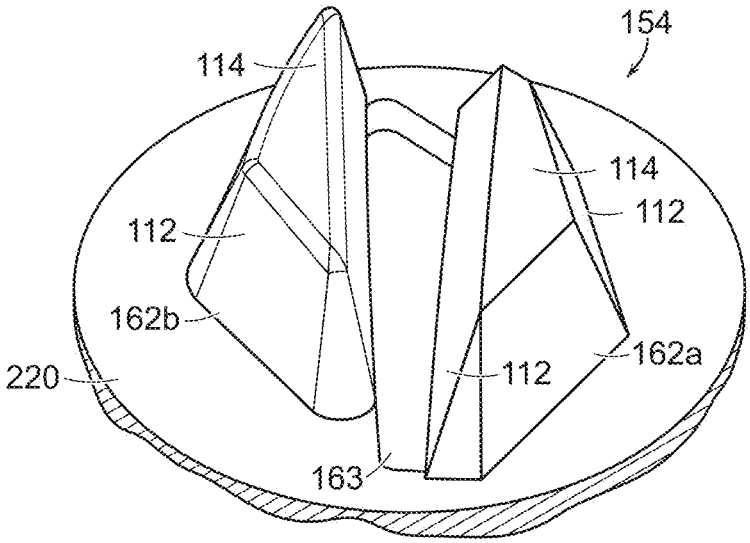
FIG. 29 is a perspective view of an example of a tile piece in the outsole of the present invention showing two traction members and a flat segment disposed between the traction members.

The traction members also can have various dimensions. For example, in one embodiment as shown in FIGS. 29 and 30, the lengths (heights) of the relatively hard traction members (162*b*) and lengths (heights) of the relatively soft traction members (162*a*) are substantially the same. For example, the heights of the relatively hard and soft traction members can be in the range of about 2 mm to about 6 mm. Preferably, the heights of the relatively hard and soft traction members are in the range of about 2.5 mm to about 4.5 mm.

In a second embodiment, the heights of the relatively hard traction members are greater than the heights of the relatively soft traction members. For example, the heights of the relatively hard traction members can be in the range of about 2 mm to about 6 mm; and the heights of the relatively soft traction members can be in the range of about 1.75 mm to about 5.75 mm. Preferably, the difference between traction member heights is in the range of about 0 mm to about 6 mm. In this manner, the firm traction members contact the ground and penetrate the grass and soil more easily. Meanwhile, the relatively soft traction members contact the ground, compress more easily, and help provide some flexibility to the shoe. This outsole structure is particularly effective for on-course use.

In yet another embodiment, the heights of the relatively hard traction members are less than the heights of the relatively soft traction members. For example, the heights of the relatively soft traction members can be in the range of about 2 mm to about 6 mm; and the heights of the relatively hard traction members can be in the range of about 1.75 mm to about 5.75 mm. Preferably, the difference between traction member heights is in the range of about 0 mm to about 6 mm.

By varying the length (height) of the different traction members, each traction member may be tuned so that it penetrates to a different depth when making contact with the ground surface. For example, in one embodiment, the first traction members may have a relatively greater height that is optimized for penetrating the ground surface deeply. Meanwhile, the second traction members may have a relatively lesser height that is optimized for riding on the surface or penetrating the ground to a shallow extent.

The traction members can have various sizes and shapes. The outsole structures (16) of this invention can contain a wide variety of traction members so that the gripping power for a particular surface is maximized and less damage is done to that surface for the amount of traction provided. The traction members can have many different shapes including for example, but not limited to, annular, rectangular, triangular, square, spherical, elliptical, star, diamond, pyramid, arrow, conical, blade-like, and rod shapes. Also, the height and area of the traction members and volume of traction member per given tile structure on the outsole can be adjusted as needed. For example, in one embodiment as shown in FIGS. 29 and 30, the first traction members (162*b*) can have three sidewalls with sloping surfaces and a triangular-shaped, non-recessed top surface that forms a ground contacting surface. The second traction members (162*a*) can also have three sidewalls with sloping surfaces and a larger sized triangular-shaped, non-recessed top surface than the first traction members. The traction tile structure (154) further includes a flexible window (163) disposed between the first and second traction members (162*b*, 162*a*); and a surrounding hard base material optionally comprising one or more hard, thermoplastic polyurethane traction members (220) as described further below.

The total ground contact surface area is preferably in the range of about 5 to about 80% based on total surface area of the traction tile structure. That is, the first and second traction members contact the ground surface such that the total ground contact surface area is preferably in the range of about 5 to about 80% based on total surface area of the tile. In one preferred embodiment, the total ground contact surface area is in the range of about 10 to about 70%, and in another preferred embodiment, the total ground contact surface area is in the range of about 20 to about 60%. In another preferred embodiment, the total ground contact surface area is in the range of about 15 to about 55%. The flat, base segment (window) (163) of the traction tile structure, which is located between the first and second traction members (162*b*, 162*a*), constitutes about 1% to about 70% of the tile. In some cases, the window (163) can constitute about 70 to about 100% of the traction tile structure as shown in FIG. 18, wherein there are no traction members in the tile structures (156).

Traction Zones

Figure 18:
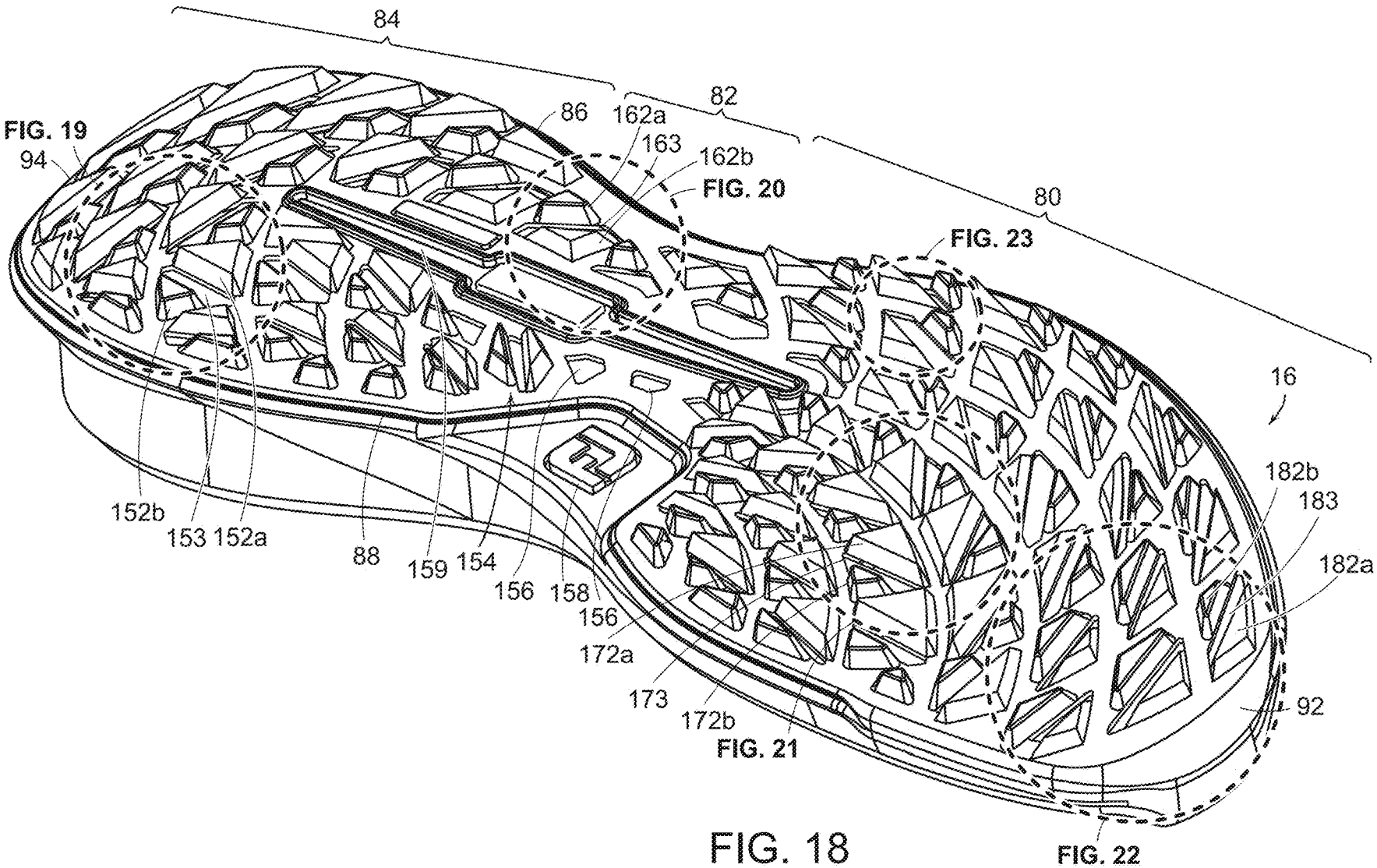
FIG. 18 is a bottom perspective view of another example of a golf shoe of the present invention showing the outsole in detail.

Turning to FIG. 18, the outsole (16) generally includes a forefoot region (80) for supporting the forefoot area; a mid-foot region (82) for supporting the mid-foot including the arch area; and rearward region (84) for supporting the rear-foot including heel area. In general, the forefoot region (80) includes portions of the outsole corresponding with the toes and the joints connecting the metatarsals with the phalanges. The mid-foot region (82) generally includes portions of the outsole corresponding with the arch area of the foot. The rear-foot region (84) generally includes portions of the outsole corresponding with rear portions of the foot, including the calcaneus.

The outsole also includes a lateral side (86) and a medial side (88). Lateral side (86) and medial side (88) extend through each of the foot regions (80, 82, and 84) and correspond with opposite sides of the outsole. The lateral side or edge (86) of the outsole is the side that corresponds with the outer area of the foot of the wearer. The lateral edge (86) is the side of the foot of the wearer that is generally farthest from the other foot of the wearer (that is, it is the side closer to the fifth toe [little toe].) The medial side or edge (88) of the outsole is the side that corresponds with the inside area of the foot of the wearer. The medial edge (88) is the side of the foot of the wearer that is generally closest to the other foot of the wearer (that is, the side closer to the hallux [big toe].)

More particularly, the lateral and medial sides extend around the periphery or perimeter (90) of the outsole (16) from the anterior end (92) to the posterior end (94) of the outsole. The anterior end (92) is the portion of the outsole corresponding to the toe area, and the posterior end (94) is the portion corresponding to the heel area.

The regions, areas, and zones of the outsole as described above are not intended to demarcate precise areas of the outsole. Rather, these regions, areas, and zones are intended to represent general areas of the outsole. The upper (12) and midsole (14) also have such regions, areas, and zones. Each region, area, and zone also may include anterior and posterior sections.

Rear-Foot Region

Figure 18A:
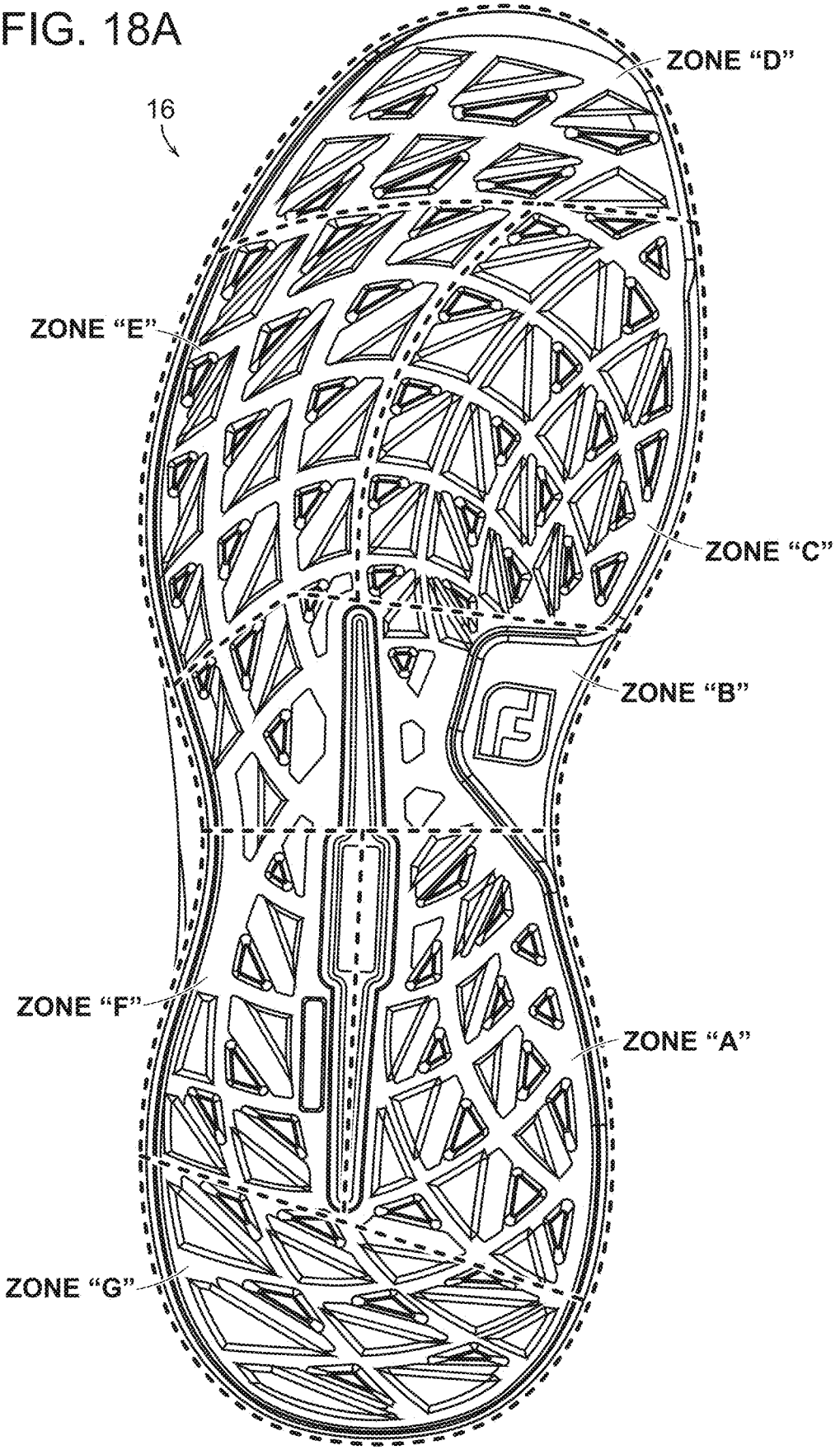
FIG. 18A is a bottom plan view of the golf shoe shown in FIG. 18 showing the tile outsole with tile pieces containing different traction members, wherein the tiles are arranged in different zones.
Figure 19:
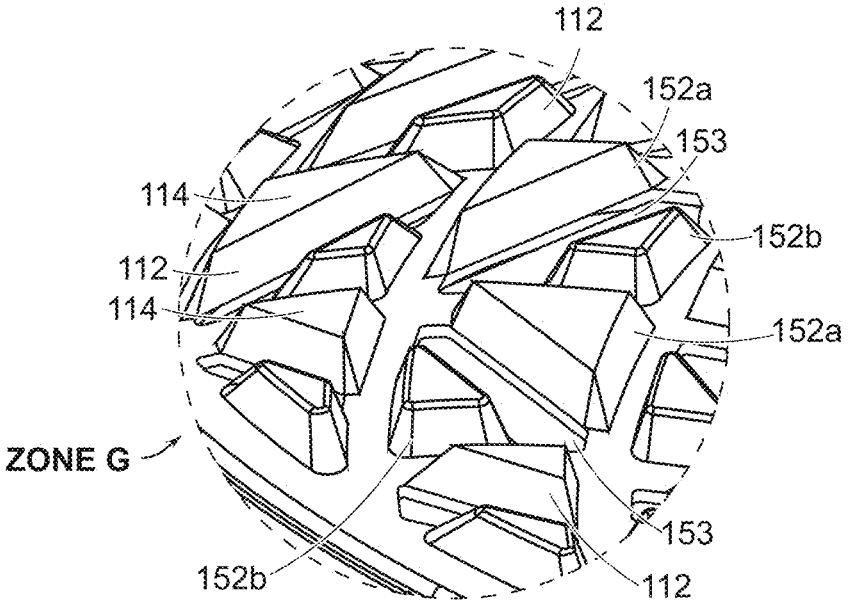
FIG. 19 is a close-up view of a portion of the outsole shown in FIG. 18, as marked by the "FIG. 19" broken circle in FIG. 18.

In FIGS. 18 and 18A, turning to the rear-foot region (84), the traction tile structures found in this Zone "G" comprise a first protruding traction member; an opposing second protruding traction member; and a non-protruding, flexible window disposed between the first and second traction members. More particularly, two traction tile structures in Zone G are shown in an enlarged view in FIG. 19. In this example, the first traction members (152*b*) are relatively hard and can be made, for example, from a hard, first thermoplastic polyurethane composition. In one embodiment, the hard, thermoplastic polyurethane composition has a hardness of greater than 70 Shore A. The second traction members (152*a*) are relatively soft and can be made, for example, from a soft, second thermoplastic polyurethane composition. In one embodiment, the soft, second thermoplastic compositions have a hardness of 70 Shore A or less. A flexible window (153) is disposed between the first and second traction members (152*b*, 152*a*).

The first and second traction members (152*b*, 152*a*) have sloping sides (112) with a triangular-shaped, non-recessed top surface (114) that forms a ground contacting surface. Preferably, the total ground contact surface area is in the range of about 10 to about 70% based on total surface area of the tile. These traction members in Zone G (crash-pad) provide a high contact surface area to prevent slipping on hard, wet, and smooth surfaces. In other word, these traction members provide a "crash-pad" for the outsole; they have a relatively wide ground-contacting surface and have a relatively high Horizontal Contact Area Ratio (HCAR). Maximum contact by the traction members is maintained in this rear-foot zone of tiles. Also, in Zone G, the horizontal sidewalls of the traction members help prevent the golfer from slipping when he/she is walking downwardly on a golf slope or simply when he/she is walking on any surface.

As also shown in FIG. 18A, Zones A and F are located in the rear-foot region (84), and the traction tile structures in these Zones also comprise a first protruding traction member; an opposing second protruding traction member; and a non-protruding, flexible window disposed between the first and second traction members. For example, the first traction members (162*b*) can be relatively hard and can be made, for example, from a hard, first thermoplastic polyurethane composition. The second traction members (162*a*) are relatively soft and can be made, for example, from a soft, second thermoplastic polyurethane composition. In one embodiment, the soft, thermoplastic polyurethane composition has a hardness of 70 Shore A or less. A flexible window (163) is disposed between the first and second traction members. These traction members (162*a*, 162*b*) have a have a pyramid-like shape with sloping sides (112) and a triangular-shaped, non-recessed top surface (114) that forms a ground-contacting surface. In one embodiment, the total ground contact surface area is in the range of about 1 to about 70% based on total surface area of the traction tile structure.

When a golfer swings a club and transfers his/her weight, their foot absorbs tremendous forces. For example, when a right-handed golfer is first planting his/her feet before beginning any club swinging motion (that is, when addressing the ball), their weight is evenly distributed between their lead (front) and trail (back) feet. As the golfer begins their backswing (upswing), their weight shifts primarily to their back foot. Significant pressure is applied to the back foot at the beginning of the downswing. Thus, the back foot can be referred to as the driving foot and the front foot can be referred to as the stabilizing foot. As the golfer follows through with their swing (downswing) and drives the ball, their weight is transferred from the driving foot to the front (stabilizing) foot. During the swinging motion, there is some pivoting at the back and front feet, but this pivoting motion must be controlled. It is important the feet do not substantially move or slip when making the shot. Good foot traction is important during the golf upswing and downswing.

The traction members in Zones A and F may have vertical sidewalls that help manage strong horizontal forces applied against the outsole during the golf swing resulting in more resistance/traction, particularly during a golf upswing. The traction members in Zones C and E, which are located in the Forefoot Region and discussed in detail below, also help stabilize the foot against this pressure, thus providing more resistance/traction during the golf swing.

Mid-Foot Region

Figure 20:
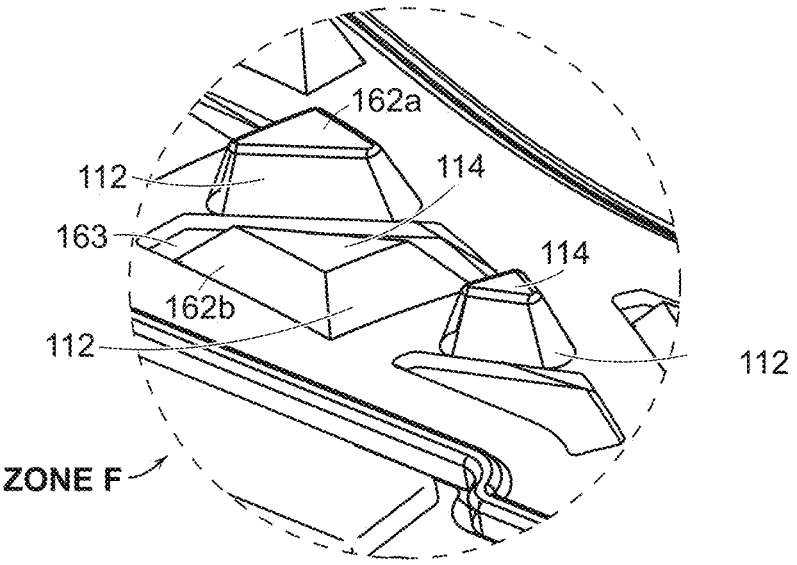
FIG. 20 is a close-up view of a portion of the outsole shown in FIG. 18, as marked by the "FIG. 20" broken circle in FIG. 18.

As also shown in FIGS. 18 and 18A, the mid-foot region (82) of the outsole (16) further comprises traction tile structures extending along this region, which can be referred to as Zone "B". More particularly, two traction tile structures in Zone B are shown in enlarged in FIG. 20. In this example, the first traction members (162*b*) are relatively hard and can be made, for example, from a hard, first thermoplastic polyurethane composition. In one embodiment, the hard, thermoplastic polyurethane composition has a hardness of greater than 70 Shore A. The second traction members (162*a*) are relatively soft and can be made, for example, from a soft, second thermoplastic polyurethane composition. A flexible window (163) is disposed between the first and second traction members. In some cases, the window (163) can constitute about 70 to about 100% of the traction tile structure, wherein there are no traction members in the tile structures (156). Also, in the mid-foot region (82), there may be a visible logo (158) which can be made from various materials, preferably thermoplastic polyurethane. Also, a shank (footbridge) (159) can be included in the outsole (16). In turn, this outsole (16), with its high mechanical strength properties, gives the golfer more stability and balance while walking on and off the course.

These traction members also have a pyramid-like shape with sloping sides (112) and a triangular-shaped, non-recessed top surface (114) that forms a ground-contacting surface. In one embodiment, the total ground contact surface area is in the range of about 1 to about 60% based on total surface area of the traction tile structure. In one preferred embodiment, the total ground contact surface area is in the range of about 5 to about 50%. These traction members in the mid-foot region (82) provide comfort and tend to distribute pressure from the central area of the mid-foot region toward the peripheral edges of the outsole (16).

Forefoot Region

As further shown in FIGS. 18 and 18A, the forefoot region (80) of the outsole (16) includes a first (medial) zone of tiles (Zone "C") containing traction tile structures extending along the periphery of the forefoot region; a second zone of tiles (Zone "D") containing traction tile structures disposed in the anterior portion of the forefoot region; and a third (lateral) zone (Zone "E") containing protruding traction tile structures extending along the opposing periphery of the forefoot region.

Figure 21:
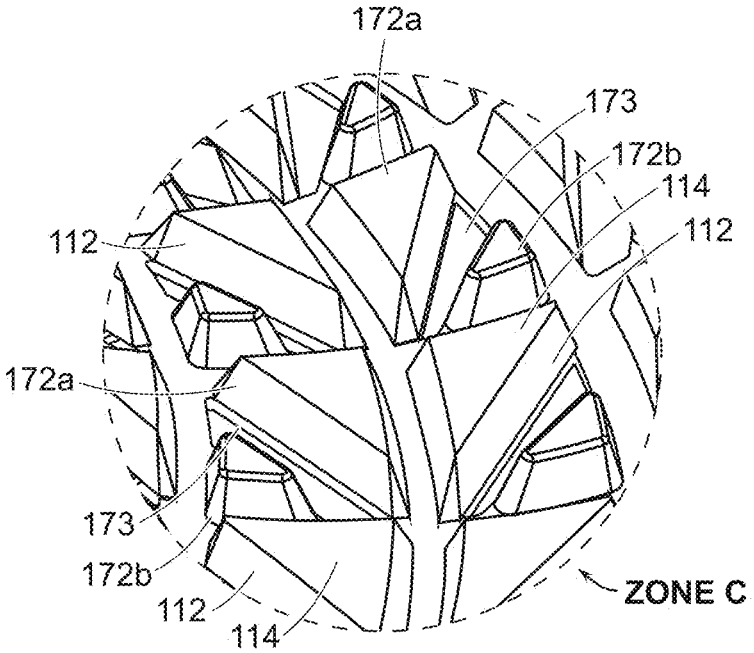
FIG. 21 is a close-up view of a portion of the outsole shown in FIG. 18, as marked by the "FIG. 21" broken circle in FIG. 18.

Referring to FIG. 21, the traction tile structures in this medial Zone C are shown having first and second traction members (172*b*, 172*a*) with sloping sides (112) and a triangular-shaped, non-recessed top surface (114) that forms a ground contacting surface. A flexible window (173) is disposed between the first and second traction members. In this example, the first traction members (172*b*) are relatively hard and can be made, for example, from a hard, first thermoplastic polyurethane composition. In one embodiment, the hard, thermoplastic polyurethane composition has a hardness of greater than 70 Shore A. The second traction members (172*a*) are relatively soft and can be made, for example, from a soft, second thermoplastic polyurethane composition. In one embodiment, the soft, thermoplastic polyurethane composition has a hardness of 70 Shore A or less. Preferably, the total ground contact surface area is in the range of about 10 to about 70% based on total surface area of the traction tile structure. These traction members are located under the ball of the foot, which is a high-pressure area.

Figure 22:
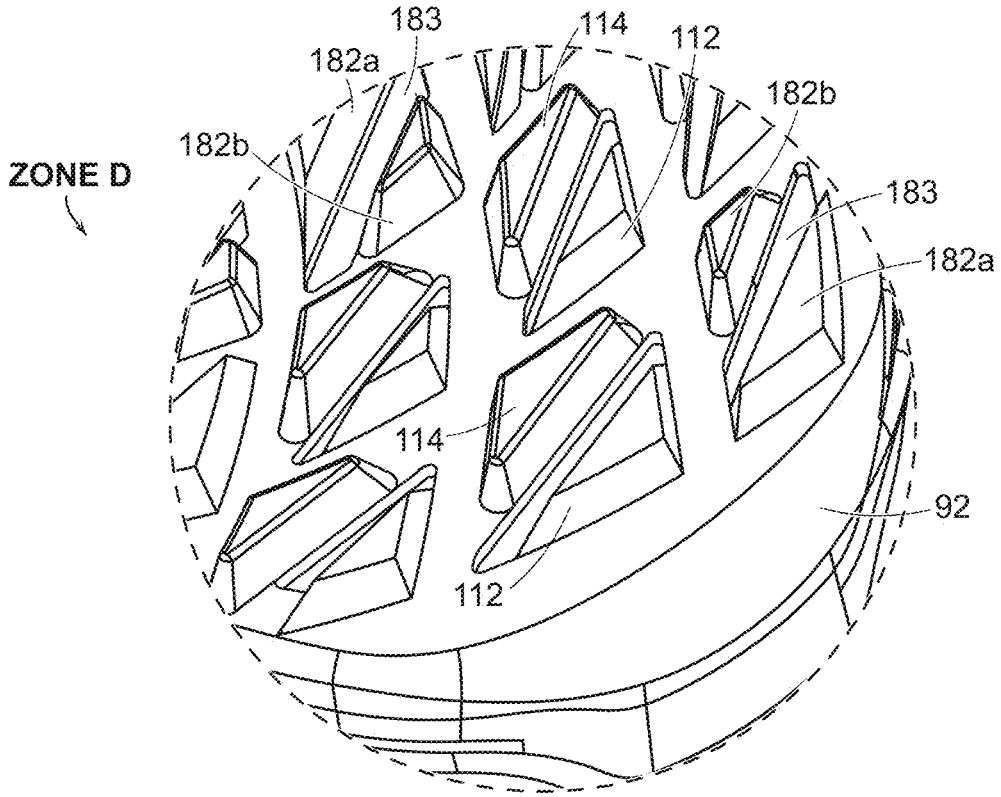
FIG. 22 is a close-up view of a portion of the outsole shown in FIG. 18, as marked by the "FIG. 22" broken circle in FIG. 18.

Turning to FIG. 22, an enlarged view of the traction tile members in anterior Zone D is shown. These first and second traction members (182*b*, 182*a*) also have sloping sides (112) and a triangular-shaped, non-recessed top surface (114) that forms a ground contacting surface. A flexible window (183) is disposed between the first and second traction members. In this example, the first traction members (182*b*) are relatively hard and can be made, for example, from a hard, first thermoplastic polyurethane composition with a hardness as discussed above. The second traction members (182*a*) are relatively soft and can be made, for example, from a soft, second thermoplastic polyurethane composition with a hardness as discussed above. Preferably, the total ground contact surface area is in the range of about 10 to about 70% based on total surface area of the traction tile structure. These traction members are located under the toes of the foot, and help provide good traction and toe push-off.

Figure 23:
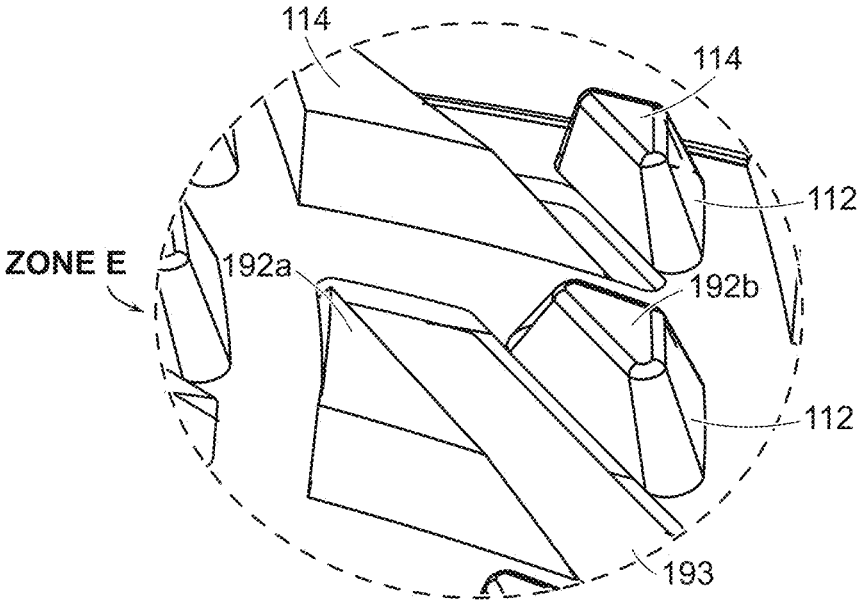
FIG. 23 is a close-up view of a portion of the outsole shown in FIG. 18, as marked by the "FIG. 23" broken circle in FIG. 18.
Figure 24:
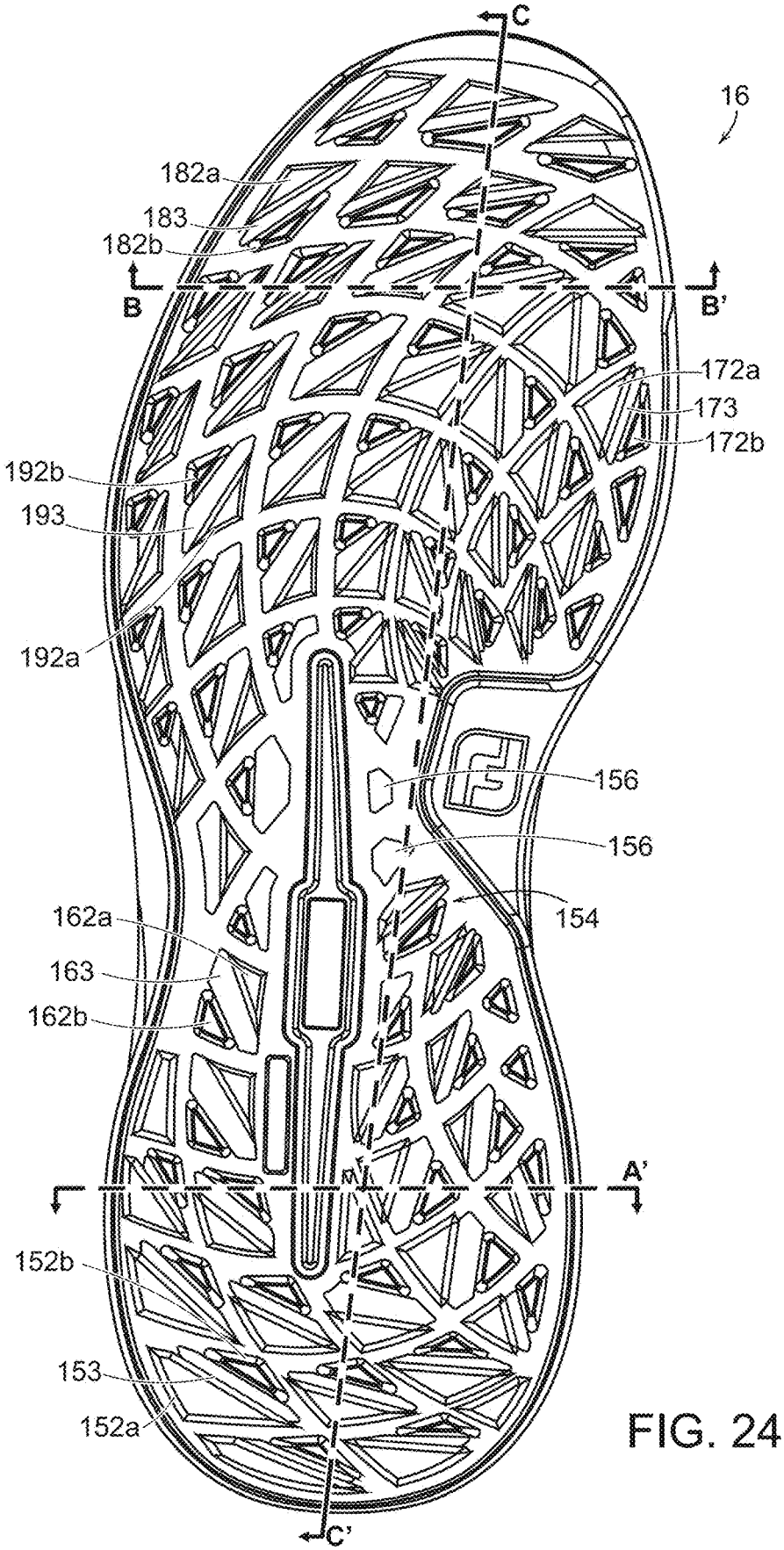
FIG. 24 is a bottom plan view of one example of an outsole of the present invention showing traction members extending along the forefoot, midfoot, and rear-foot regions.

Turning to FIG. 23, an enlarged view of the traction tile members in lateral Zone E is shown. These first and second traction members (192*b*, 192*a*) also have sloping sides (111, 112) and a triangular-shaped, non-recessed top surface (114) that forms a ground contacting surface. A flexible window (193) is disposed between the first and second traction members. In this example, the first traction members (192*b*) are relatively hard and can be made, for example, from a hard, first thermoplastic polyurethane composition with a hardness as discussed above. The second traction members (192*a*) are relatively soft and can be made, for example, from a soft, second thermoplastic polyurethane composition with a hardness as discussed above. Preferably, the total ground contact surface area is in the range of about 10 to about 70% based on total surface area of the tile.

The traction tile structures in Zone C (medial) and Zone E (lateral) are primarily used for golf-specific traction, that is, these traction members help control forefoot lateral and medial traction, and prevent the foot from slipping during a golf shot. As discussed above, significant pressure is applied to the exterior of the foot at various stages in the golf shot swing. In the present invention, the Zones C and E of the outsole (16) are designed to provide support and stability to the sides of the foot. In particular, as the golfer follows through with their swing (downswing) and drives the ball, their weight is transferred from the back (driving) foot to the front (stabilizing) foot. During the swinging motion, there is some pivoting at the back and front feet, but this pivoting motion must be controlled. The Zones C and E help hold and support the lateral and medial sides of the golfer's foot as he/she shift their weight when making a shot. Thus, the golfer has better stability and balance in all phases of the game. The traction members in Zones C and E have vertical sidewalls that help manage strong horizontal forces applied against the outsole during the golf swing resulting in more resistance/traction, particularly during a golf downswing. The traction members in Zones A and F, which are located in the Rear-Foot Region and discussed in detail above, also help stabilize the foot stabilize the foot against this pressure, thus providing more resistance/traction during the golf swing.

At the same time, the Zones D, E, and C in the Forefoot Region have good active phase thrust generation, so the golfer is better able to push-off their foot. These features help the golfer with playing performance and walking the course. The golfer is able to engage in golf-specific activities comfortably and naturally. All of these different traction members in the outsole help impart a high level of stability and traction as well as high flexibility to the golf shoe of this invention. The unique geometry and structure of the upper (12), midsole (14), and outsole (16) including the traction members provides the golfer with a shoe having many beneficial properties.

Figure 27:
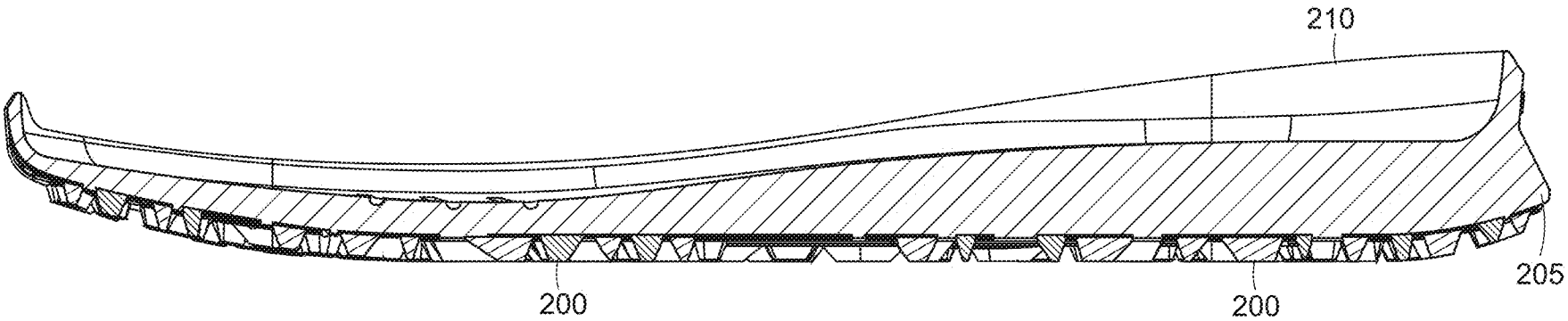
FIG. 27 is a cross-sectional view of the outsole in FIG. 24 along Line C-C'.

Turning to FIGS. 24-27, the outsole (16) and midsole (14) structures are shown in more detail. As discussed above, the outsole (16) is designed to provide stability and traction for the shoe. The bottom surface of the outsole (16) includes multiple traction members, generally indicated at (200) in FIGS. 25-27, to help provide traction between the shoe and grass on the course. The bottom surface of the outsole (16) and traction members (200) can be made of any suitable material such as rubber or plastics and combinations thereof as discussed above. The midsole (14) is relatively light-weight and provides cushioning to the shoe. The midsole (14) can be made from midsole materials such as, for example, foamed ethylene vinyl acetate copolymer (EVA) or foamed polyurethane compositions. In one preferred embodiment, the midsole (14) is constructed using a foam blend composition of ethylene vinyl acetate (EVA) and polyolefin as further described below. Commercially-available foam blend compositions such as, for example, Engage® PO-EVA, available from the Dow Chemical Company can be used. Different foaming additives and catalysts are used to produce the EVA foam. The EVA blend foam compositions have various properties making them particularly suitable for constructing midsoles including good cushioning and shock absorption; high water and moisture-resistance; and long-term durability. In FIGS. 25-27, the midsole (14) is shown having a lower region (205) and upper region (210). These lower and upper regions (205, 210) can be made of the same or different materials. For example, one region can be made of a relatively hard foamed EVA composition; and the other region can be made of a relatively soft foamed EVA composition. The lower region (205) forms the sidewalls of the midsole, and these firm, strong sidewalls help hold and support the medial and lateral sides of the golfer's foot as they shift their weight when making a golf shot. In this embodiment of the invention, the outsole structure (16) is a dual-grid structure comprising relatively hard traction members and relatively soft traction members as discussed further below.

Figure 28:
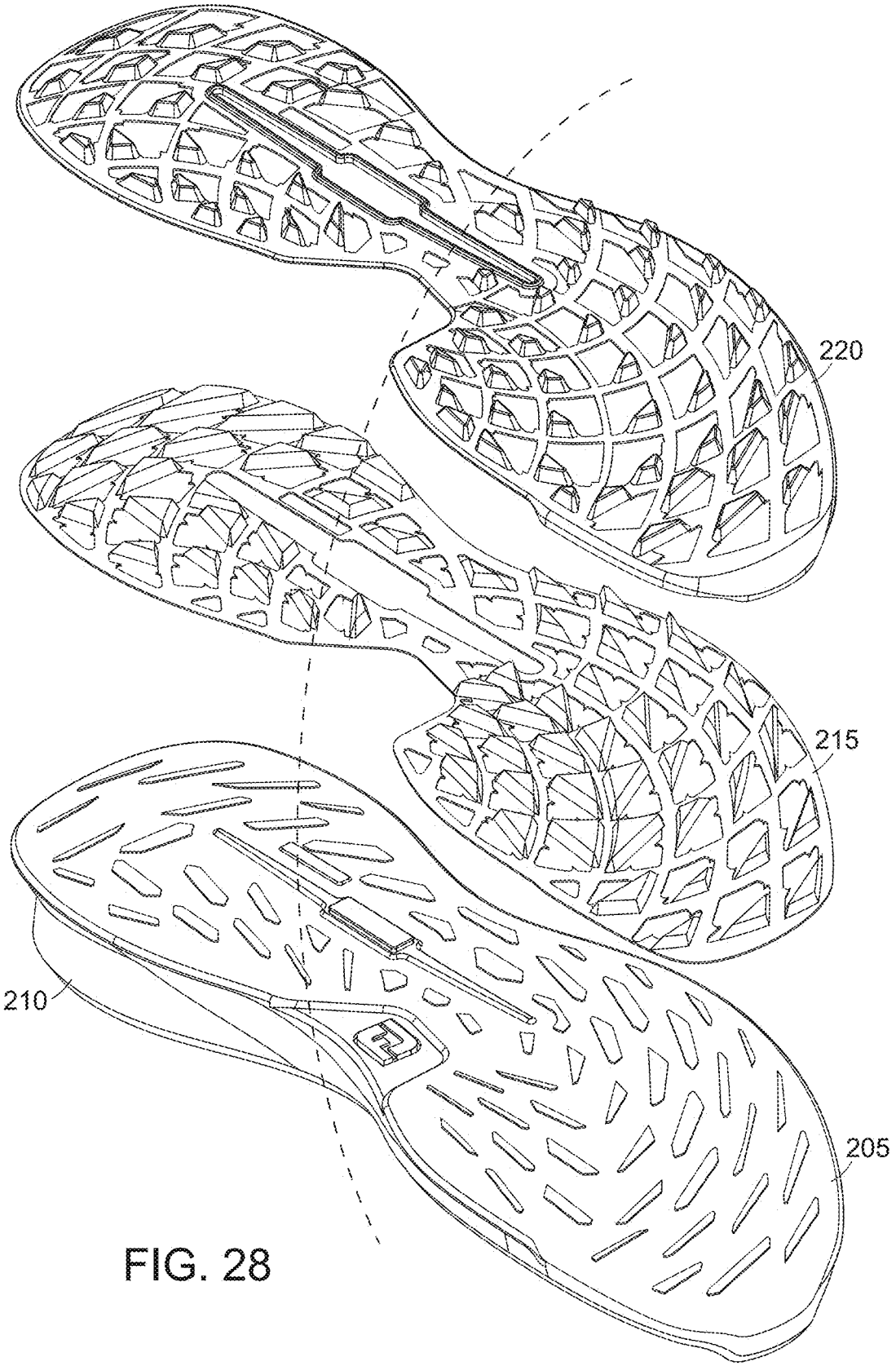
FIG. 28 is an exploded view of one example of a midsole and outsole of the golf shoe of the present invention showing the different components of the midsole and outsole.

More particularly, referring to FIG. 28 the outsole section containing the hard, thermoplastic polyurethane traction members (220); outsole section containing the soft thermoplastic polyurethane traction members (215); and the midsole section including the lower region (205) are shown in an exploded view. In one manufacturing process, the midsole (14) can be molded as a separate piece and then joined to the top surface of the outsole by stitching, adhesives, or other suitable means using standard techniques known in the art. For example, the midsole (14) can be heat-pressed and bonded to the top surface of the outsole (16). The outsole can be molded using a 'two-shot' mold, wherein the hard, thermoplastic polyurethane (TPU) used to make the outsole section containing the hard, thermoplastic polyurethane traction members is injected into the mold first; and the soft thermoplastic polyurethane (TPU) used to make the outsole section containing the soft traction members is injected into the mold secondly. In one embodiment, the harder thermoplastic polyurethane is molded over the softer thermoplastic polyurethane to provide a U-shaped beam-like structure having high structural capacity. The harder thermoplastic polyurethane provides a protective shell around the softer thermoplastic polyurethane. This dual-grid structure of the outsole helps provide high structural support and mechanical strength. The dual-grid structure has high structural rigidity an yet it does not sacrifice flexibility as discussed further below.

Figure 32:
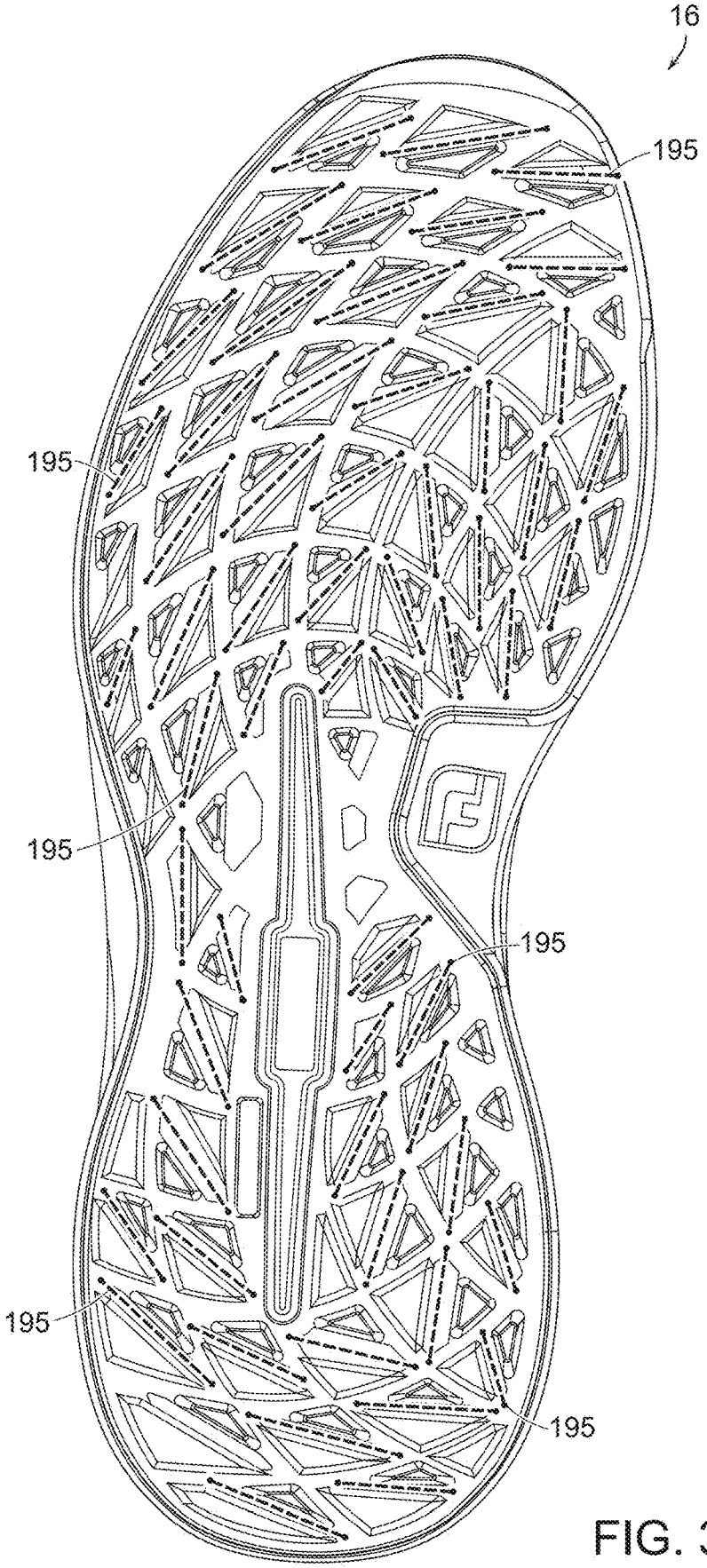
FIG. 32 is a bottom plan view of one example of an outsole of the present invention showing traction members extending along the forefoot, midfoot, and rear-foot regions with the flex points shown in detail.

Turning to FIGS. 29 and 30, the traction tile segment may comprise a first protruding traction member comprising a hard, thermoplastic polyurethane traction member (220); an opposing second protruding traction member; and a non-protruding, level base segment (window) disposed between the first and second traction members. The first traction member (162*b*) is relatively hard and the second traction member (162*a*) is relatively soft. The open window (163) provides a flex point in between the two traction members. As shown in FIG. 32, these flex points (195) are oriented in various directions across the dual-grid structure. The flex points (195) have different axes and this provides a three-hundred and sixty-degree (360 degree) flex feel to the dual-grid structure. The flex points (195) form discrete flex zones throughout the outsole; as a result, the outsole (16) is able to flex slightly in multiple directions as opposed to many traditional shoes that flex only in a single direction. The outsole (16) of this invention does not have hinge points, wherein major sections of the outsole flex; rather, the outsole has many minor flex points oriented at many different angles. Thus, the outsole (16) provides a three-hundred and sixty-degree (360 degree) flex feel to the person wearing the shoes. The outsole of this invention provides an optimum combination of structural rigidity and flexibility.

As shown in FIGS. 29 and 30, the first traction members (162*b*) have sidewalls with sloping surfaces and a triangular-shaped, non-recessed top surface that forms a ground contacting surface. The second traction members (162*a*) can also have sidewalls with sloping surfaces and a larger sized triangular-shaped, non-recessed top surface than the first. The flat surface helps provide a relatively high Horizontal Contact Area Ratio (HCAR) and the sidewalls help provide a relatively high Vertical Contact Area Ratio (VCAR).

Figure 33A:
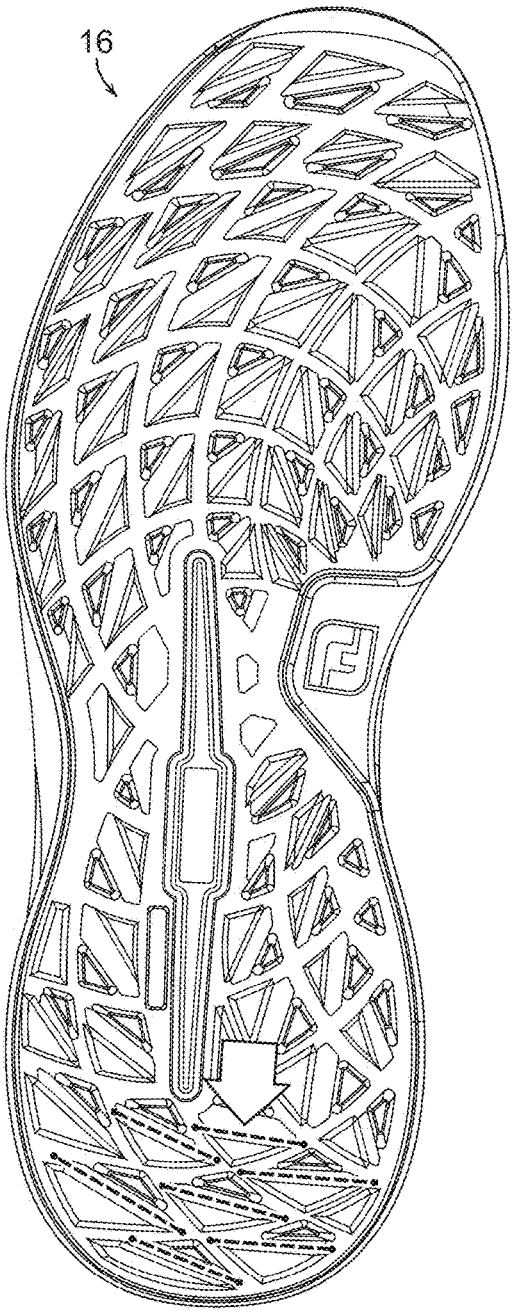
FIG. 33A is a schematic diagram of one example of the outsole of this invention showing horizontal sidewalls of selected traction members in Zone G in detail.
Figure 33B:
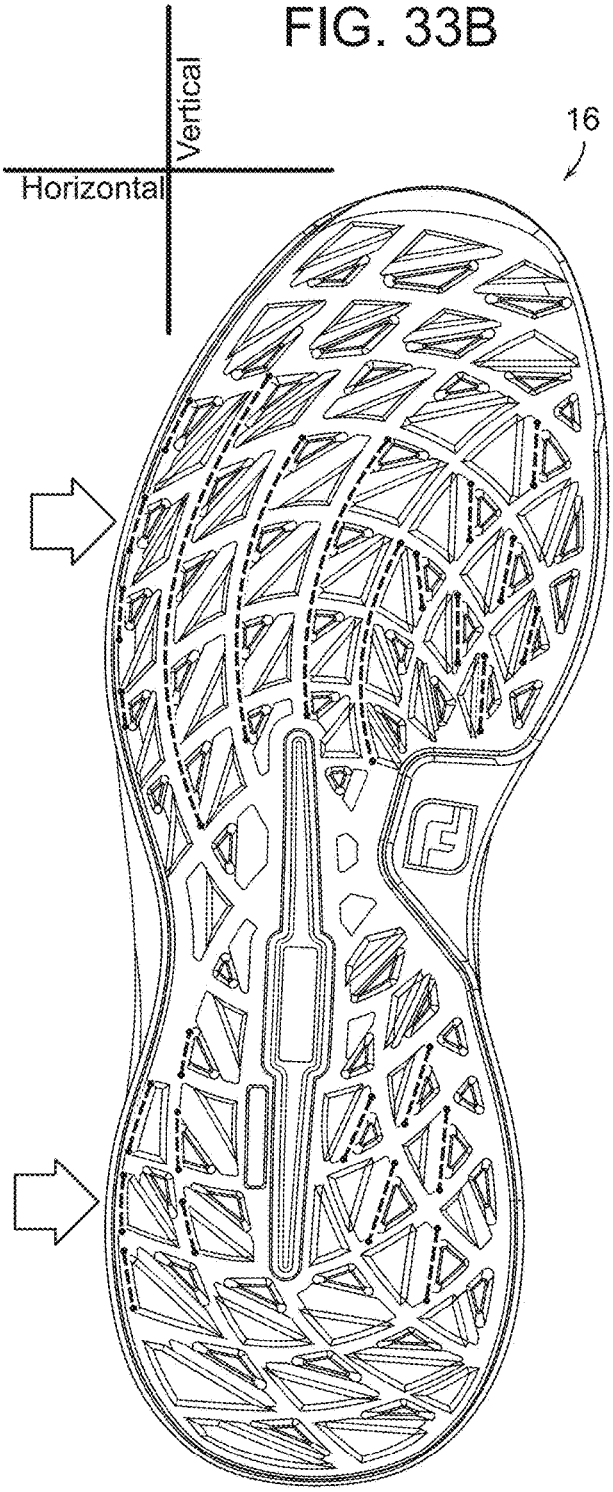
FIG. 33B is a schematic diagram of one example of the outsole of this invention showing vertical sidewalls of selected traction members in Zones A, C, E, and F in detail.
Figure 33C:
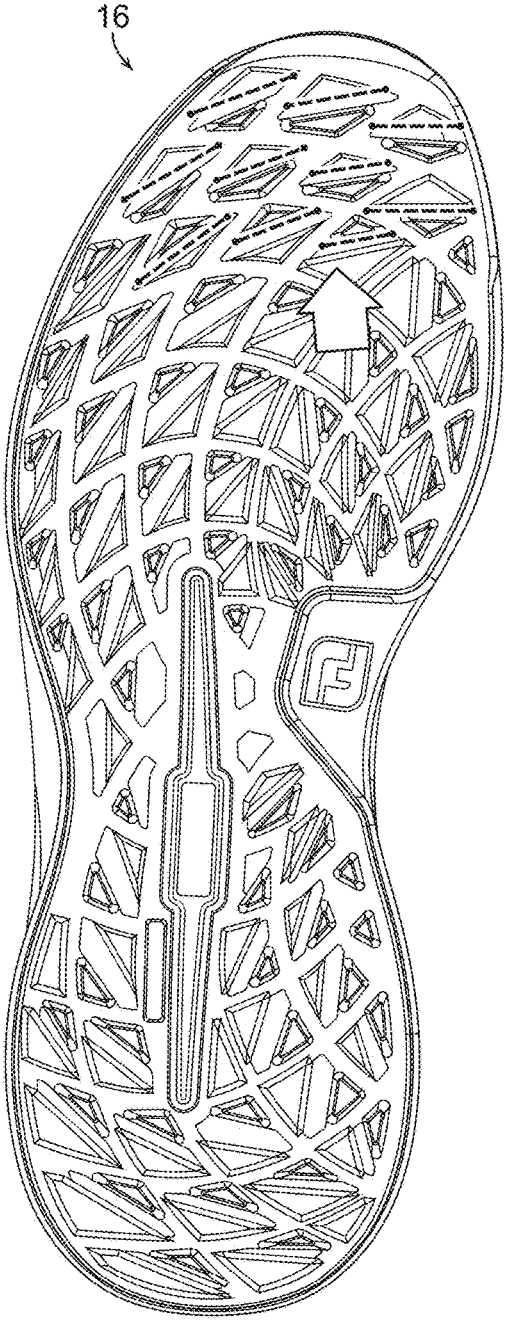
FIG. 33C is a schematic diagram of one example of the outsole of this invention showing horizontal sidewalls of selected traction members in Zone D in detail.
Figure 33D:
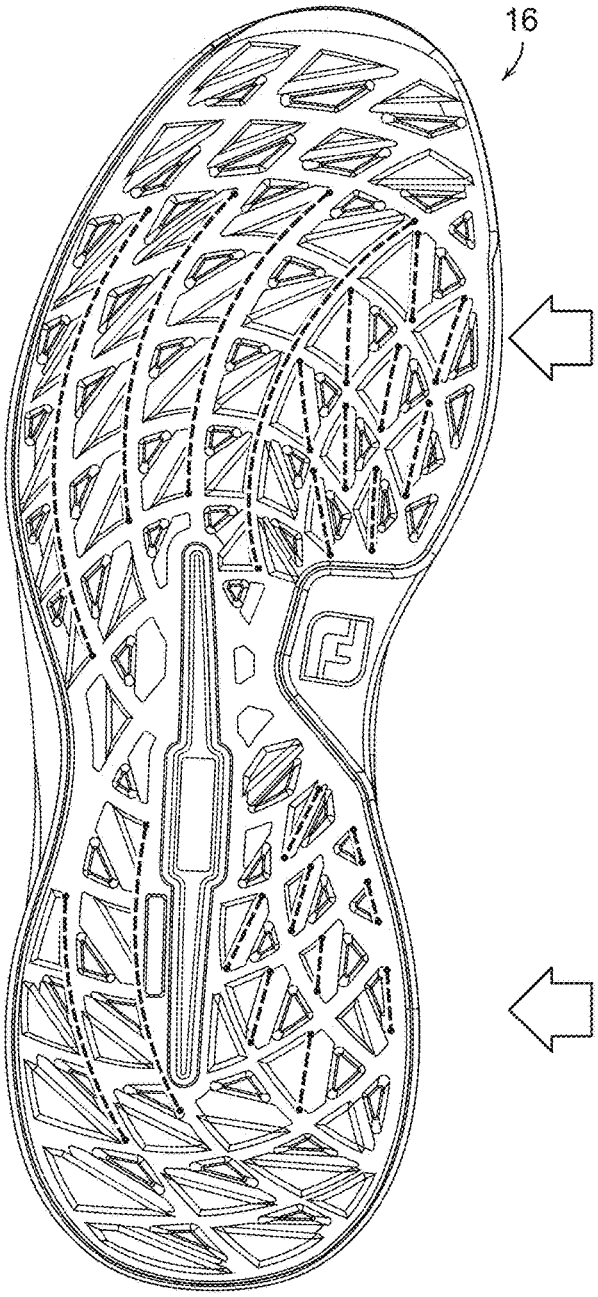
FIG. 33D is a schematic diagram of one example of the outsole of this invention showing vertical sidewalls of other traction members in Zones A, C, E, and F in detail.

Referring to FIGS. 33A, 33B, 33C, and 33D, the horizontal and vertical sidewalls of the traction members in the outsole (16) also provide other benefits for the traction members in the different regions. For example, as shown in FIG. 33A, in Zone G (crash-pad) of the heel area, the horizontal sidewalls of the traction members help prevent the golfer from slipping when he/she is walking downwardly on a golf slope or simply walking on or off-course. In FIG. 33B, the vertical sidewalls in Zones A, C, E, and F also help stabilize the foot against the significant horizontal pressure and forces that are exerted against the foot (shown by directional arrows in FIG. 33B), particularly during the golf backswing (upswing). In FIG. 33C, the horizontal sidewalls in Zone D helps provide good traction and prevent slipping, particularly when a golfer is walking upwardly on a golf slope or simply walking on or off-course. A golfer wearing the shoe can comfortably walk and play the course. The shoe (10) has high forefoot flexibility, and yet it does not sacrifice stability, traction, and other important properties. Lastly, referring to FIG. 33D, the opposing vertical sidewalls in Zones A, C, E, and F help stabilize the foot against the significant horizontal pressure and forces that are exerted against the foot (shown by directional arrows in FIG. 33D), particularly during the golf downswing. Zones A, C, E, and F are golf-specific Zones that provide support and stability to the sides of the foot so the golfer does not slip during the golf swing. The golfer needs a stable platform so that he/she can maintain their balance as they perform their swinging action. At the same time, a golfer wearing the shoe can comfortably walk and play the course. The shoe is lightweight and comfortable so it can be worn easily while walking and in other activities. A person can easily and comfortably wear the shoe away from the golf course. The shoe has high flexibility, and yet it does not sacrifice stability, traction, and other important properties. As discussed above, the Horizontal Contact Area Ration (HCAR) is optimized in specific outsole traction zones for walking on hard, flat surfaces, particularly "off-course" surfaces such as boat decks, polished concrete and marble flooring, painted surfaces of sidewalks, and the like. In the remaining outsole traction zones, the HCAR is managed and tuned so that a maximum VCAR (Vertical Contact Area Ratio) can be reached for a given HCAR.

The shoe of this invention has an optimum combination of structural rigidity and flexibility. The unique geometry, materials, and structure of the upper (12), midsole (14), and outsole (16) including the traction members provides the golfer with a multi-surface (MST) shoe. The shoes of this invention achieve high traction on firm and particularly hard, wet, and smooth "off-course" surfaces. The shoes also provide high traction on various natural turf surfaces, particularly golf courses or "on-course" surfaces.

Heeled Outsole

Figure 34:
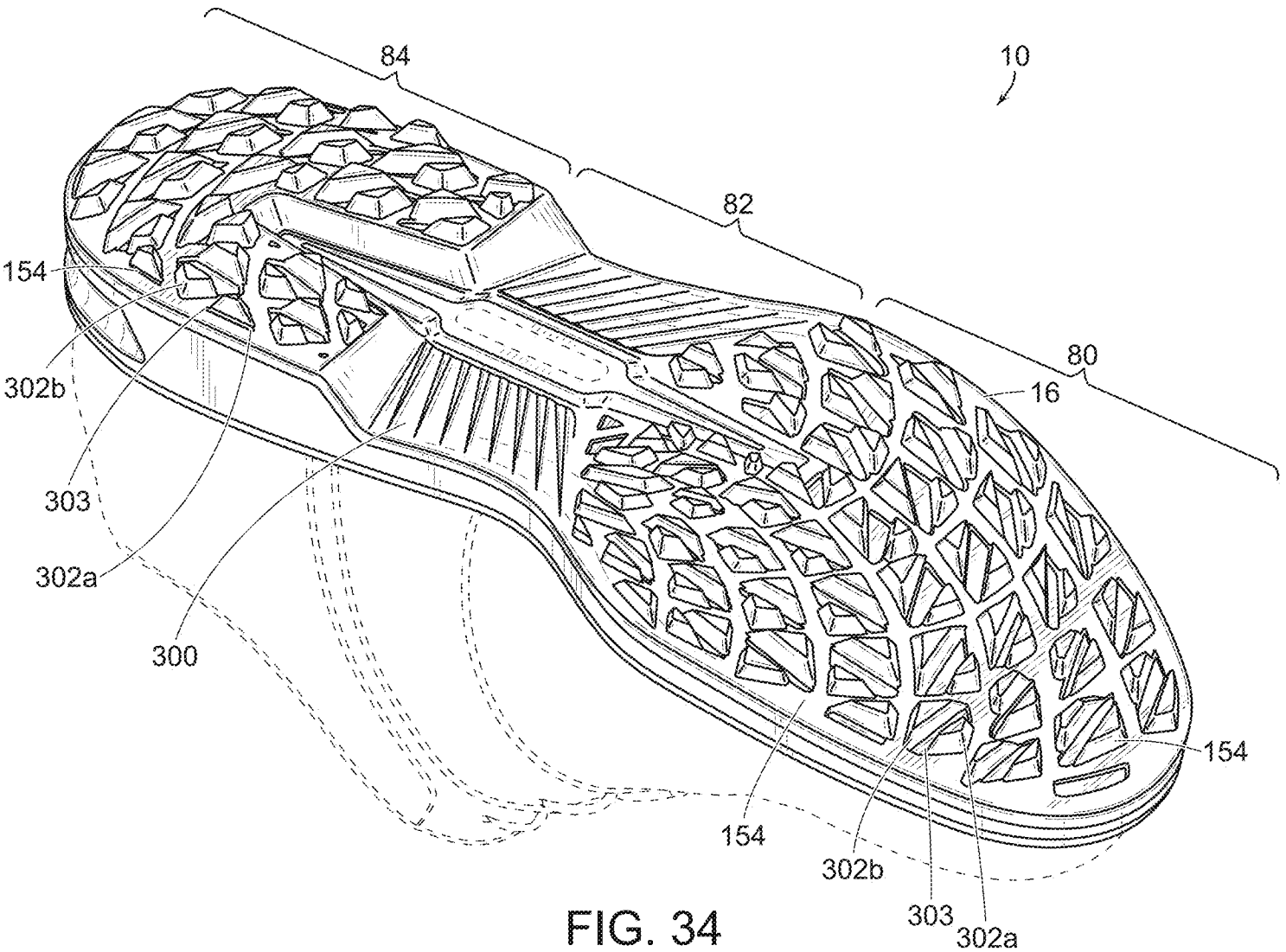
FIG. 34 is a perspective view of one embodiment of a golf shoe of the present invention showing the outsole in detail.
Figure 35:
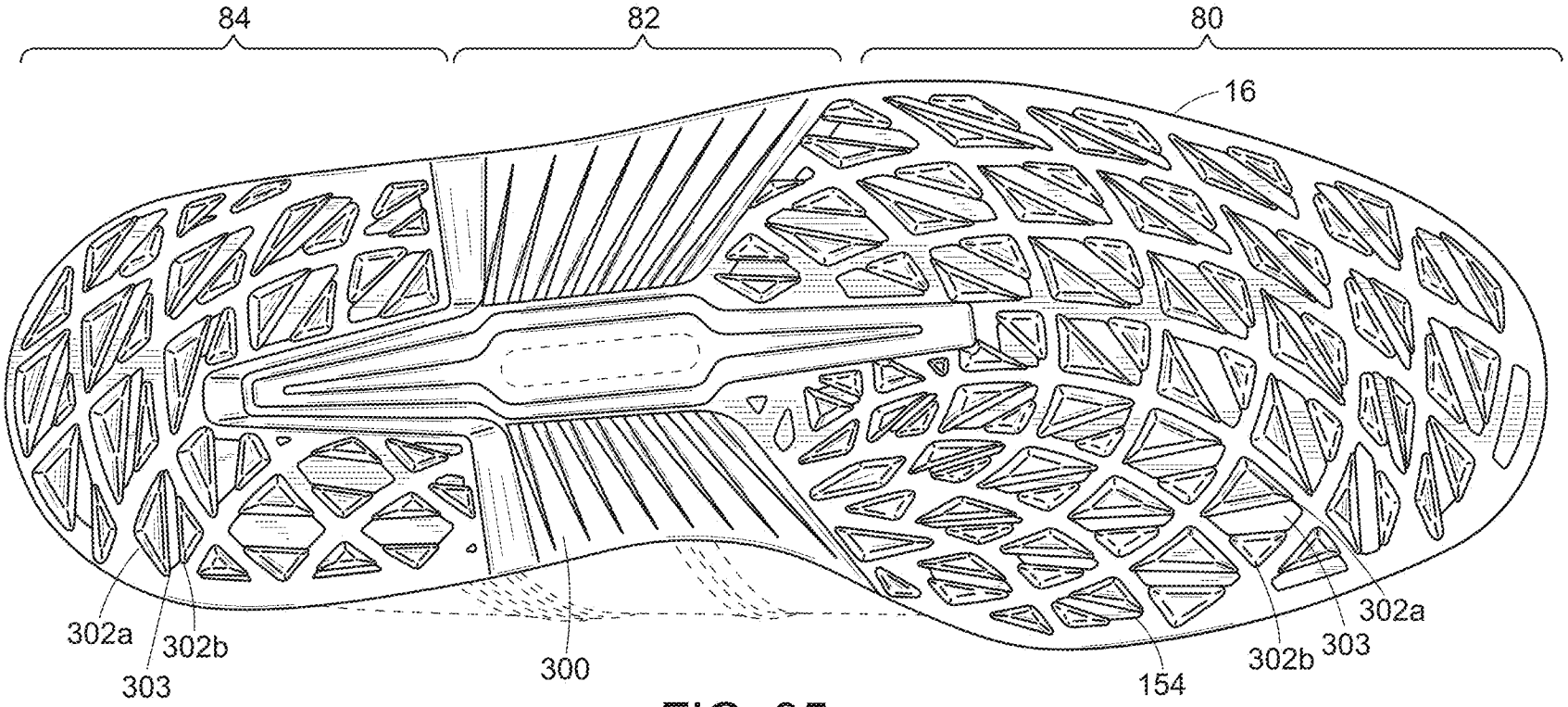
FIG. 35 is a bottom plan view of the embodiment of the outsole of FIG. 34 of the present invention.
Figure 36:
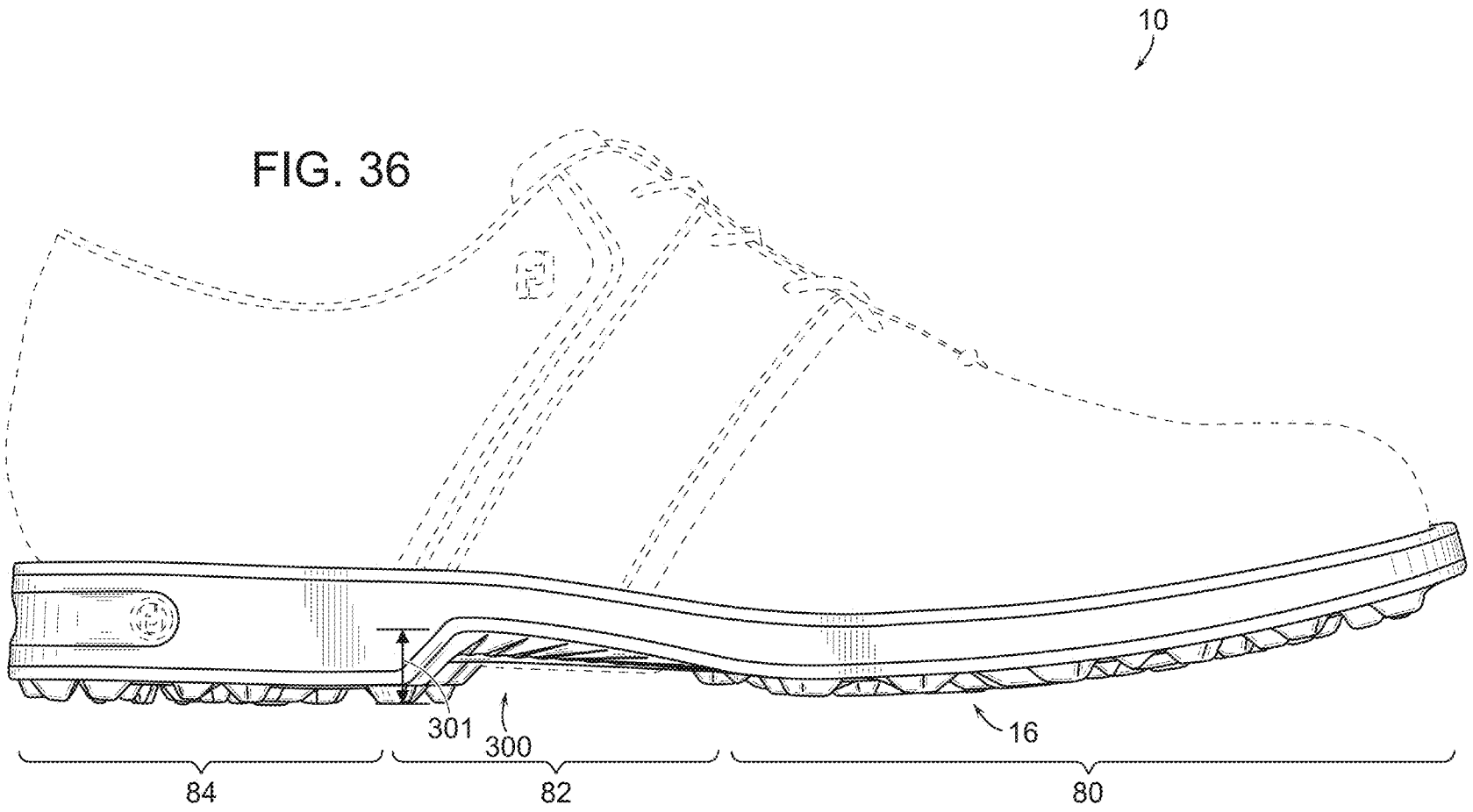
FIG. 36 is a medial side view of the embodiment of a golf shoe of FIG. 34 of the present invention.

Now referring to FIGS. 34-36, as described above the outsole (16) generally includes a forefoot region (80) for supporting the forefoot area; a mid-foot region (82) for supporting the mid-foot including the arch area; and rearward region (84) for supporting the rear-foot including heel area. In general, the forefoot region (80) includes portions of the outsole corresponding with the toes and the joints connecting the metatarsals with the phalanges. The mid-foot region (82) generally includes portions of the outsole corresponding with the arch area of the foot. The rear-foot region (84) generally includes portions of the outsole corresponding with rear portions of the foot, including the calcaneus. The forefoot region (80) and rearward region (84) include the tile structures (154) as previously described, while the mid-foot region incorporates a heel step region (300). The tile structures (154) shown in FIGS. 34-36 are provided as described with regard to FIGS. 18-33D. It will be appreciated that alternatively the traction members may also be provided as previously described and shown in FIGS. 1-17B. In the embodiment shown in FIGS. 34-36, heel step region (300) is provided extending from the forefoot region (80) through the mid-foot region (82) to the rearward region (84) sloping upward and away from the outermost portion of the tile structures (154) where they contact the ground. In some cases, the heel step region (300) generally slopes to a maximum height (301) of about 5 mm to about 20 mm, preferably 8-17 mm. It will be appreciated that the heel step region (300) does not come into contact with the ground and may not have any tile structures (154). Typically, this heel step region (300) is provided on golf shoes with a more traditional classic dress design for the upper.

In the embodiment of FIGS. 34-37, the tile structures (154) located on the outsole (16) comprise a first protruding traction member (302*b*); an opposing second protruding traction member (302*a*); and a non-protruding, base segment (window) (303) disposed between the first and second traction members (302*b*, 302*a*). As described previously, the traction members of this embodiment can have various sizes, shapes, and/or material properties. In this embodiment, preferably the first traction members (302*b*) can be made from a relatively hard, first thermoplastic polyurethane composition having a hardness of greater than 80 Shore A; and the second traction members (302*a*) can be made from a relatively soft, second thermoplastic polyurethane composition having a hardness of 80 Shore A or less. Such first and second traction members (302*b*, 302*a*) can be made from commercially-available polyurethane compositions such as, for example, Estane® TRX thermoplastic polyurethanes, available from the Lubrizol Corporation. Moreover, as described previously, the traction members (302*b*, 302*a*) also can have various dimensions. In this embodiment, the lengths (heights) of the relatively hard traction members (302*b*) and lengths (heights) of the relatively soft traction members (302*a*) are substantially the same. For example, the heights of the relatively hard and soft traction members can be in the range of about 2 mm to about 6 mm. Preferably, the heights of the relatively hard and soft traction members are in the range of about 2.5 mm to about 4.5 mm.

Heeled Outsole with Spikes

Figure 37:
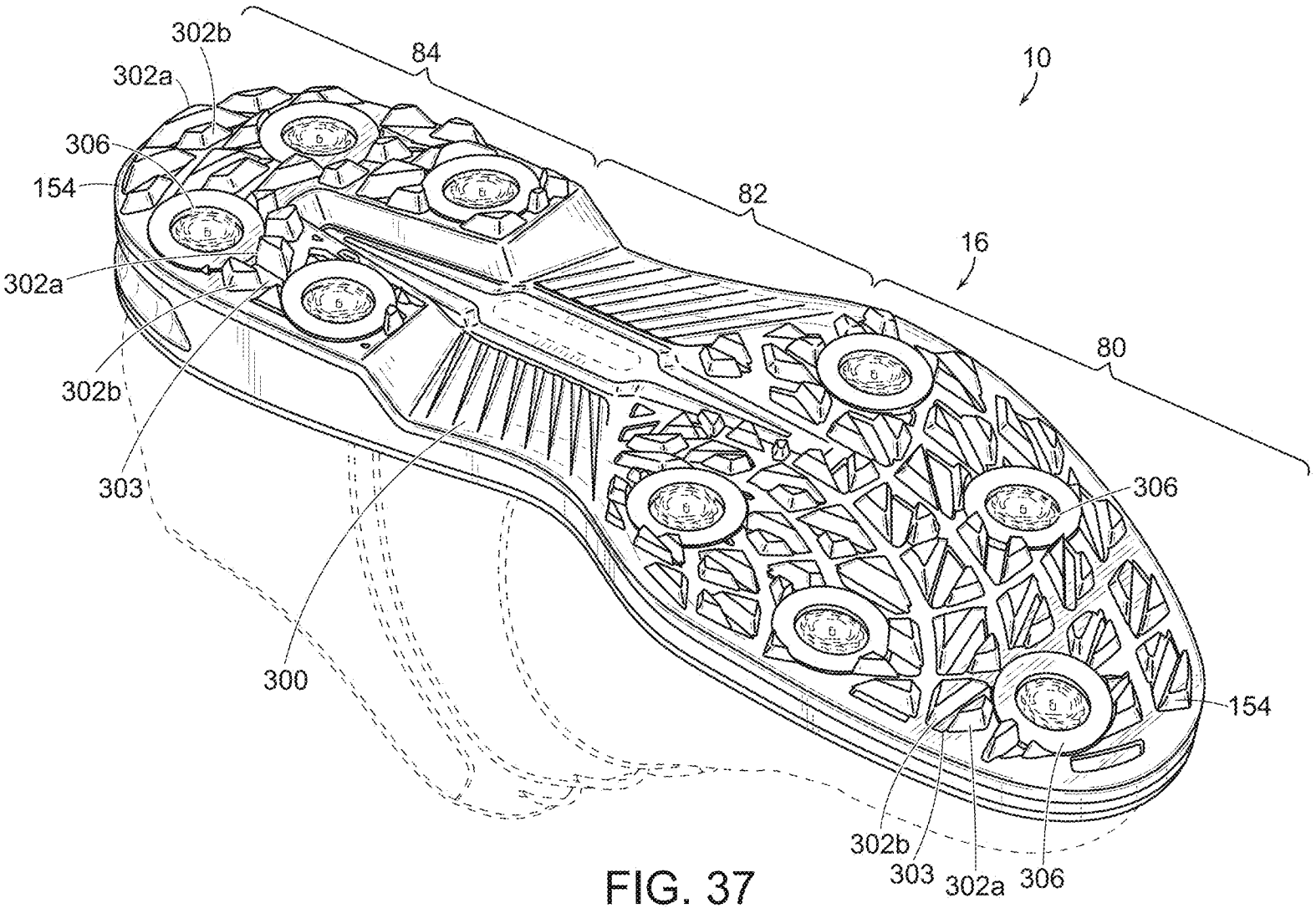
FIG. 37 is a perspective view of one embodiment of a golf shoe of the present invention showing the outsole in detail with spike receptacles.
Figure 38:
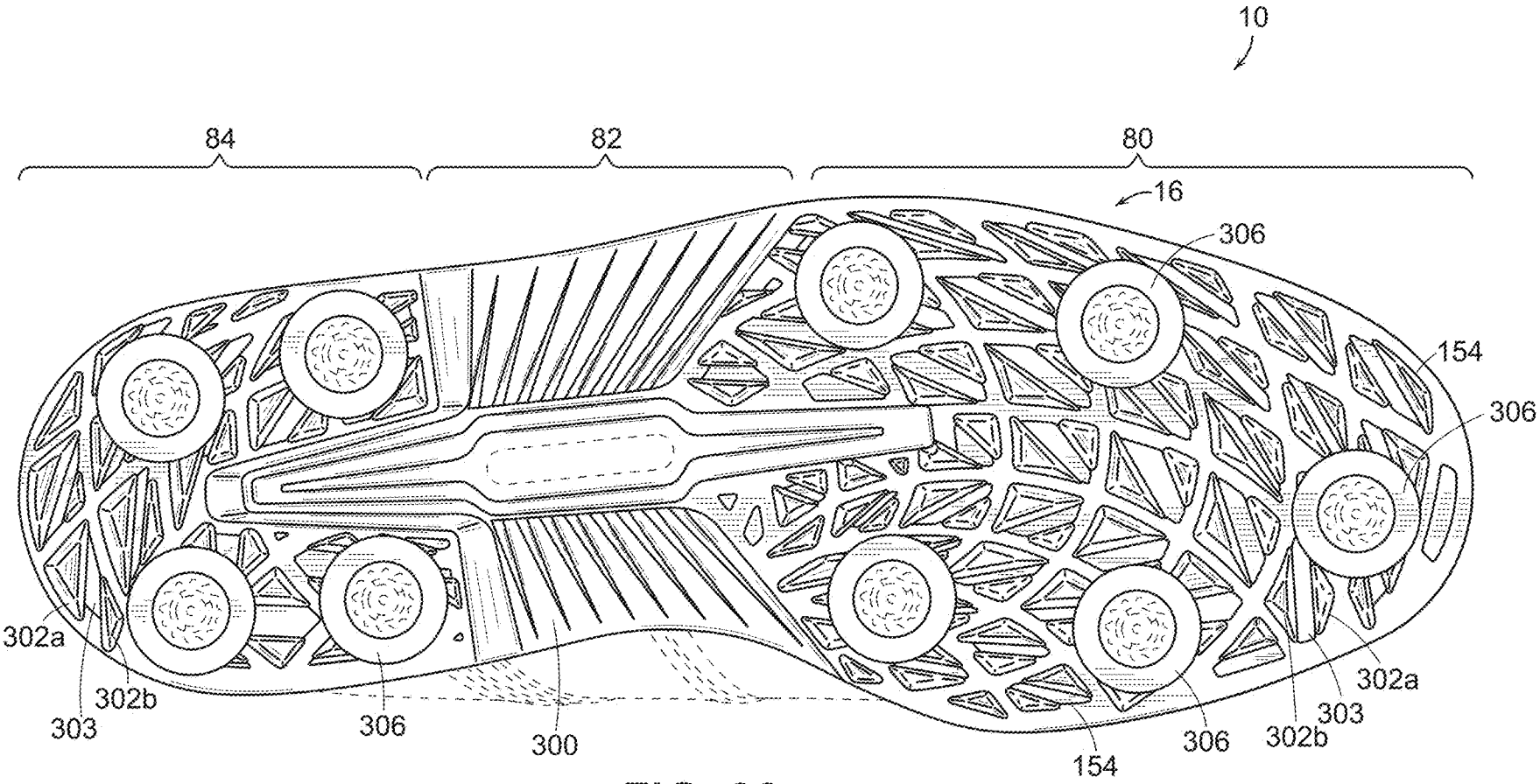
FIG. 38 is a bottom plan view of the embodiment of the outsole of FIG. 37 of the present invention with spike receptacles.
Figure 39:
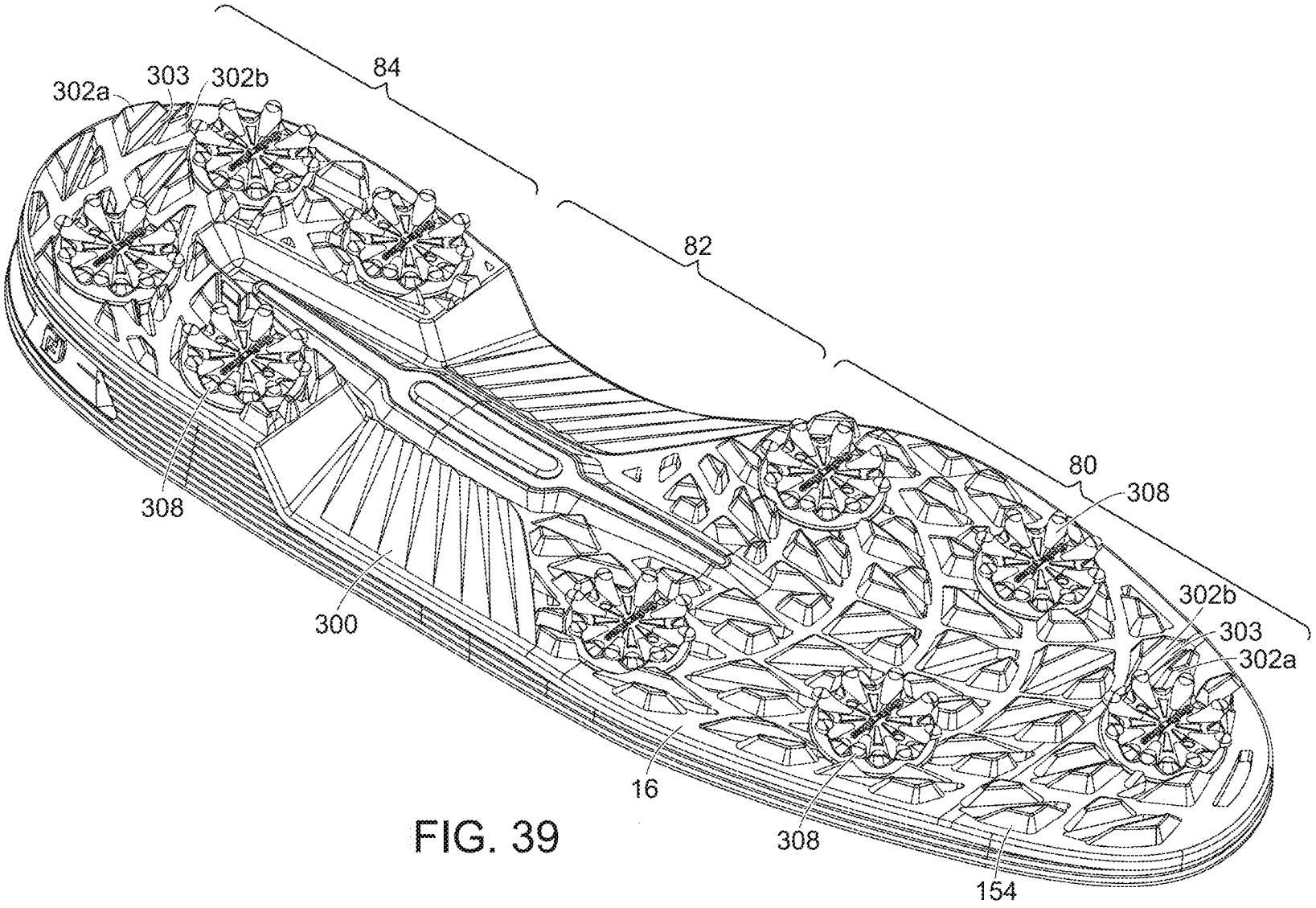
FIG. 39 is a perspective view of the embodiment of FIG. 37 of the present invention showing the outsole in detail with spikes secured in the spike receptacles.
Figure 41:
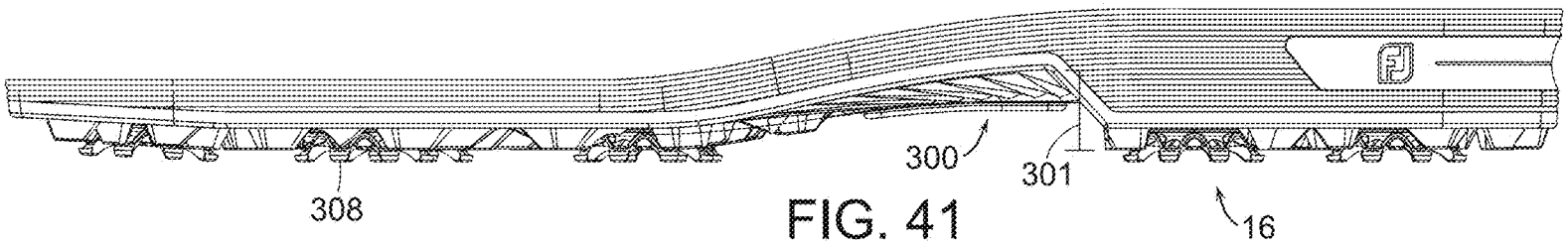
FIG. 41 is a medial side view of the embodiment of a golf shoe of FIG. 39 of the present invention.
Figure 40:
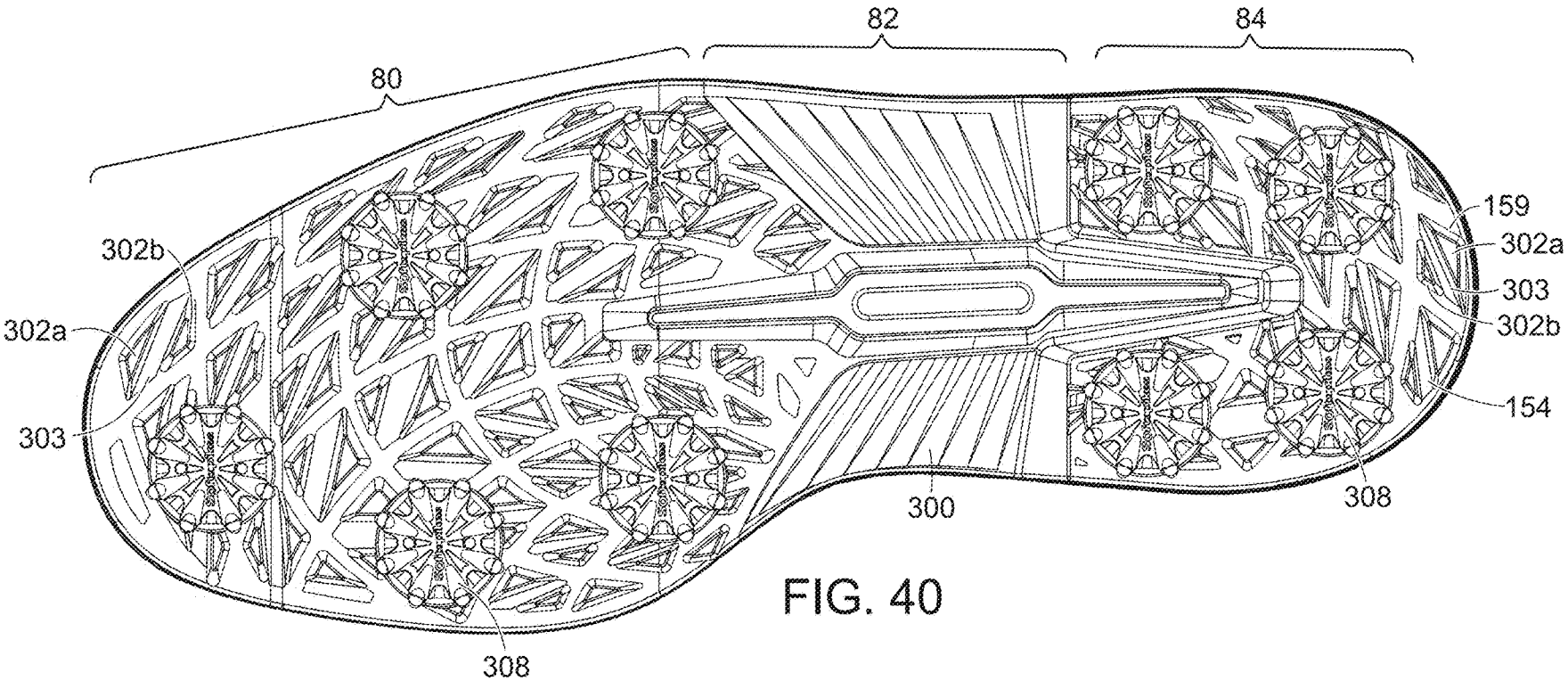
FIG. 40 is a bottom plan view of the embodiment of the outsole of FIG. 39 of the present invention.

Now referring to FIGS. 37-42C, the embodiment shown in FIGS. 34-36 has outsole (16) incorporating spike receptacles (306) for receiving spikes (308). FIGS. 37 and 38 show placement of the spike receptacles (306) on the outsole (16). Generally, five spike receptacles (306) are placed in the forefoot region (80) and four spike receptacles (306) are place in the rear-foot foot region (84). However, it will be appreciated that any number or placement of spike receptacles (306) may be used. The spike receptacles (306) are molded and attached to the outsole (16). The spikes (308) may be secured to and removed easily from the outsole (16). As is known in the art, the spikes (308) may be secured in the spike receptacle (306) by inserting and slight twisting in a clockwise direction and removed with slight twisting in a counter-clockwise direction. Now referring to FIGS. 39-41, spikes (308) are shown secured in the spike receptacles (306) provided in the outsole (16). It will be appreciated that any spikes that may be suitable for use in golf could be attached to the spike receptacles. Typically, the spike (308) will have a rounded base (310) with radial arms (312) having traction projections (314) that contact the ground surface.

Figure 42A:
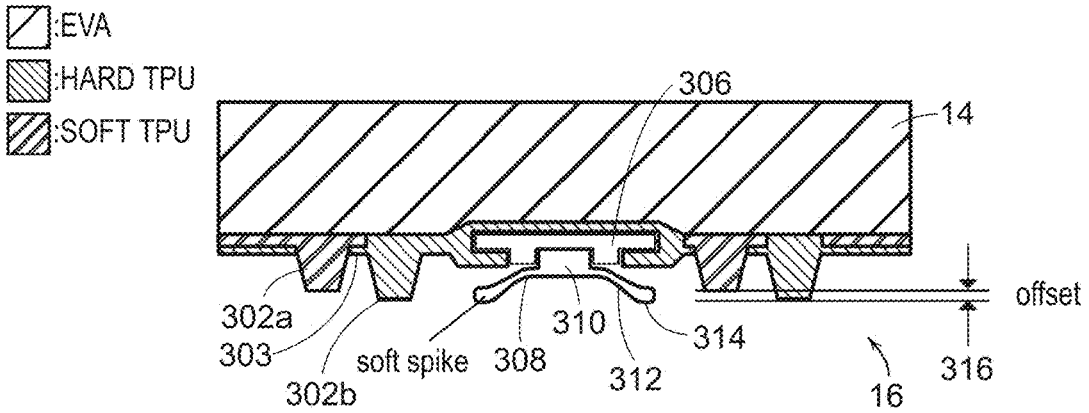
FIGS. 42A-42C are partial cross-sectional views through a spike receptacle and part of the outsole of FIGS. 39-41 showing a spike and multi-surface traction members both without a load and with a load.
Figure 42B:
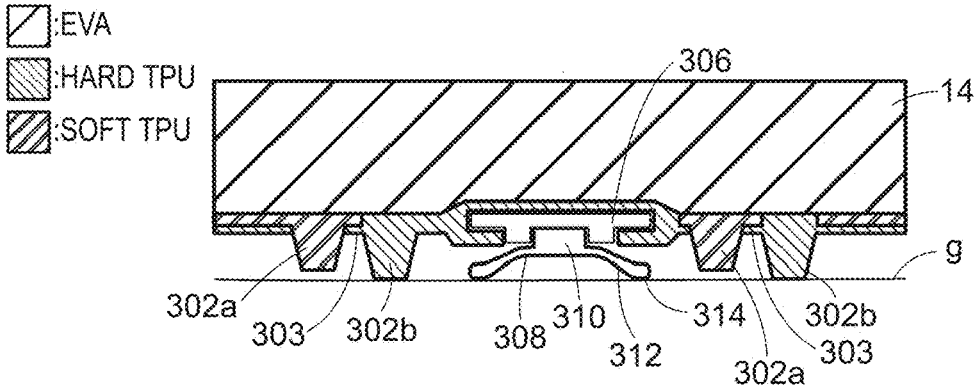
Figure 42C:
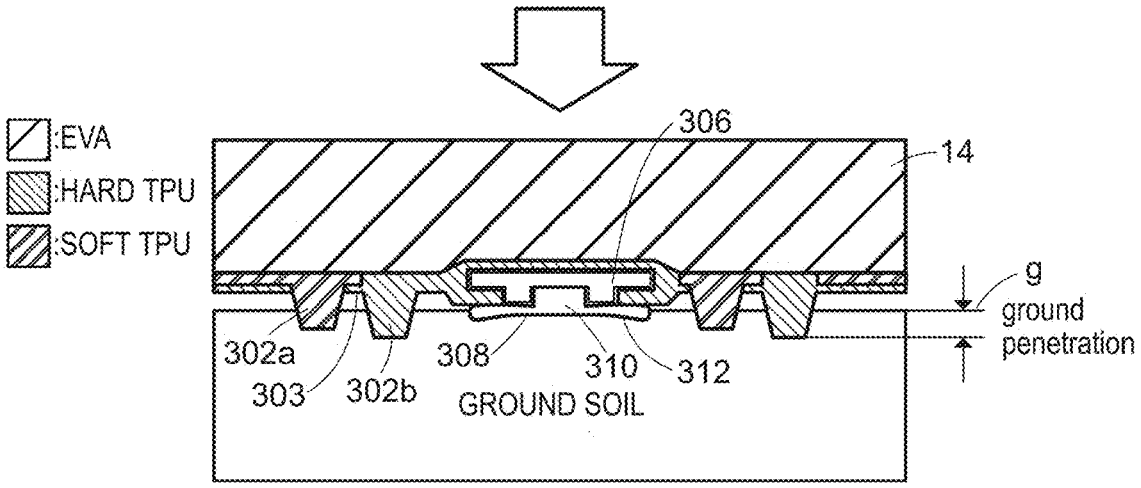

Now referring to FIGS. 42A-42C, the placement of the spikes (308) relative to the tile structure (154), specifically hard traction members (302*b*) and soft traction members (302*a*) and base segment (303) is shown. FIG. 42A shows the midsole (14) and outsole (16) with the tile structure (154) and spike (308) without any load placed on them by a golfer. As shown, the heights of the relatively hard traction members (302*b*) are greater than the heights of the relatively soft traction members (302*a*) by offset (316). For example, the heights of the relatively hard traction members (302*b*) can be in the range of about 2 mm to about 6 mm; and the heights of the relatively soft traction members (302*a*) can be in the range of about 1.75 mm to about 5.75 mm. Preferably, the offset (316) between traction member heights is in the range of about 0 mm to about 6 mm. More preferably, the offset (316) between the heights of the hard and soft traction members is about 0.25 mm to 1 mm. FIG. 42B shows the outsole (16) with the tile structure (154) and spike (308) relative to the ground (g) without any load or pressure placed on them. FIG. 42C shows the outsole (16) with the tile structure (154) and spike (308) relative to the ground (g) with a load placed on the outsole, such as when a golfer places their weight on the outsole (16). When a load is applied to the outsole (16) the spike (308) flexes and expands outwardly, allowing the radial arms (312) to move outwardly and upwardly. At the same time, the harder traction members (302*b*) penetrate the ground (g) further than the softer traction members (302*a*) or spikes (308). In this manner, the firm traction members (302*b*) contact the ground and penetrate the grass and soil more easily. Meanwhile, the relatively soft traction members (302*a*) contact the ground, compress more easily, and help provide some flexibility to the shoe. Thus, this outsole structure combining both tile structures (154) and spikes (308) is particularly effective for on-course use.

Spiked and Spikeless Outsoles with Multi-Surface Traction Members

As discussed above, there is a need to provide outsole structures that can achieve high traction on firm and particularly hard, wet, and smooth surfaces such as boat decks, polished concrete and marble flooring, painted surfaces of sidewalks, and the like. These surfaces can be referred to as "off-course" surfaces. At the same time, there is need for outsole structures that provide high traction on various natural turf surfaces, particularly golf courses. These shoes can be referred to as "on-course" surfaces. The present invention provides such multi-surface traction (MST) outsole structures.

Turning now to FIGS. 43-48, the outsole (16) generally includes a forefoot region (80) for supporting the forefoot area; a mid-foot region (82) for supporting the mid-foot including the arch area; and a rear-foot region (84) for supporting the rear-foot including heel area. In general, the forefoot region (80) includes portions of the outsole corresponding with the toes and the joints connecting the metatarsals with the phalanges. The mid-foot region (82) generally includes portions of the outsole corresponding with the arch area of the foot. The rear-foot region (84) generally includes portions of the outsole corresponding with rear portions of the foot, including the calcaneus. The outsole also includes a lateral side (86) and a medial side (88). Lateral side (86) and medial side (88) extend through each of the foot regions (80, 82, and 84) and correspond with opposite sides of the outsole. The lateral side or edge (86) of the outsole is the side that corresponds with the outer area of the foot of the wearer. The lateral edge (86) is the side of the foot of the wearer that is generally farthest from the other foot of the wearer (that is, it is the side closer to the fifth toe [little toe].) The medial side or edge (88) of the outsole is the side that corresponds with the inside area of the foot of the wearer. The medial edge (88) is the side of the foot of the wearer that is generally closest to the other foot of the wearer (that is, the side closer to the hallux [big toe].) The outsole (16) can be spiked or spikeless.

The outsole (16) can have different traction members to optimize the outsole for on-course and/or off-course wear. For example, different traction members can be used depending upon whether the shoe is primarily intended for firm or soft surfaces. For example, one set of traction members is described above and illustrated in FIGS. 1 and 8-11A. While in FIGS. 17A and 17B, another set of traction members is illustrated. Referring to FIGS. 24, 28-30, and 33A-33D as described above, in yet another example of a spikeless outsole, there is a tile piece or tile structure (154) located on the outsole (16) and the piece comprises a first protruding traction member (162*b*); an opposing second protruding traction member (162*a*); and a non-protruding, base segment (window) (163) disposed between the first and second traction members (162*b*, 162*a*).

However, in all of these outsole constructions, the outsoles generally have a tread pattern as described above, particularly: a) a forefoot region containing first, second (middle), and third zone of tiles with traction members; b) a mid-foot region containing a zone of tiles with traction members; and c) a rear-foot region containing first, second (middle), and third zone of tiles with traction members. That is, the type of traction members in the outsoles is different; however, the geometric configuration of traction members is similar to the non-channeled pattern described above. This pattern helps provide a shoe with a high traction per volume of traction members and minimal turf-trenching properties for the amount of traction provided.

Spikeless Outsoles

Figure 43:
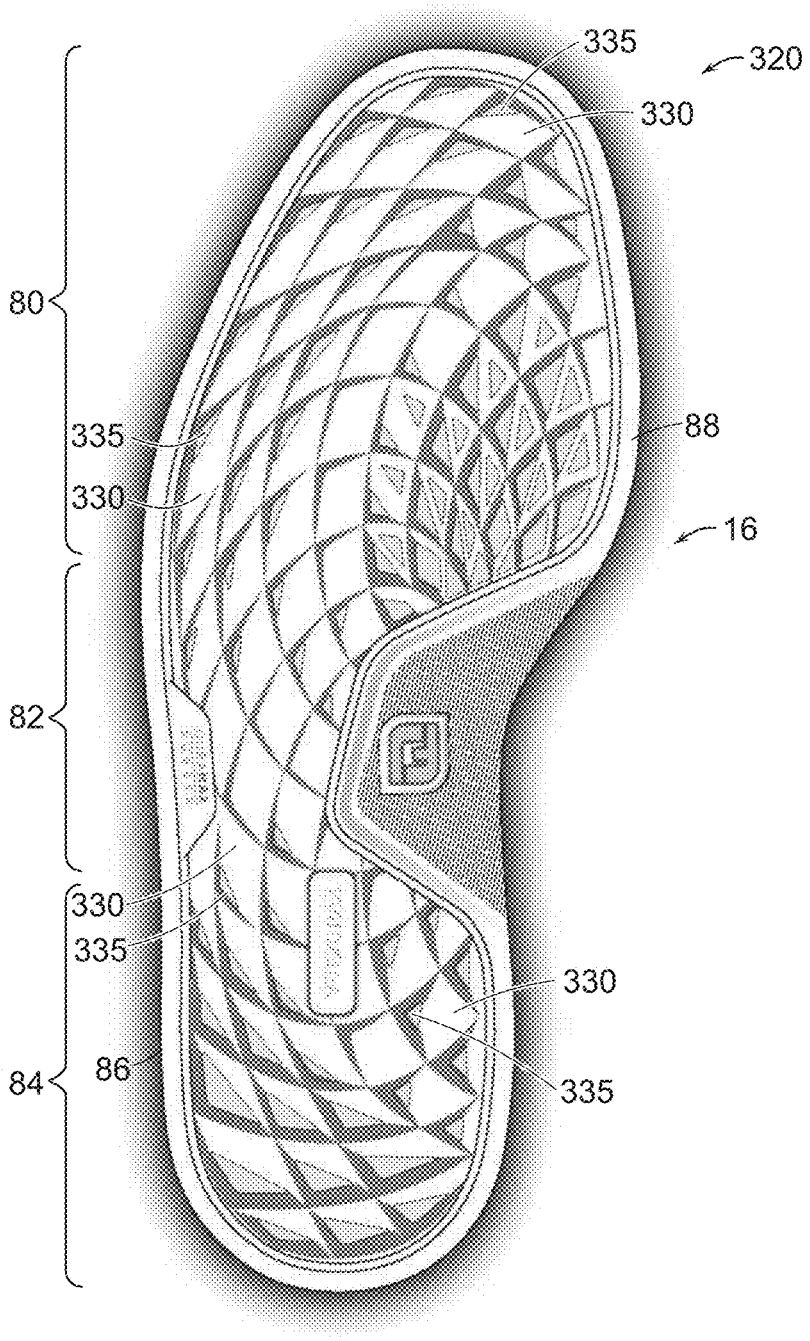
FIG. 43 is a bottom plan view of one embodiment of a golf shoe of the present invention showing different traction members in the outsole.

In FIG. 43, the spikeless outsole (320) does not contain any spikes; rather, there are only traction members as generally indicated at (335). These traction members (335) are described in further detail below. The outsole (16) generally includes: a) a forefoot region containing first, second (middle), and third zone of tiles with traction members; b) a mid-foot region containing a zone of tiles with traction members; and c) a rear-foot region containing first, second (middle), and third zone of tiles with traction members. As described above, the traction members (335) are arranged in an eccentric configuration and each adjacent traction member (335) is positioned at a different radius from a given center of rotation. This results in improved traction for the shoe on all surfaces—there is no channeling and little or no trenching of grass turf for the amount of traction provided. This geometric configuration of traction members helps provide a shoe with high traction per volume of traction members and minimal turf-trenching properties for the amount of traction provided.

In FIGS. 43-48, the outsole (16) comprises different zones of tiles or tile pieces (330). Each zone contains different traction members for gripping both golf course and off-golf course surfaces. The tile piece (330) for the traction members (335) has a similar structure as the tile structure shown in above FIGS. 29-30, except there is no window (163) located between the first and second traction members (334, 336). Rather, in the tile piece (330) of FIGS. 43-48, there is a non-protruding, base segment (333) disposed between first and second traction members (334, 336).

Figure 44:
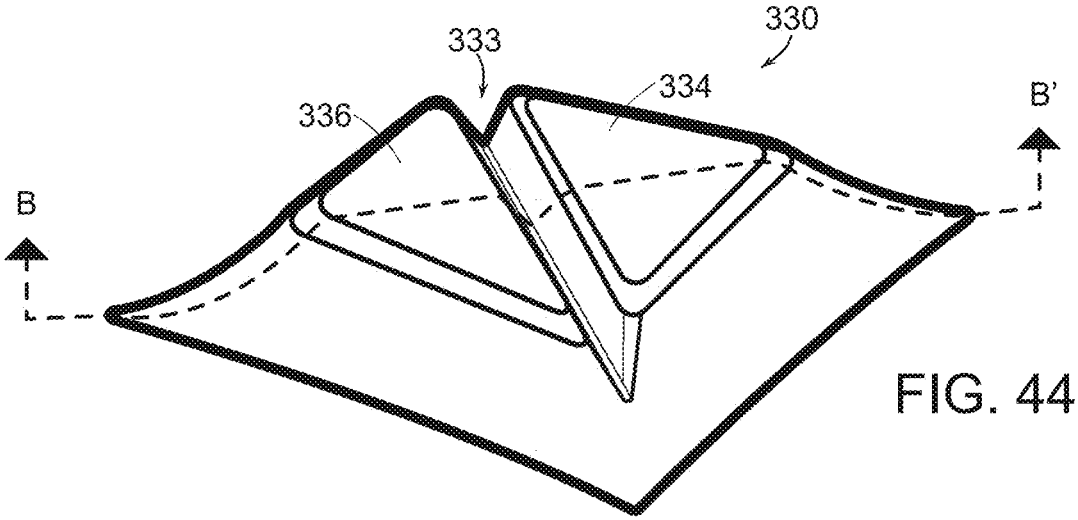
FIG. 44 is a perspective view of one embodiment of a tile piece and traction members of the present invention.
Figure 44B:
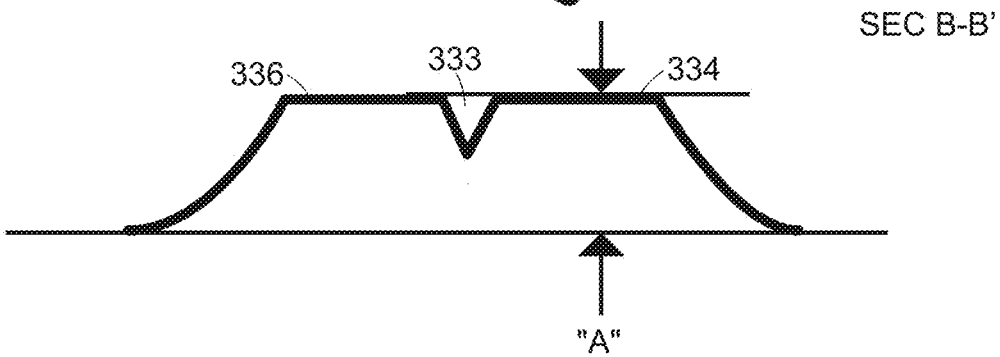
FIG. 44B is a cross-sectional view of the tile piece shown in FIG. 44 along Line B-B'.
Figure 45:
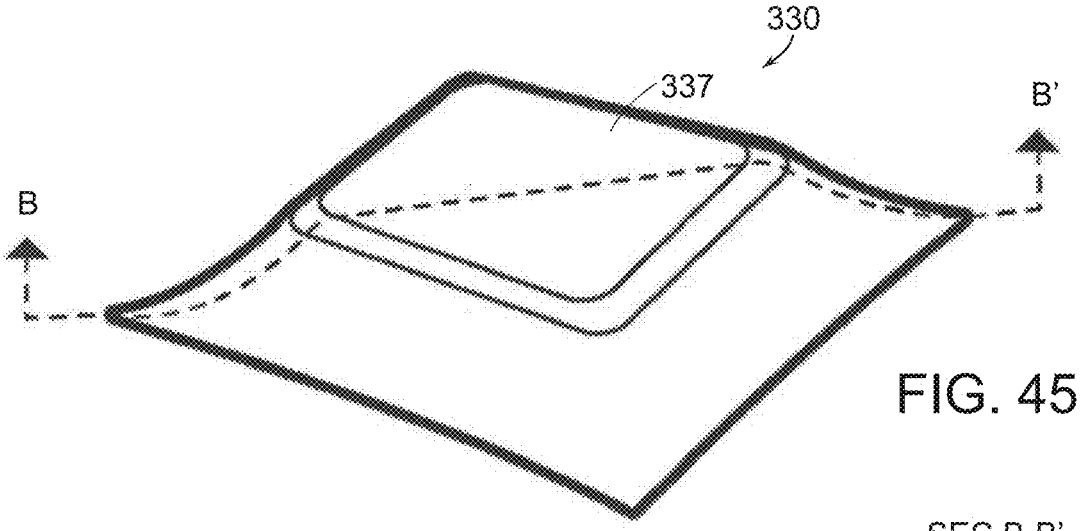
FIG. 45 is a perspective view of one embodiment of a tile piece and traction member of the present invention.
Figure 45B:
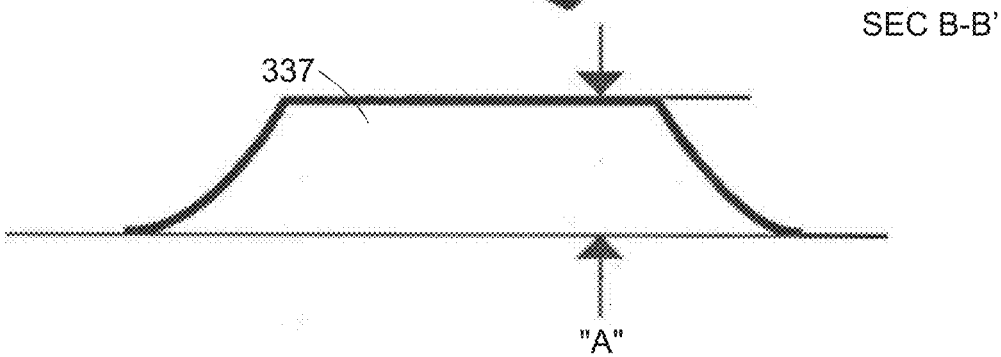
FIG. 45B is a cross-sectional view of the tile piece shown in FIG. 45 along Line B-B'.
Figure 46:
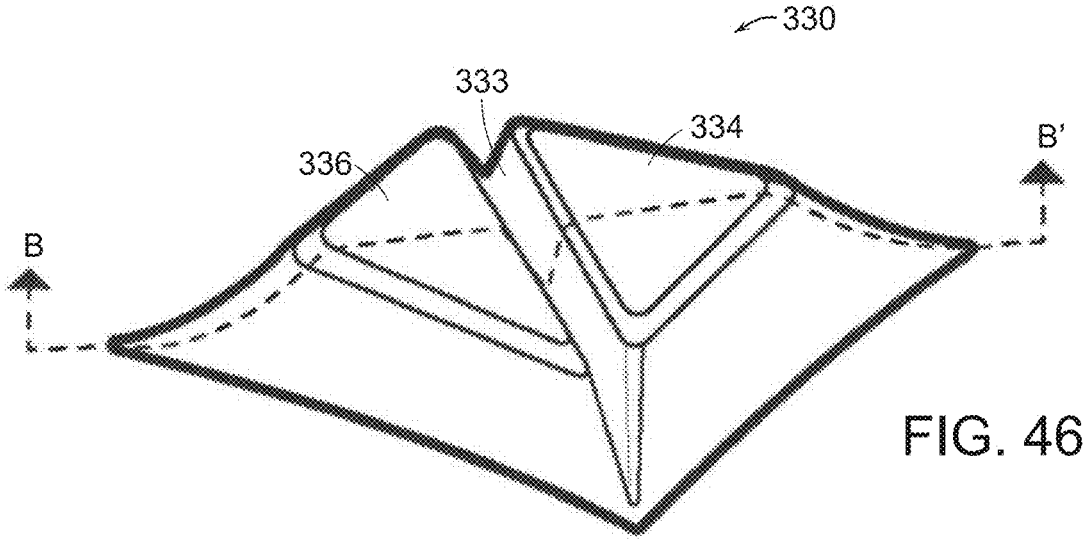
FIG. 46 is a perspective view one embodiment of a tile piece and traction members of the present invention.
Figure 46B:
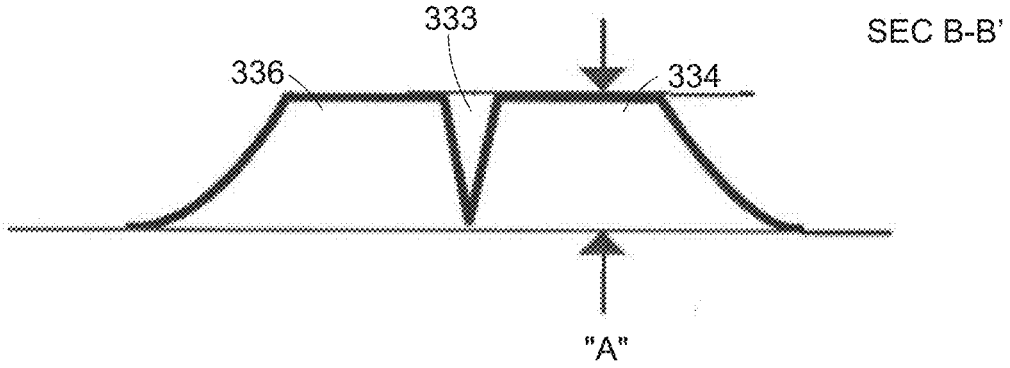
FIG. 46B is a cross-sectional view of the tile piece shown in FIG. 46 along Line B-B'.
Figure 47:
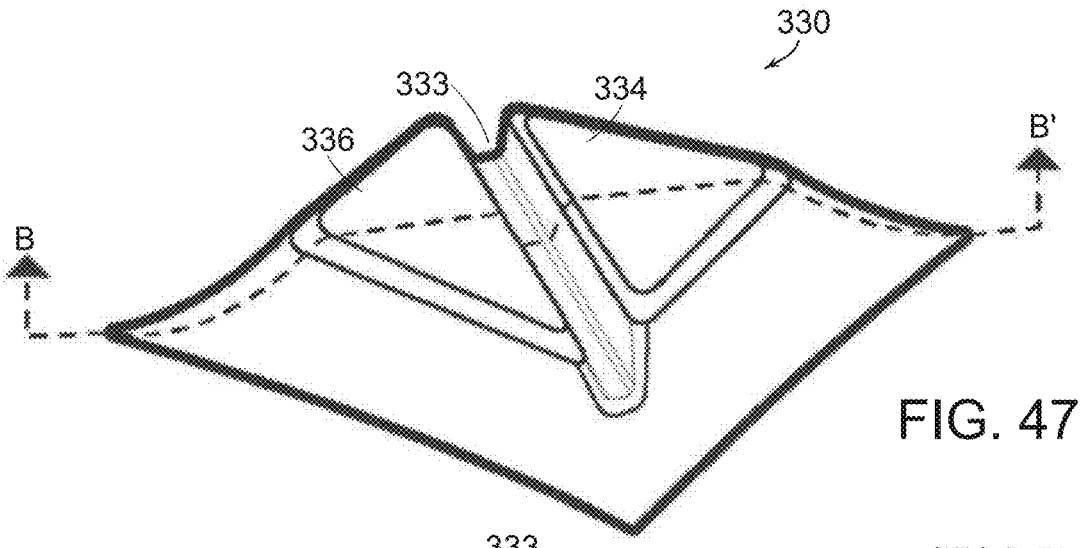
FIG. 47 is a perspective view one embodiment of a tile piece and traction members of the present invention.
Figure 47B:
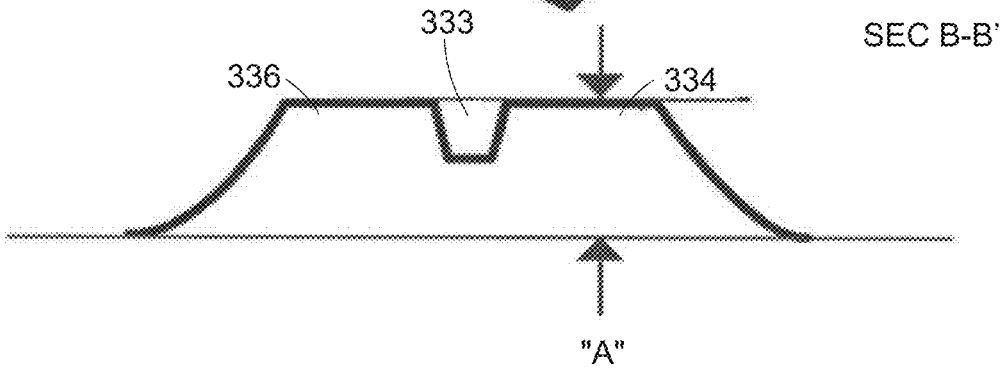
FIG. 47B is a cross-sectional view of the tile piece shown in FIG. 47 along Line B-B'.

As discussed above, in FIGS. 29-30, the midsole (14), which can be made of a relatively soft material such as ethylene vinyl acetate copolymer (EVA), is shown through the window (163). The exposed midsole areas form the windows (163) between the traction elements. However, in the embodiments shown in FIGS. 43-48, there is no window and the EVA or other midsole material is not visible. Rather, the tile piece (330) is a unitary, integral structure with protruding first and second traction members (334, 336) and a base segment (333) that covers the midsole (14) so that it is not visible. The spikeless outsole structure or spikeless outsole (320) having the tile pieces (330) extends over the midsole and there is no EVA or other midsole material showing through a window. The base segment (333) can have a V-shaped notch cross-section as shown in FIGS. 44 and 44B and FIGS. 46 and 46B, or a U-shaped notch cross-section as shown in FIGS. 47-47B or any other suitable shape. The V-shaped and U-shaped notches provide a flex point between the two traction members (334, 336). In FIGS. 44-44B and 46-46B and FIGS. 47-47B, the base segment (333) is flat and has a channel or grooved area with a V-shaped and U-shaped cross-section. The base segment (333) can have any suitable shape such as, for example, rectangular, triangular, square, diamond, rod-like shapes, and the like. Referring to FIGS. 45 and 45B, in an alternative embodiment, the tile piece (330) is a unitary, integral piece with a single protruding traction member (337).

The unitary tile pieces (330) and traction members (334, 336, 337) can be made of any suitable material such as rubber or plastics and combinations thereof. Thermoplastics such as nylons, polyesters, polyolefins, and polyurethanes can be used. Suitable rubber materials that can be used include, but are not limited to, polybutadiene, polyisoprene, ethylene-propylene rubber ("EPR"), ethylene-propylene-diene ("EPDM") rubber, and styrene-butadiene rubber. Preferably, the unitary tile piece (330) and protruding traction members (334, 336, 337) are made of a rubber material which provides good gripping power. With rubber, the gripping power for a particular surface is maximized and less damage is done to that surface for the amount of traction provided. The above-described traction members (334, 336, 337) are particularly effective in providing maximum contact with the ground to help prevent a person from slipping and losing their balance when walking or swinging a golf club. These traction members (334, 336, 337) also have high turf-grabbing strength and help to provide stability and support. These traction members (334, 336, 337) provide high gripping action for the shoe for off-course surfaces such as, for example, golf clubhouses, sidewalks, streets, office, and homes. The traction members (334, 336, 337) can have various sizes and shapes as discussed further below.

For example, the first traction members (334) can be made from a relatively hard composition; and the second traction members (336) can be made from a relatively soft composition. By varying the hardness of the different traction members (334, 336), each traction member can be tuned so that it responds differently upon contacting a ground surface. The traction members (334) are configured so they deform differently when pressed against a ground surface. For example, one traction member may have a relatively low hardness that is optimal for maximizing traction with a hard, wet surface; and a second traction member may have a relatively high hardness making it optimal for maximizing traction with soft natural grass.

The traction members (334, 336) also can have various dimensions. For example, as shown in FIGS. 44-47B, the lengths (heights) of the first traction members (334) and lengths (heights) of the second traction members (336) are substantially the same. For example, the heights of the traction members (334, 336) can be in the range of about 1 mm to about 6 mm. As discussed above, the base segment (333) can have a V-shaped notch cross-section. In FIGS. 44-44B, the depth of the channel of the base segment (333) is about 1.5 mm to about 2.5 mm; while in FIGS. 46-46B, the depth of the channel of the base segment (333) is about 5.0 to about 5.5 mm. In FIGS. 47 and 47B, the base segment (333) is shown having a U-shaped cross-section, wherein the depth of the channel of the base segment (333) is about 2 mm to about 3 mm. In general, the depth of the channel of the base segment (333) is in the range of about 0.5 mm to about 5.5 mm.

In a second embodiment, the heights of the first traction members (334) and heights of the second traction members (336) are different. By varying the length (height) of the different traction members (334, 336), each traction member may be tuned so that it penetrates to a different depth when making contact with the ground surface. For example, in one embodiment, the first traction members (334) may have a relatively greater height that is optimized for penetrating the ground surface deeply. Meanwhile, the second traction members (336) may have a relatively lesser height that is optimized for riding on the surface or penetrating the ground to a shallow extent.

In one preferred embodiment, as shown in FIGS. 44-44B and 46-46B and FIGS. 47-47B, the first traction members (334) have three sidewalls with sloping surfaces and a triangular-shaped, flat top surface that forms a ground contacting surface. The second traction members (336) also have three sidewalls with sloping surfaces and a triangular-shaped, flat top surface. In alternative embodiments, the triangular-shaped top surface can have a recessed area. As discussed above, the traction tile piece (330) further includes a base segment (333) disposed between the first and second traction members (334, 336). The total ground contact surface area is preferably in the range of about 5 to about 80% based on total surface area of the traction tile piece (330). That is, the first and second traction members (334, 336) contact the ground surface such that the total ground contact surface area is preferably in the range of about 5 to about 100% based on total surface area of the tile. The base segment (333) of the traction tile piece (330), which is located between the first and second traction members, can generally constitute about 1% to about 70% of the tile. In FIGS. 45-45B, the single protruding traction member (337)

also has three sidewalls with sloping surfaces and a triangular-shaped, flat top surface that forms a ground contacting surface. In alternative embodiments, the triangular-shaped top surface of traction member (337) can have a recessed area. In the example shown in FIGS. 45-45B, the single protruding traction member (337) has a total ground contact surface area of 100% based on total surface area of the tile.

The above-described shaped traction members (FIGS. 44-44B, 45-45B, 46-46B and FIGS. 47-47B) can be used in different combinations with each other to provide optimal traction depending upon the surface. That is, the traction members can be selected from the group consisting of traction members having the structures shown in FIGS. 44-44B, 45-45B, 46-46B and FIGS. 47-47B, and combinations thereof. Furthermore, these traction members (FIGS. 44-44B, 45-45B, 46-46B and FIGS. 47-47B) can be used in combinations with differently-shaped traction members as described in further detail below.

Referring back to FIG. 8, the forefoot region (80) of the outsole includes a first (lateral) zone of tiles (96) containing protruding traction members (98) extending along the periphery of the forefoot region; a third (medial) zone of tiles (100) containing protruding traction members (102) extending along the opposing periphery of the forefoot region; and a second (middle) zone of tiles (104) containing protruding traction members (106) disposed between the first and third zones.

Figure 48:
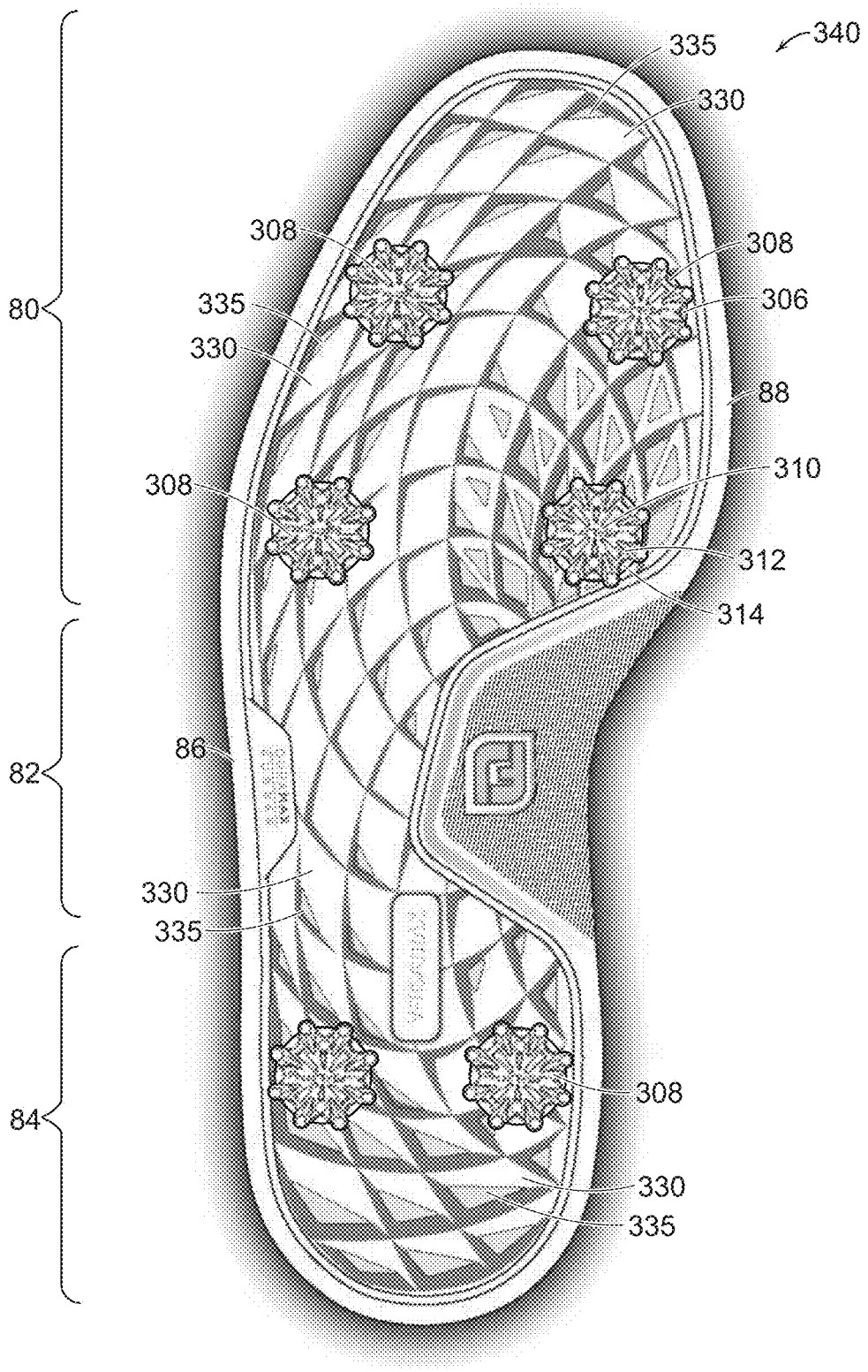
FIG. 48 is a bottom plan view of one embodiment of a golf shoe of the present invention showing different traction members and spikes in the outsole.

As shown in FIGS. 43 and 48, the traction members (335) preferably have the same geometric configuration as shown in FIG. 8, wherein the traction members (335) are arranged in an eccentric configuration and each adjacent traction member is positioned at a different radius from a given center of rotation. In particular, the traction members (334, 336, and 337) are preferably located in the third (medial) zone of the forefoot region (80). The remaining traction members (335) in other regions of the outsoles as shown in FIGS. 43 and 48 can have different structures. For example, these traction members (335) can have the traction structures as shown in FIGS. 9, 9A, 10, 10A, 11, and 11A described above. In particular, for example, the traction members can have a three-sided pyramid-like shape with three sloping surfaces extending from a pyramid-like base and having an apex. Thus, in one preferred embodiment, the traction members (334, 336, and 337) are placed in the third medial zone of the forefoot region and traction members having different shapes are placed in other zones of the outsole. In this example, the shaped traction members described above (334, 336, 337) are combined with other shaped traction members (335) to form the complete traction profile of the outsole. In this example, the outsole (16) comprises a combination of the above-described shaped traction members (334, 336, 337) with other shaped traction members.

These traction members (335) can have different shapes to provide optimal traction given the number of traction members. That is, the outsoles can contain a wide variety of traction members so that the gripping power for a particular surface is maximized and less damage is done to that surface for the amount of traction provided. The traction members can have many different shapes including for example, but not limited to, annular, rectangular, triangular, square, spherical, elliptical, star, diamond, pyramid, arrow, conical, blade-like, and rod shapes. Also, the height and area of the traction members and volume of traction member per given tile on the outsole can be adjusted as needed.

In other embodiments, the traction members (334, 336, and 337) are located in zones or regions in addition to or other than the (medial) zone of the forefoot region (80). That is, the traction members (334, 336, and 337) can be located in any zone of the outsole, particularly the forefoot, midfoot, and/or rear-foot regions. Also, the other traction members (335) disposed on the outsole can have different shapes to provide optimal traction given the number of traction members. That is, the outsoles can contain a wide variety of traction members so that the gripping power for a particular surface is maximized and less damage is done to that surface for the amount of traction provided. The traction members can have different shapes including for example, but not limited to, annular, rectangular, triangular, square, spherical, elliptical, star, diamond, pyramid, arrow, conical, blade-like, and rod shapes. Also, the height and area of the traction members and volume of traction member per given tile can be adjusted as needed.

Spiked Outsoles

In an alternative embodiment, "spiked" or "cleated" outsoles (340) are made. As illustrated in FIG. 48, the outsole (340) contains both spike receptacles (306) for spikes (308) as well as traction members generally indicated at (335). This type of outsole, wherein there are both protruding spikes (308) and traction members (335) is considered a spiked outsole (340).

Most golf courses require that golfers use non-metal spikes on their shoes. The bottom surface (27) of the outsole (340) contains molded receptacles (sockets) (306) for securing the spikes (308) to the shoe. Plastic spikes (308) are commonly used and they typically have a rounded base (310) with a central stud on one face. On the other face of the rounded base (310), there are radial arms (312) with traction projections (314). Screw threads are spaced about the stud on the spike (308) for inserting into the threaded receptacle (306). These plastic spikes (308), which can be easily fastened and later removed from the locking receptacle (306), tend to cause less damage to the greens and clubhouse flooring surfaces than metal spikes.

The spikes (308) are preferably detachably fastened to receptacles (306) in the outsole (16). The spike (308) may be inserted and removed easily from the receptacle (306). Normally, the spike (308) may be secured in the receptacle (306) by inserting it and then slightly twisting it in a clockwise direction. To remove the spike (308) from the receptacle (306), it may be slightly twisted in a counterclockwise direction.

Concerning the traction members (335) that extend between the spikes (308) on the spiked outsole (340), these traction members preferably have the same structure as the traction members found on the spikeless outsole (320) as described above. In particular, the traction members (335) can have the structures as shown in FIGS. 44-44B to 47-47B. The bottom surface of the spiked outsole (340) and the traction members (335) can be made of any suitable material such as rubber or plastics and combinations thereof. The spikes (308) are preferably made of a plastic material. Thermoplastics such as nylons, polyesters, polyolefins, and polyurethanes can be used. Suitable rubber materials that can be used include, but are not limited to, polybutadiene, polyisoprene, ethylene-propylene rubber ("EPR"), ethylene-propylene-diene ("EPDM") rubber, and styrene-butadiene rubber. Preferably, the tile piece (330) and protruding traction members (334, 336) are made of a rubber material which provides good gripping power.

In FIG. 48, one example of a spiked outsole (340) that can be made in accordance with this invention is shown. This outsole (340) example contains a total of six (6) spikes as indicated at (308) locked in spike receptacles (306); there are four spikes in the forefoot region (80) and two spikes in the rear-foot region (84). The spiked outsole (340) shown in FIG. 48 is only one embodiment, and it should be understood that the present invention is not limited to this outsole example. The outsole (16) can contain any number of spikes (308), and the spikes can be arranged in a wide variety of patterns. For example, referring back to FIGS. 37-42C, the outsole can contain a total of nine (9) spikes locked in spike receptacles; wherein there are five spikes in the forefoot region (80) and four spikes in the rear-foot foot region (84). Preferably, the spiked outsole (340) contains at least three spikes (308) locked in spike receptacles. More preferably, the spiked outsole (340) contains a total number of spikes (308) in the range of five (5) to nine (9) spikes. These spike receptacles (306) and spikes (308) can be arranged in various patterns on the forefoot, mid-foot, and/or rearfoot regions.

Outsoles with Multi-Surface Traction Members Using Different Zones or Materials

As discussed above, there is a need to provide outsole structures that can achieve high traction on firm and particularly hard, wet, and smooth surfaces such as boat decks, polished concrete and marble flooring, painted surfaces of sidewalks, and the like. These surfaces can be referred to as "off-course" surfaces. At the same time, there is need for outsole structures that provide high traction on various natural turf surfaces, particularly golf courses. These surfaces can be referred to as "on-course" surfaces. The present invention provides such multi-surface traction (MST) outsole structures.

Figure 49:
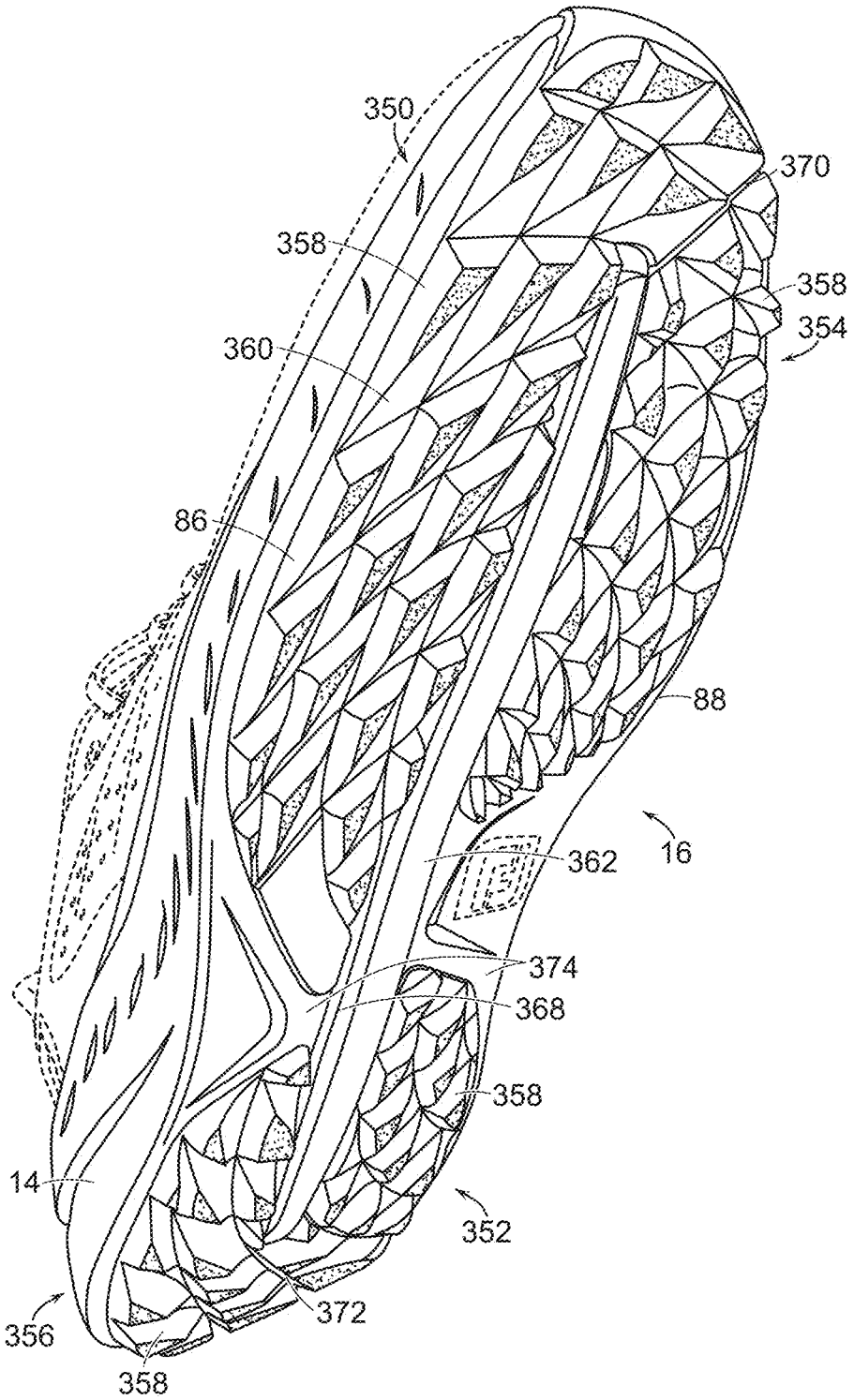
FIG. 49 is a perspective view of one embodiment of a golf shoe of the present invention showing the outsole in detail.
Figure 50A:
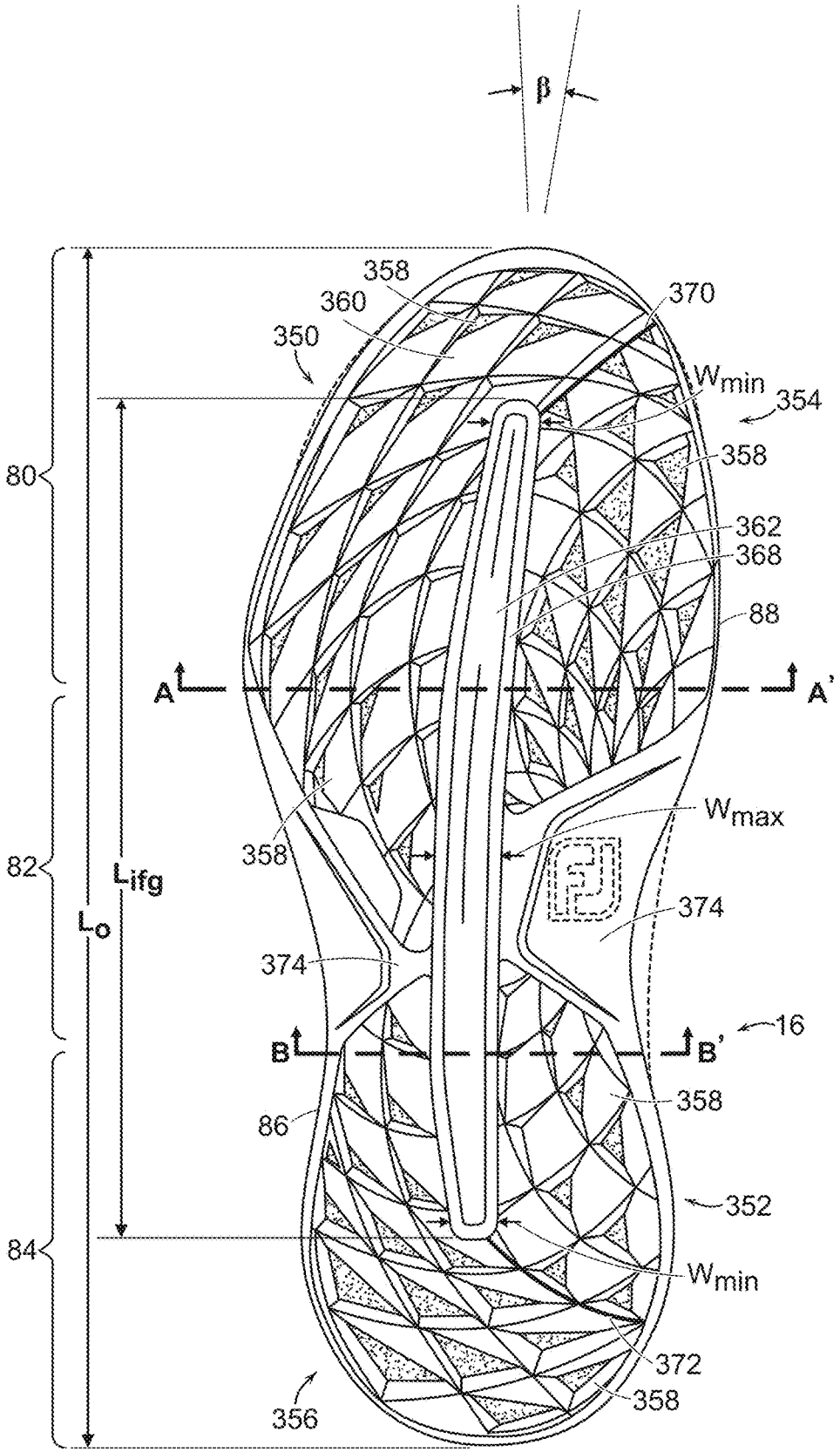
FIGS. 50A-B are a bottom plan views of the embodiment of the outsole of FIG. 49 of the present invention, with FIG. 50B showing the zones of tiles.
Figure 50B:
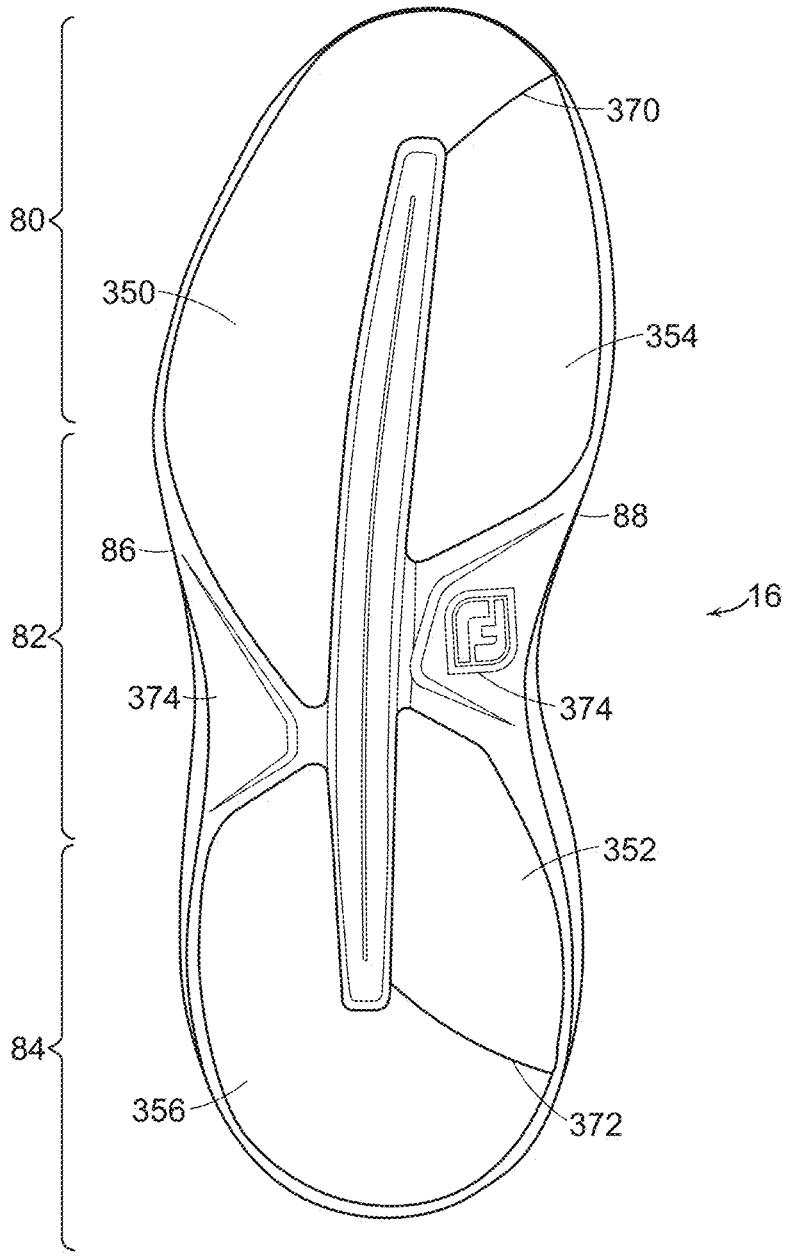

Turning now to FIGS. 49-50B, the outsole (16) generally includes a forefoot region (80) for supporting the forefoot area; a mid-foot region (82) for supporting the mid-foot including the arch area; and a rear-foot region (84) for supporting the rear-foot including heel area. In general, the forefoot region (80) includes portions of the outsole corresponding with the toes and the joints connecting the metatarsals with the phalanges. The mid-foot region (82) generally includes portions of the outsole corresponding with the arch area of the foot. The rear-foot region (84) generally includes portions of the outsole corresponding with rear portions of the foot, including the calcaneus. The outsole also includes a lateral side (86) and a medial side (88). Lateral side (86) and medial side (88) extend through each of the foot regions (80, 82, and 84) and correspond with opposite sides of the outsole. The lateral side or edge (86) of the outsole is the side that corresponds with the outer area of the foot of the wearer. The lateral edge (86) is the side of the foot of the wearer that is generally farthest from the other foot of the wearer. That is, it is the side closer to the fifth toe or little toe. The medial side or edge (88) of the outsole is the side that corresponds with the inside area of the foot of the wearer. The medial edge (88) is the side of the foot of the wearer that is generally closest to the other foot of the wearer. That is, it is the side closer to the hallux or big toe. The outsole (16) can be spiked or spikeless as discussed further below.

As discussed above, the outsole (16) can have different traction members to optimize the outsole for on-course and/or off-course wear. For example, different traction members can be used depending upon whether the shoe is primarily intended for firm or soft surfaces. For example, one set of traction members is described above and illustrated in FIGS. 1 and 8-11A, while in FIGS. 17A and 17B, another set of traction members is illustrated. Referring to FIGS. 24, 28-30, 33A-33D and 43-48 as described above, in yet another example of a spikeless outsole, there is a tile piece or tile structure (154) located on the outsole (16) and the piece comprises a first protruding traction member (162*b*); an opposing second protruding traction member (162*a*); and a non-protruding, base segment (window) (163) disposed between the first and second traction members (162*b*, 162*a*). As described above, the traction members are arranged in an eccentric configuration and each adjacent traction member is positioned at a different radius from a given center of rotation. This results in improved traction for the shoe on all surfaces—there is no channeling and little or no trenching of grass turf for the amount of traction provided. This geometric configuration of traction members helps provide a shoe with high traction per volume of traction members and minimal turf-trenching properties for the amount of traction provided.

In FIGS. 49-50B, the outsole (16) comprises four different zones of tiles (350, 352, 354, 356). Each zone contains traction members (358) for gripping both on-course and off-course surfaces. It will be appreciated that although four zones are shown, two or more zones may be provided in the outsole (16). The tile piece (360) for the traction members (358) has a similar structure as the tile structure shown in above FIGS. 8-11A. As shown in FIGS. 49-50B, the unitary tile pieces (360) are located in four zones (350, 352, 354, 356). A first zone (350) is located extending from the toe through the lateral side (86) forefoot region (80) and into the mid-foot region (82), a second zone (352) is provided extending from the medial side (88) mid-foot region (82) to the medial side (88) rear-foot region (84). These two zones (350, 352) preferably have similar hardness values. They may, for example, be made of the same material, preferably a harder, stiffer rubber for on-course use. A third zone (354) is provided extending from the medial side (88) fore-foot region (80) extending to the mid-foot region (82). A fourth zone (356) is provided extending from the lateral side (86) rear-foot region (84) through the heel. Preferably, the third and fourth zones (354, 356) have similar hardness values. They may, for example, be made of the same material, preferably a softer, grippier rubber for off-course use. It will be appreciated that each zone (350, 352, 354, 356) could be made of a different material that falls within the hardness range for the on-course or off-course designation for that zone. Additionally, each zone (350 352, 354, 356) may be constructed of a single piece of material, or multiple pieces of material, for example each tile could be constructed from a separate piece of material. Furthermore, it will be appreciated that the zones may have a color designating whether they are a harder, stiffer material or a softer, grippier material, or to signify that each is comprised of a different material.

As discussed above with regard to FIGS. 29-30, the midsole (14) can be made of a relatively soft material such as ethylene vinyl acetate copolymer (EVA). As shown in FIGS. 49-50B the midsole (14) comprises the longitudinal flex groove (362) separating at least part of the lateral side (86) and medial side (88) of the outsole (16). It will be appreciated that the midsole (14) may be made of two or more materials with different densities. The exposed portions of the forefoot, mid-foot and rear-foot regions (80, 82, 84) of the midsole (14) form the longitudinal flex groove (362) between the lateral side (86) zones of tiles (350, 352) and the medial side (88) zones of tiles (354, 356). In the embodiments shown in FIGS. 49-50B, there is no window (163) in the tile piece (360) and the EVA or other midsole material is not visible within the tile piece. Rather, the tile piece (360) is a unitary, integral structure with a single traction member (358). The spikeless outsole structure having the tile pieces (360) extends over the midsole (14) and the EVA or other midsole material shows through as the longitudinal flex groove (362) and the mid-foot region (82).

Figure 51A:
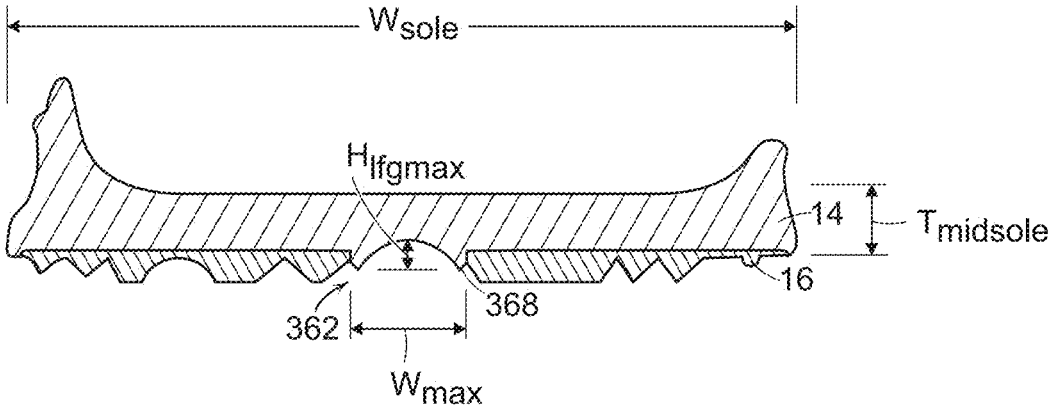
FIGS. 51A-B are a cross-sectional views of the longitudinal flex groove shown in FIG. 50A along line A-A' and B-B'.
Figure 51B:
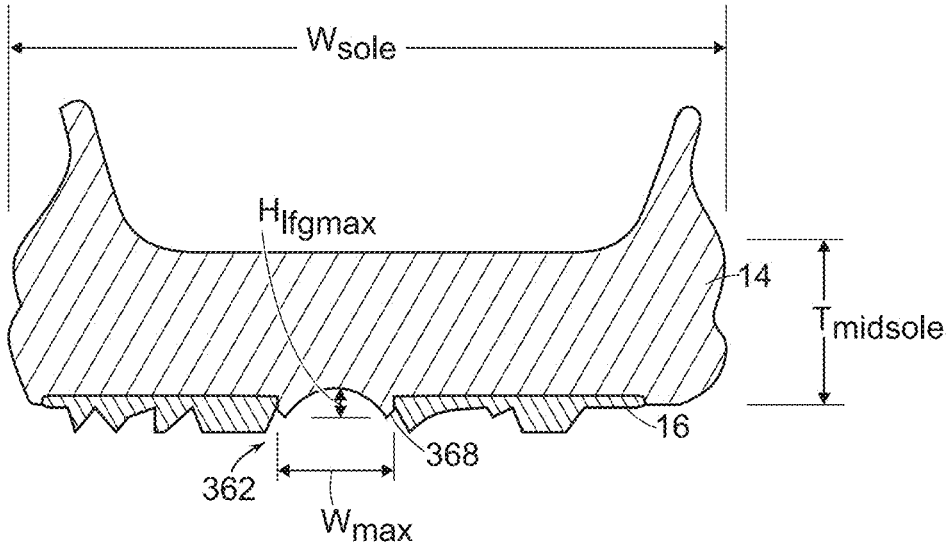
Figure 52A:
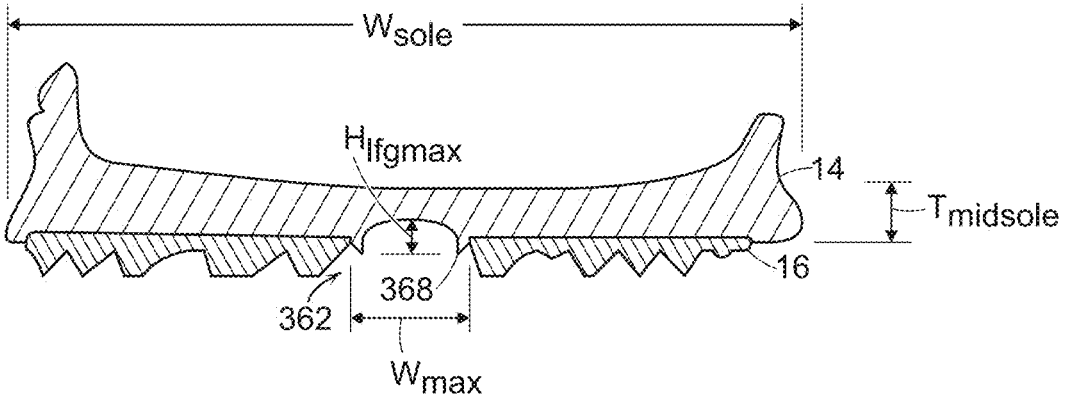
FIGS. 52A-52E are alternative cross-sectional views of the longitudinal flex groove as shown in FIG. 51A.
Figure 52B:
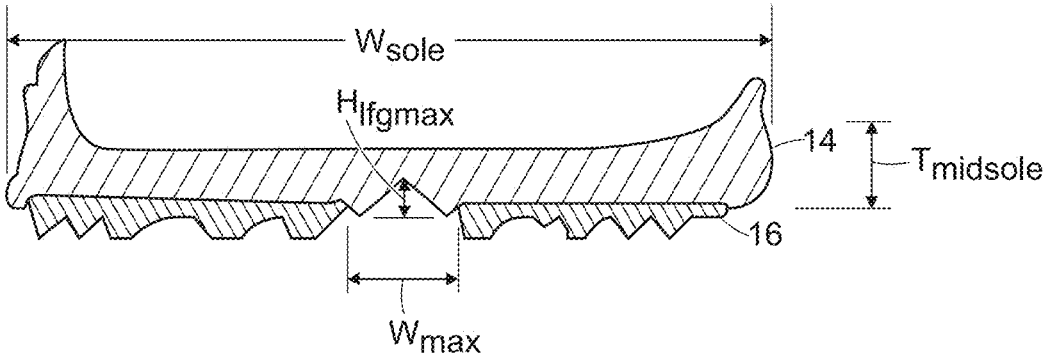
Figure 52C:
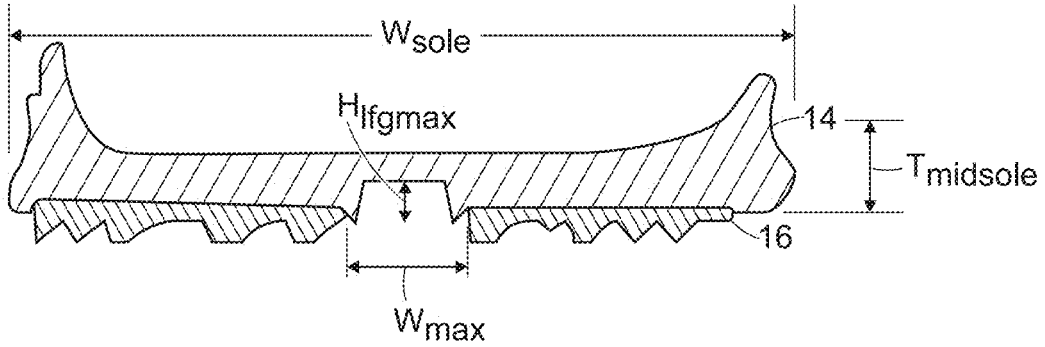
Figure 52D:
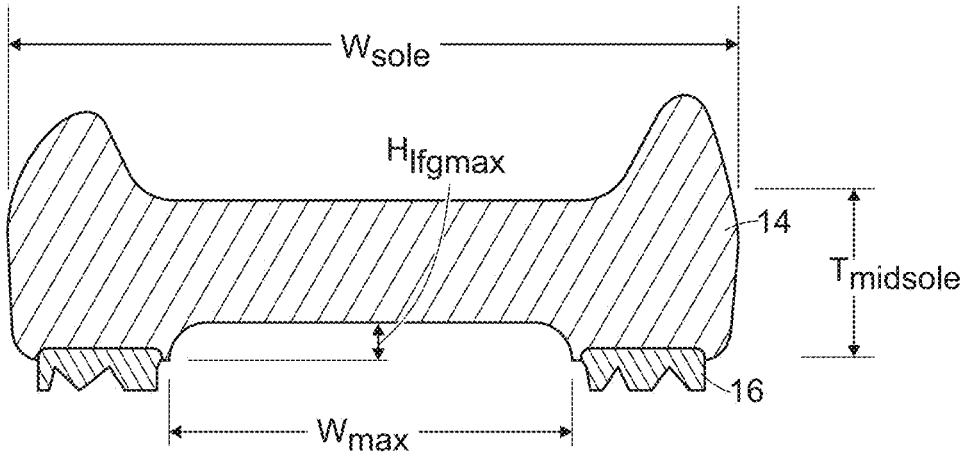
Figure 52E:
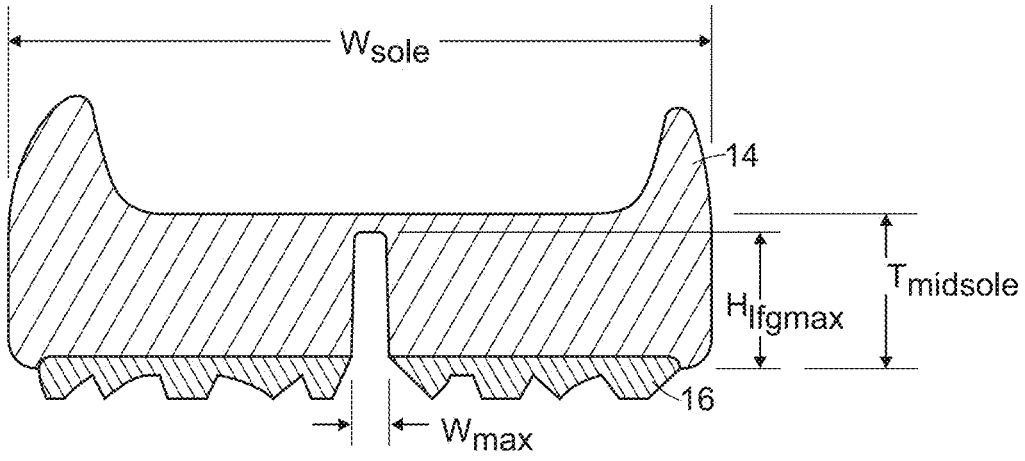

Preferably the longitudinal flex groove (362) has a length $L_{lfg}$ of about 35% to 95% of the length of the outsole $L_o$, and more preferably about 60 to 80% of the length of the outsole $L_o$. The longitudinal flex groove (362) has a maximum width $w_{max}$ and a minimum width $w_{min}$. As shown, the minimum width $w_{min}$ is at the ends (364, 366) of the longitudinal flex groove (362), while the maximum width $w_{max}$ is in the central mid-foot region (82) of the longitudinal flex groove (362). It will be appreciated that the longitudinal flex groove (362) may have a substantially constant width along its length, or alternatively, the longitudinal flex groove (362) may have a maximum width $w_{max}$ at one or more ends with a minimum width $w_{min}$ in the central mid-foot region (82) of the longitudinal flex groove (362). Alternatively, the longitudinal flex groove (362) may have either an increase or decrease in width from the rear-foot region (84) to the forefoot region (80) of the outsole (16). Preferably, as shown in FIGS. 51A-51B the maximum width $w_{max}$ is at least 2 mm and more preferably between about 15% to 30% of the overall sole width $w_{sole}$. Preferably the longitudinal flex groove (362) does not protrude from the outsole (16) toward the ground surface. As shown in FIGS. 51A-51B, preferably the longitudinal flex groove (362) has a maximum height $H_{lfgmax}$ of about 15% to 45% of the midsole (14) thickness $T_{midsole}$. The height $H_{flgmax}$ may be at least about one-quarter the maximum width $w_{max}$ of the longitudinal flex groove (362). The maximum height $H_{lfgmax}$ is at least 2 mm and up to about 90% of the thickness $T_{midsole}$ of the midsole (14). It will be appreciated that the height may vary across of the length $L_{lfg}$ of the longitudinal flex groove (362) along the outsole (16), particularly in relation to the thickness $T_{midsole}$ of the midsole. For example, the longitudinal flex groove (362) may have a greater height when the midsole (14) has a greater thickness and a smaller height when the midsole has a smaller thickness.

As shown in FIGS. 51A-B and 52A-E, the longitudinal flex groove (362) has a cross-sectional shape. Preferably, as shown in FIGS. 51A-B the longitudinal flex groove (362) has a substantially C shaped cross-section. Although, it will be appreciated that the cross-section may be U or V shaped or have vertical sidewalls or have any other suitable cross-sectional shape such as those shown in FIGS. 52A-E. In the embodiment shown in FIG. 52D the longitudinal flex groove (362) has a width $w_{max}$ up to about 80% of the overall sole width $w_{sole}$ while the maximum height $H_{lfgmax}$ is at least about 3 mm. In the embodiment shown in FIG. 52E the longitudinal flex groove (362) has a width $w_{max}$ of at least about 2 mm, but a maximum height $H_{lfgmax}$ of up to about 80% of the midsole (14) thickness $T_{midsole}$.

Additionally, it will be appreciated that the longitudinal flex groove (362) is not completely straight, but when viewed longitudinally from heel to toe, for example in FIGS. 50A-B, the longitudinal flex groove (362) curves at an angle towards the medial side (88) of the outsole (16) as it gets closer to the hallux (big toe) at an angle β of about 5 to 20 degrees, more preferably about 7 to 15 degrees. Moreover, as shown in FIGS. 49-50B, the longitudinal flex groove (362) has a perimeter portion (368), this perimeter portion (368) may have the same thickness around the longitudinal flex groove (362) and it may include a beveled edge as shown. The longitudinal flex groove (362) will allow the outsole (16) to flex about the longitudinal flex groove (362) so that the lateral side (86) of the outsole may stay in contact with the ground longer during a golfer's swing, thus providing more stability and power during a golfer's golf swing to be transferred to the golf ball during shot taking.

As shown in FIGS. 49 and 50A, the traction members (358) preferably have the same geometric configuration as shown in FIG. 8, wherein the traction members are arranged in an eccentric configuration and each adjacent traction member is positioned at a different radius from a given center of rotation. It will be appreciated that the traction members (358) may have different structures. For example, traction members (358) may have the traction structures as shown in FIGS. 9, 9A, 10, 10A, 11, and 11A described above. In particular, for example, the traction members can have a three-sided pyramid-like shape with three sloping surfaces extending from a pyramid-like base and having an apex as described above. Alternatively, the traction members (358) may have the traction structures as shown in FIGS. 19-23, 29-30 and 44-47B described above or other suitable structures. The total ground contact surface area is preferably in the range of about 5 to about 100% based on total surface area of the traction tile piece (360). Moreover, it will be appreciated that the outsole (16) may be combined with spikes as previously described. The traction members may have different shapes to provide optimal traction given the number of traction members. That is, the outsoles can contain a wide variety of traction members so that the gripping power for a particular surface is maximized and less damage is done to that surface for the amount of traction provided. The traction members can have many different shapes including for example, but not limited to, annular, rectangular, triangular, square, spherical, elliptical, star, diamond, pyramid, arrow, conical, blade-like, and rod shapes. Also, the size of the traction members may differ. For example, the height and area of the traction members and volume of traction member per given tile on the outsole can be adjusted as needed.

The zones (350, 352, 354, 356) can be made of any suitable material such as rubber or plastics and combinations thereof. Thermoplastics such as nylons, polyesters, polyolefins, and polyurethanes can be used. Suitable rubber materials that can be used include, but are not limited to, polybutadiene, polyisoprene, ethylene-propylene rubber ("EPR"), ethylene-propylene-diene ("EPDM") rubber, and styrene-butadiene rubber. Preferably, the zones (350, 352, 354, 356) are made of a rubber material which provides good gripping power. With rubber, the gripping power for a particular surface is maximized and less damage is done to that surface for the amount of traction provided. The above-described traction members (358) are particularly effective in providing maximum contact with the ground to help prevent a person from slipping and losing their balance when walking or swinging a golf club. These traction members (358) also have high turf-grabbing strength and help to provide stability and support. These traction members (358) provide high gripping action for the shoe for off-course surfaces such as, for example, golf clubhouses, sidewalks, streets, office, and homes.

As discussed above, the zones (350, 352, 354 and 356) shown in FIG. 50B may comprise different materials. For example, preferably the first and second zones (350, 352) may be made from a relatively harder, stiffer composition for on-course surfaces; and the third and fourth zones (354, 356) may be made from a relatively softer, grippier composition for off-course surfaces. It is preferred that the first and second zones are tuned for on-course surfaces and that the third and fourth zones are tuned for off-course surfaces. It will be appreciated that by varying the hardness values of the different zones (350, 352, 354, 356), each zone can be tuned so that it responds differently upon contacting a ground surface. The zones (350, 352, 354, 356) are configured so they deform differently when pressed against a ground surface. For example, a zone may have a relatively low hardness value that is optimal for maximizing traction with a hard, wet surface and may be better for walking or off-course; and another zone may have a relatively high hardness value making it optimal for maximizing traction with soft natural grass and may be better for shot taking or on-course activity. Materials used in on-course zones will generally have a higher hardness range of about 60 to 80 Shore A. Materials used in off-course zones will generally have a lower hardness range of about 50 to 70 Shore A. Preferably, the harder, stiffer material has a hardness range of about 65 to 75 Shore A and the softer, grippier material has a hardness range of about 55 to 65 Shore A. More preferably, the harder, stiffer material has a hardness range of about 67 to 73 Shore A and the softer, grippier material has a hardness range of about 57 to 63 Shore A. Preferably, harder zone materials differ in hardness from the softer zone materials by at least 3 Shore A, more preferably by at least 5 Shore A, and still more preferably at least 8 Shore A. In an embodiment that is more for on-course use, the on-course zones 350, 352 would have a hardness of about 70 to 80 Shore A and the off-course zones 354, 356 would have a hardness of about 60 to 70 Shore A. In another embodiment that is more for general off-course use, the on-course zones 350, 352 would have a hardness of about 60 to 70 Shore A and the off-course zones 354, 356 would have a hardness of about 50 to 60 Shore A.

It will be appreciated that the boundary and area of the zones (350, 352, 354, 356) may be altered to cover different portions of the outsole to achieve different results for on-course and off-course attributes. For example, it will be appreciated that boundary (370) between the first and third zones in the toe, forefoot region extending from the edge of the outsole (16) to the longitudinal flex groove (362) may be altered in location or shape, or boundary (372) between the second and fourth zones in the heel, rear-foot region extending from the edge of the outsole (16) to the longitudinal flex groove (362) may be altered in location and shape. Moreover, it will be appreciated that there may be no gap (374) in the mid-foot region (82) between the zones (350, 354) in the forefoot region (80) and the zones (352, 354) in rear-foot region (84), they may be directly adjacent to each other. Additionally, the type of traction member (358) in each zone may be different to alter the on-course and off-course attributes for the zone, or alternatively, the zones may comprise different multi-surface traction members (358) within the zone as described above. Moreover, it will be appreciated that the lengths (heights) of the traction members (358) as shown are substantially the same. However, it will be appreciated that the lengths (heights) of the traction members (358) may be different in different zones as discussed previously. For example, the heights of the traction members can be in the range of about 1 mm to about 6 mm. Alternatively, the lengths (heights) of the traction members (358) may differ within the same zone. By varying the length (height) of the different zones or traction members, each zone or traction member may be tuned so that it penetrates to a different depth when contacting the ground surface. For example, in one embodiment, the first and fourth zones (350, 356) on the lateral side (86) may have a relatively greater height that is optimized for penetrating the ground surface deeply. Meanwhile, the third and second zones (354, 352) on the medial side (88) may have a relatively lesser height that is optimized for riding on the surface or penetrating the ground to a shallow extent.

Golf Course Turf Grasses

One problem with conventional golf shoes is they can cause damage to the grasses on golf courses, particularly putting greens. There are many different turf grasses that are used over the golf course depending upon the course area, for example, the tee box, fairway, rough, or putting green. Also, different grasses are used based on factors such as geographic region, climate, availability of water and irrigation systems, and soil type. For example, many Northern golf courses use Bentgrass and many Southern golf courses used Bermuda grass on putting greens. Some older courses use ryegrass or *Poa anna* (annual bluegrass) on the greens. All of the turf grasses are generally tough and can withstand some foot traffic; however, some conventional golf shoes are more likely to damage the turf grasses on golf courses. Damage to putting greens is a particular problem.

In general, golf shoe spikes can be made of a metal or plastic material. However, one problem with metal spikes is they are normally elongated pieces with a sharp point extending downwardly that can sharply break through the ground surface tear apart the turf grass. These metal spikes can leave spike holes or other marks on putting greens. These metal spikes also can cause damage to other ground surfaces at a golf course, for example, the carpeting and flooring in a clubhouse. Today, most golf courses require that golfers use non-metal spikes. Plastic spikes normally have a rounded base and a central stud on one face. On the other face of the rounded base, there are radial arms with traction projections for contacting the ground surface. Screw threads are spaced about the stud on the spike for inserting into a threaded receptacle on the outsole of the shoe. These plastic spikes, which can be easily fastened and later removed from the locking receptacle on the outsole, cause less damage to the turf grasses and putting greens and clubhouse flooring surfaces. Still, many conventional shoes with these replaceable plastic cleats have a very aggressive design. These cleats have long projecting arms and teeth that can penetrate into the ground and potentially damage the crown and root network of turf grasses.

In general, grass growth originates from the crown of the grass. The crown grows at the ground level where the grass shoots and roots meet. New blades of grass are continuously produced to replace grass blades that are dying off, and this growth starts at the crown. The roots feed the crown and anchor the grass. The root network can be complex and many roots tend to extend horizontally. When the cleats of some conventional golf shoes first penetrate the soil, they damage the crown portion. As the cleats penetrate more deeply into the soil, they tear against the roots. This chopping or shearing action damages the root structure. The roots are pulled apart in different directions. If the damage to the crown and roots is severe enough, the grass will die.

The outsole structures of this invention contain traction members that provide good traction on the various turf grasses of the golf course. At the same time, the traction members of this invention tend to penetrate the ground to a relatively shallow extent. The traction members of this invention do not bite into the grass to a point where they can completely destroy the plant's structure. The outsole structures and traction members of this invention can be considered "green-friendly" because of their non-putting green damaging nature.

Upper and Midsole Structure

Turning back to FIG. 31, this embodiment of the shoe includes an upper portion and outsole portion along with a midsole connecting the upper to the outsole. The midsole is joined to the upper and outsole as discussed in more detail below.

The upper (225) has a traditional shape and is made from a standard upper material such as, for example, natural leather, synthetic leather, non-woven materials, natural fabrics, and synthetic fabrics. For example, breathable mesh, and synthetic textile fabrics made from nylons, polyesters, polyolefins, polyurethanes, rubbers, and combinations thereof can be used. The material used to construct the upper is selected based on desired properties such as breathability, durability, flexibility, and comfort. In one preferred example, the upper is made of a soft, breathable leather material having waterproof properties. The upper material is stitched or bonded together to form an upper structure using traditional manufacturing methods.

Figure 31:
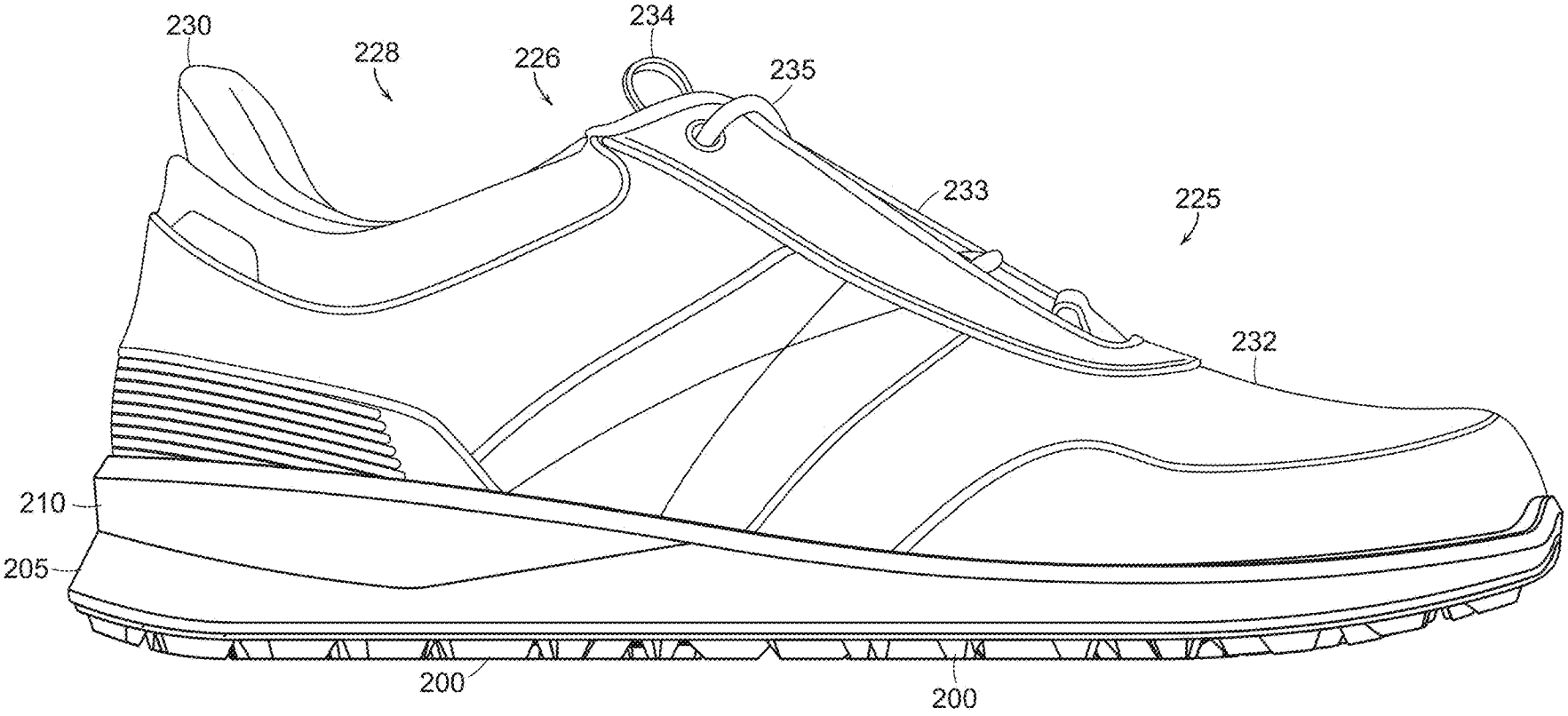
FIG. 31 is a side view of one example of a golf shoe of the present invention showing the shoe upper in detail.

As shown in FIG. 31, the upper (225) generally includes an instep region (226) with an opening (228) for inserting a foot. The upper preferably includes a soft, molded foam heel collar (230) for providing enhanced comfort and fit. An optional ghille strip (not shown) can be wrapped around the heel collar. The upper includes a vamp (232) for covering the forepart of the foot. The instep region includes a tongue member (233) overlying the quarter section of the upper. The upper portion of the tongue or tongue member (233) can include an optional ghille strip (234). Normally, laces (235) are used for tightening the shoe around the contour of the foot. However, other tightening systems can be used including metal cable (lace)-tightening assemblies that include a dial, spool, and housing and locking mechanism for locking the cable in place. Such lace tightening assemblies are available from Boa Technology, Inc. It should be understood that the above-described upper shown in FIG. 31 represents only one example of an upper design that can be used in the shoe construction of this invention and other upper designs can be used without departing from the spirit and scope of this invention.

Multi-Stance/Multi-Swing/Multi-Shot Traction

In some embodiments, the shoes disclosed herein may comprise an outsole with traction members that are arranged and/or configured to provide multi-stance, multi-swing, and/or multi-shot traction performance. In some cases, the traction members may be configured to provide traction during golf-related actions or movements that are initiated or executed using different stances. In some cases, the traction members may be configured to provide traction during golf-related actions or movements involving a variety of different biomechanical actions or sequences that can result in different types of swings and/or different types of shots. In some cases, the golf-related actions or movements may involve multiple golf swings executed by a subject in different stances, multiple different types of golf swings executed by the subject, or multiple different types of golf shots executed by the subject. In some cases, the golf-related actions or movements may involve multiple golf swings or multiple different types of golf swings executed by different subjects with different stances. In some cases, the outsoles and traction members disclosed herein may be configured to provide consistent traction regardless of the stance used by a subject when the subject initiates or executes a golf-related action or movement. In some cases, the outsoles and traction members disclosed herein may be configured to provide consistent traction regardless of the type of swing executed by a subject or the type of golf shot that the subject hits when the subject executes a golf swing.

Figure 53A:
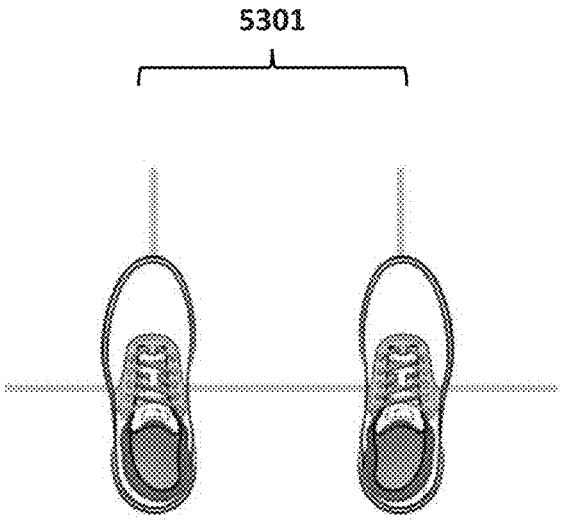
FIGS. 53A and 53B schematically illustrate various different types of stances that a subject can take when initiating or executing a golf swing.
Figure 53B:
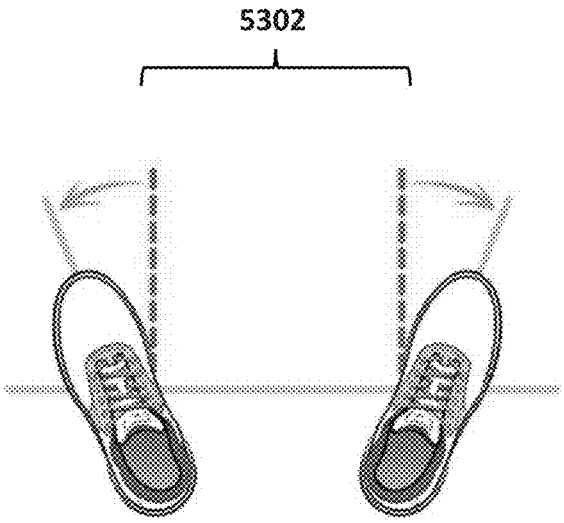

FIGS. 53A and 53B schematically illustrate various different types of stances that a subject can take when initiating or executing a golf swing. In some cases, the stance of a subject may influence the type of swing that the subject can execute or the type of shot that the subject can hit. In some cases, the stance of a subject may influence the biomechanical actions involved in executing a golf swing, including the physical movements associated with the golf swing and the relative timings of the physical movements needed to execute the golf swing. In some cases, the subject may take a neutral stance. In other cases, the subject may take an angled stance. In some alternative cases, the subject may have one foot in a more angled stance and another foot in a more neutral stance.

As shown in FIG. 53A, in some cases, the subject may take a neutral stance 5301 in which the subject's feet are aligned with one or more longitudinal (vertical) axes bisecting the subject's left and right feet. In some cases, the one or more longitudinal (vertical) axes may be perpendicular to a lateral (horizontal) axis intersecting a point or region in three-dimensional space corresponding to the subject's center of mass (e.g., when the subject is standing upright with an equal weight distribution across the subject's left and right feet).

As shown in FIG. 53B, in some cases, the subject may take an angled stance 5302 in which the subject's feet are oriented at an angle relative to the one or more longitudinal (vertical) axes. In some cases, at least one of the subject's left and/or right foot may be angled inwards by an angle ranging from about 0 degrees to about 45 degrees relative to the longitudinal (vertical) axis. In some cases, at least one of the subject's left and/or right foot may be angled outwards by an angle ranging from about 0 degrees to about 45 degrees relative to the longitudinal (vertical) axis. In some cases, the subject's left foot may be oriented at a different angle than the subject's right foot. For example, in some cases, the subject's left foot may be oriented inwards or outwards, and the subject's right foot may be oriented outwards or inwards. In other cases, the subject's left foot and right foot may both be oriented inwards or outwards, but at different angles relative to the longitudinal (vertical) axes for each respective foot.

Figure 54A:
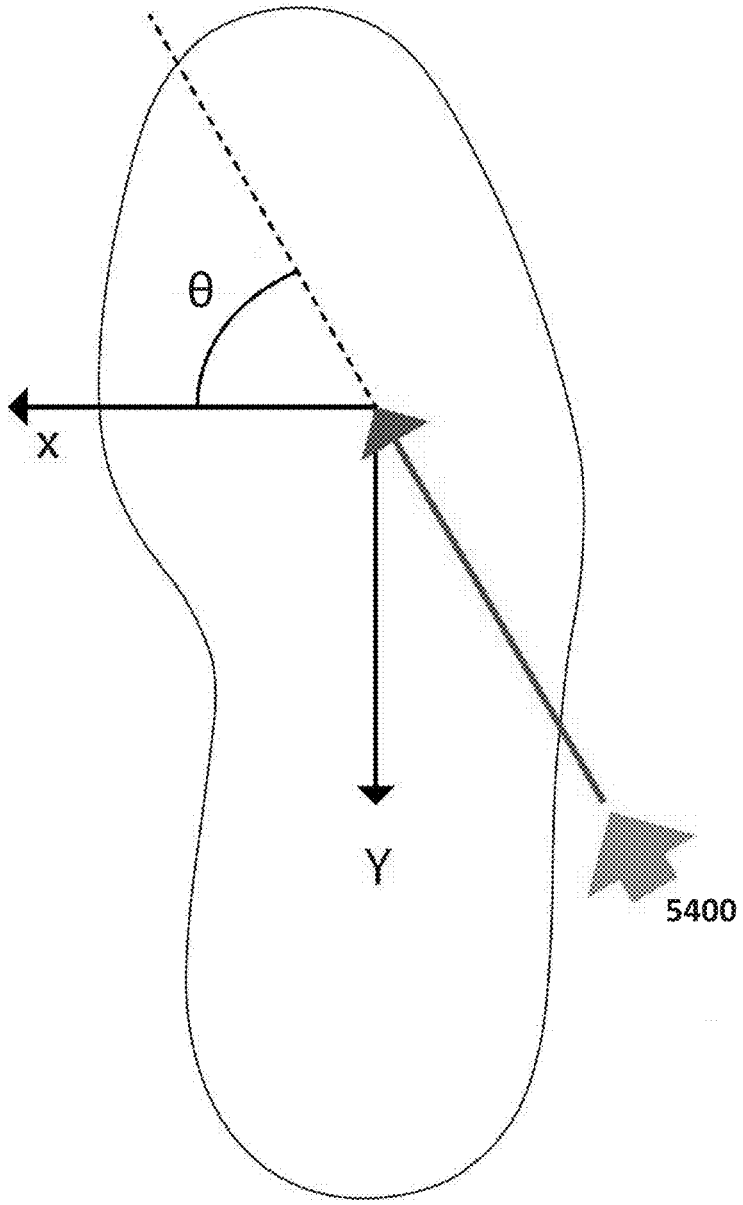
FIG. 54A schematically illustrates an exemplary force vector associated with a golf swing that is executed using a neutral stance.

FIG. 54A schematically illustrates an exemplary force vector 5400 associated with one or more ground reaction forces that are generated in response to the forces exerted by the subject's feet or the subject's shoe on the ground surface (e.g., when the subject is executing a golf-related action or movement). In some cases, the one or more ground reaction forces may correspond to one or more forces that are exerted by the ground surface on the traction members of the shoe in reaction to the forces exerted by the traction members on the ground surface (e.g., when the subject is executing a golf-related action or movement). In some cases, the force vector 5400 may have an orientation corresponding to a direction along which frictional interactions can occur between the traction members and the ground surface. In some cases, the force vector 5400 may be oriented towards a center of pressure in the forefoot region of the shoe when a subject wearing the shoe executes one or more biomechanical actions associated with a golf swing. Because there is an increased possibility of slipping and loss of traction when the subject executes a downswing and applies pressure to the trailing forefoot, it is advantageous to add traction members in the forefoot region of the shoe that are in alignment with the ground reaction forces generated during a golf swing (e.g., during the downswing) so that the subject can leverage the ground reaction forces to perform a series of optimal biomechanical movements that allow the subject to execute a particular type of swing or to hit a particular type of shot type.

In some cases (e.g., for swings executed using a more neutral stance), the force vector 5400 may be disposed within a predetermined angular range θ. In some cases, the predetermined angular range θ may be about 50 degrees to about 75 degrees relative to the lateral (horizontal) axis. In some cases, the predetermined angular range θ may be about 55 degrees to about 70 degrees relative to the lateral (horizontal) axis. In some cases, the predetermined angular range θmay be about 60 degrees to about 65 degrees relative to the lateral (horizontal) axis. In some cases, the force vector may be about 60 degrees, 61 degrees, 62 degrees, 63 degrees, 64 degrees, or 65 degrees relative to the lateral (horizontal) axis.

As discussed elsewhere herein, in some cases, the subject's stance may be different from the neutral stance (e.g., the subject may have an angled stance or a combination of a neutral stance for one foot and an angled stance for the other foot), or the subject's stance may change or vary depending on the type of swing or the type of shot that the subject is executing. In such cases, the force vectors associated with the subject's swing may have a different directionality or orientation than the force vectors typically associated with more neutral stances. Thus, it would be beneficial to configure an outsole with multiple sets of traction members that can manage different force vectors in different directions and/or different sets of force vectors associated with different types of stances and/or different types of swings or shots.

EXAMPLES

In one aspect, the present disclosure provides various examples and embodiments of a golf shoe with an outsole comprising multiple sets of traction members, each individually configured to accommodate force vectors with a different orientation or directionality. In some cases, the multiple sets of traction members may be configured to collectively accommodate a wide range of different ground reaction force vectors associated with many different types of stances, swings, or shots. In some cases, the traction members disclosed herein may be arranged to provide multiple outsole or traction regions that are each tailored to provide optimal traction along different directions of the outsole (e.g., for different types of stances, swings, and/or shots).

Figure 54B:
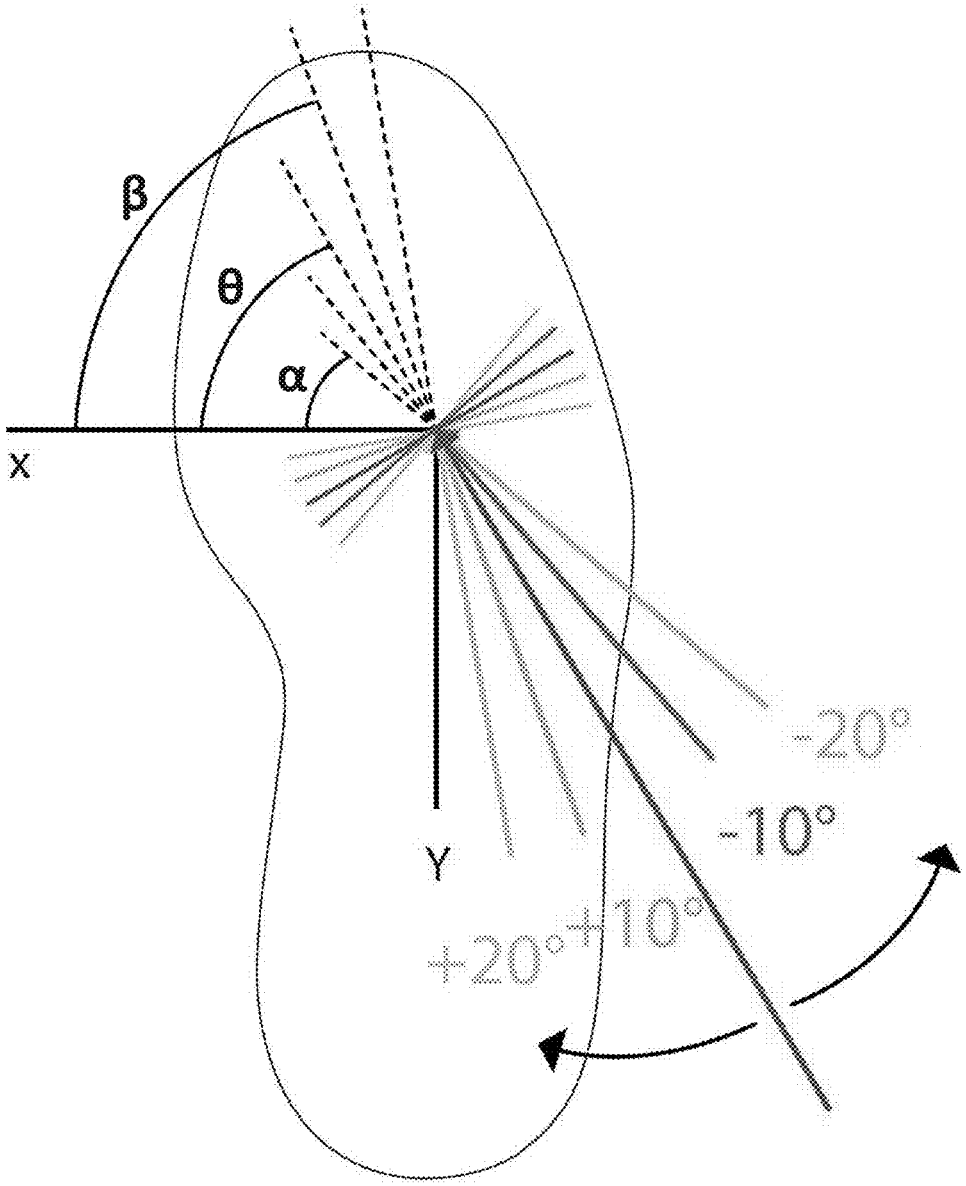
FIG. 54B schematically illustrates a plurality of different force vector directions associated with golf-related actions or movements that are initiated or executed using multiple different stances.

FIG. 54B schematically illustrates a plurality of different force vectors that the traction members of the present disclosure can be configured to accommodate or manage. In some cases, a first set of traction members may be configured to provide traction along a first force vector direction that is disposed at an angle θ relative to a lateral (horizontal) axis of the outsole. In some cases, the angle θ may be associated with a neutral stance. In some cases, a second set of traction members may be configured to provide traction along a second force vector direction that is disposed at an angle α relative to the lateral (horizontal) axis of the outsole. In some cases, the angle α may be associated with an angled stance (e.g., a stance that is angled more inwards or outwards than a neutral stance). In some cases, a third set of traction members may be configured to provide traction along a third force vector direction that is disposed at an angle R relative to the lateral (horizontal) axis of the outsole. In some cases, the angle β may be associated with an angled stance (e.g., a stance that is angled more outwards or inwards than a neutral stance).

In some cases, the angle θ may range from about 50 degrees to about 75 degrees relative to the lateral (horizontal) axis of the shoe. In some cases, the angle θ may range from about 55 degrees to about 70 degrees relative to the lateral (horizontal) axis of the shoe. In some cases, the angle θ may range from about 60 degrees to about 65 degrees relative to the lateral (horizontal) axis of the shoe. In some cases, the angle θ may be about 60 degrees, 61 degrees, 62 degrees, 63 degrees, 64 degrees, or 65 degrees relative to the lateral (horizontal) axis of the shoe.

In some cases, the angle α may be less than the angle θ. In some cases, the angle α may be at most about 65 degrees relative to the lateral (horizontal) axis of the shoe. In some cases, the angle α may be at most about 60 degrees relative to the lateral (horizontal) axis of the shoe. In some cases, the angle α may be at most about 55 degrees relative to the lateral (horizontal) axis of the shoe. In some cases, the angle α may be at most about 50 degrees relative to the lateral (horizontal) axis of the shoe. In some cases, the angle α may be at most about 45 degrees relative to the lateral (horizontal) axis of the shoe. In some cases, the angle α may be at most about 40 degrees relative to the lateral (horizontal) axis of the shoe.

In some cases, the angle β may be greater than the angle θ. In some cases, the angle R may be at least about 60 degrees relative to the lateral (horizontal) axis of the shoe. In some cases, the angle β may be at least about 65 degrees relative to the lateral (horizontal) axis of the shoe. In some cases, the angle β may be at least about 70 degrees relative to the lateral (horizontal) axis of the shoe. In some cases, the angle β may be at least about 75 degrees relative to the lateral (horizontal) axis of the shoe. In some cases, the angle β may be at least about 80 degrees relative to the lateral (horizontal) axis of the shoe.

In some cases, the angular variance between the angle θ and the angle α may be about 5 degrees, about 10 degrees, about 15 degrees, about 20 degrees, or more. In some cases, the angular variance between the angle θ and the angle β may be about 5 degrees, about 10 degrees, about 15 degrees, about 20 degrees, or more. In some cases, the angular variance between the angle θ and the angle α may be greater than or equal to the angular variance between the angle θ and the angle β. In some cases, the angular variance between the angle θ and the angle α may be less than or equal to the angular variance between the angle θ and the angle β.

In some cases, the shoes disclosed herein may comprise an outsole with multiple sets of traction members arranged along multiple different force vector directions. In some cases, the angular variance between each adjacent set of traction members may be constant. In other cases, the angular variance between each adjacent set of traction members may change or vary in an irregular or aperiodic manner.

Tile Patterns and Spiral Pathways

Figure 55:
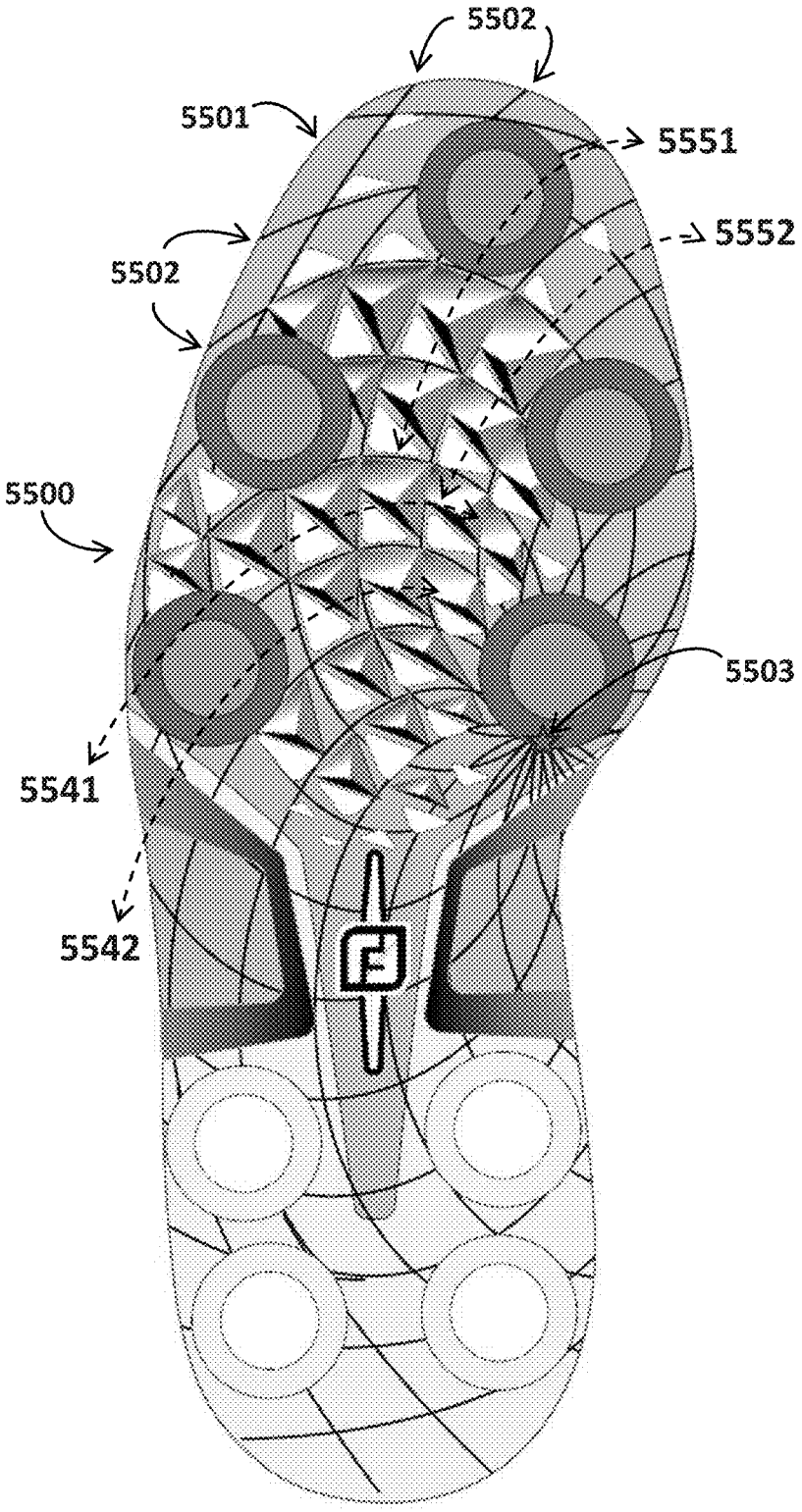
FIG. 55 schematically illustrates an example of an outsole with traction members arranged in a tile configuration, in accordance with some embodiments.

Referring now to FIG. 55, in some embodiments, the outsole may comprise one or more traction members arranged in a tile configuration 5500 as described elsewhere herein. In some cases, the tile configuration may include a plurality of tiles 5501 configured to extend across a forefoot region, a midfoot region, and/or a rearfoot region of the outsole. In some cases, the plurality of tiles may be defined at least in part by superimposing or overlaying multiple spiral pathways 5502. In some cases, the multiple spiral pathways 5502 may have one or more common points of origin 5503 and multiple spiral segments radiating from the one or more common points of origin. In some cases, the multiple spiral pathways may include a first spiral pathway and a second spiral pathway that is an inverse of the first spiral pathway.

In some embodiments, the outsole may comprise (i) a first set of spiral pathways with a first plurality of spiral segments radiating from a first point of origin. In some cases, each segment in the first plurality of spiral segments may have a different degree of curvature. In some embodiments, the outsole may comprise (ii) a second set of spiral pathways with a second plurality of spiral segments radiating from a second point of origin. The first and second points of origin may be common points of origin, or may be different points of origin which do not coincide. In some cases, each segment in the second plurality of spiral segments may have a different degree of curvature. In some cases, the first set of spiral pathways and the second set of spiral pathways may be inversely related and superimposed to form a plurality of tiles across the outsole. In some cases, the plurality of tiles may have a plurality of sides or edges formed by a plurality of sub-segments associated with the first plurality of spiral segments and/or the second plurality of spiral segments.

In some cases, the curved segments associated with a first spiral pathway and the curved segments associated with a second spiral pathway may be arranged to create a plurality of multi-sided tile pieces, and the intersecting points between the superposed or overlaid sets of spiral pathways may form the corners of the tile pieces. In some cases, the tile pieces may contain one or more traction members with sidewalls extending from the sides or edges of the tile pieces. In some cases, the sidewalls of the traction members may be configured to extend from the sides or edges of the tiles to form the ground contacting or ground penetrating portions of the traction members.

Traction Element Arrangement by Sidewall Orientation

In some embodiments, the traction members may be arranged along or between different spiral segments according to an angular orientation of the sidewalls of the traction members. For example, in some cases, a first set of traction members with sidewalls oriented in a first direction may be arranged along a first spiral segment or between a first and second spiral segment, and a second set of traction members with sidewalls oriented in a second direction may be arranged along a second spiral segment or between a second and third spiral segment, and so on. In some cases, traction members oriented in a first direction may be arranged along or between a first set of spiral segments, and traction members oriented in a second direction may be arranged along or between a second set of spiral segments. In some cases, the first and second sets of spiral segments may include one or more common spiral segments. In other cases, the first and second sets of spiral segments may include different spiral segments and/or unique sets of spiral segments with no common spiral segments.

In some embodiments, the traction members may comprise (i) a first set of directional traction elements arranged along a first curved pathway extending between a medial side and a lateral side of the outsole and (ii) a second set of directional traction elements arranged along a second curved pathway extending alongside the first curved pathway. In some cases, the first curved pathway and/or the second curved pathway may correspond to a curvature of one or more spiral segments extending across the outsole. In some cases, the first curved pathway may be parallel to the second curved pathway. In some cases, the first curved pathway and the second curved pathway may be vertically offset from each other. For example, the first curved pathway may be positioned above the second curved pathway, or the first curved pathway may be positioned below the second curved pathway.

In some cases, the first curved pathway and the second curved pathway may be located within a forefoot region of the outsole. In some cases, the first curved pathway and the second curved pathway may be located within a forefoot region and/or a midfoot region of the outsole. In some cases, the first curved pathway and the second curved pathway may be configured to extend between a forefoot region of the outsole and a midfoot region or a rearfoot region of the outsole.

Directionally Aligned Traction Elements

In some cases, the first set of directional traction elements and/or the second set of directional traction elements may include a plurality of directionally aligned traction elements. In some cases, the directionally aligned traction elements may have sidewalls that are oriented in a same direction. In some cases, the directionally aligned traction elements may include adjacent traction elements arranged along one or more lateral curved pathways and/or one or more longitudinal curved pathways.

Lateral Curved Pathways

In some cases, the plurality of directionally aligned traction elements may include two or more adjacent traction elements positioned in different tiles that are arranged along one or more lateral curved pathways 5541, 5542. In some cases, the adjacent traction elements may be positioned along a same curved pathway extending laterally between a medial side and a lateral side of the outsole. In some cases, the adjacent traction elements may be positioned between a same set of curved pathways extending laterally between the medial side and the lateral side of the outsole.

In some cases, the adjacent traction elements may include a first traction element integrated with a first tile and a second traction element integrated with a second tile that is directly adjacent to (e.g., on a left side or a right side of) the first tile. In some cases, the first tile and the second tile may be neighboring tiles sharing a common side or edge. In some cases, the first traction element and the second traction element may have one or more sidewalls extending from the common side or edge in different directions.

In some alternative cases, the adjacent traction elements may be positioned along different curved pathways extending laterally between the medial side of the outsole and the lateral side of the outsole. In some cases, the adjacent traction elements may be positioned along different sets of curved pathways extending laterally between the medial side and the lateral side of the outsole.

Longitudinal Curved Pathways

In some cases, the plurality of directionally aligned traction elements may include two or more adjacent traction elements positioned in different tiles that are arranged along one or more longitudinal curved pathways 5551, 5552. In some cases, the adjacent traction elements may include a first directional traction element and a second directional traction element arranged along a same curved pathway extending longitudinally between a forefoot region and a midfoot or rearfoot region of the outsole. In some cases, the first directional traction element and the second directional traction element may be positioned between a same set of curved pathways extending longitudinally between the forefoot region and the midfoot or rearfoot region of the outsole.

In some cases, the first directional traction element may be integrated with a first tile and the second directional traction element may be integrated with a second tile that is directly adjacent to (e.g., above or below) the first tile. In some cases, the first tile and the second tile may be neighboring tiles sharing a common side or edge. In some cases, the first directional traction element and the second directional traction element may have one or more sidewalls extending from the common side or edge in different directions.

In some alternative cases, the first directional traction element and the second directional traction element may be positioned along different curved pathways extending longitudinally between the forefoot region and the midfoot or rearfoot region of the outsole. In some cases, the first directional traction element and the second directional traction element may be positioned between different sets of curved pathways extending longitudinally between the forefoot region and the midfoot or rearfoot region of the outsole.

Progressive Change in Sidewall Orientation

Figure 56A:
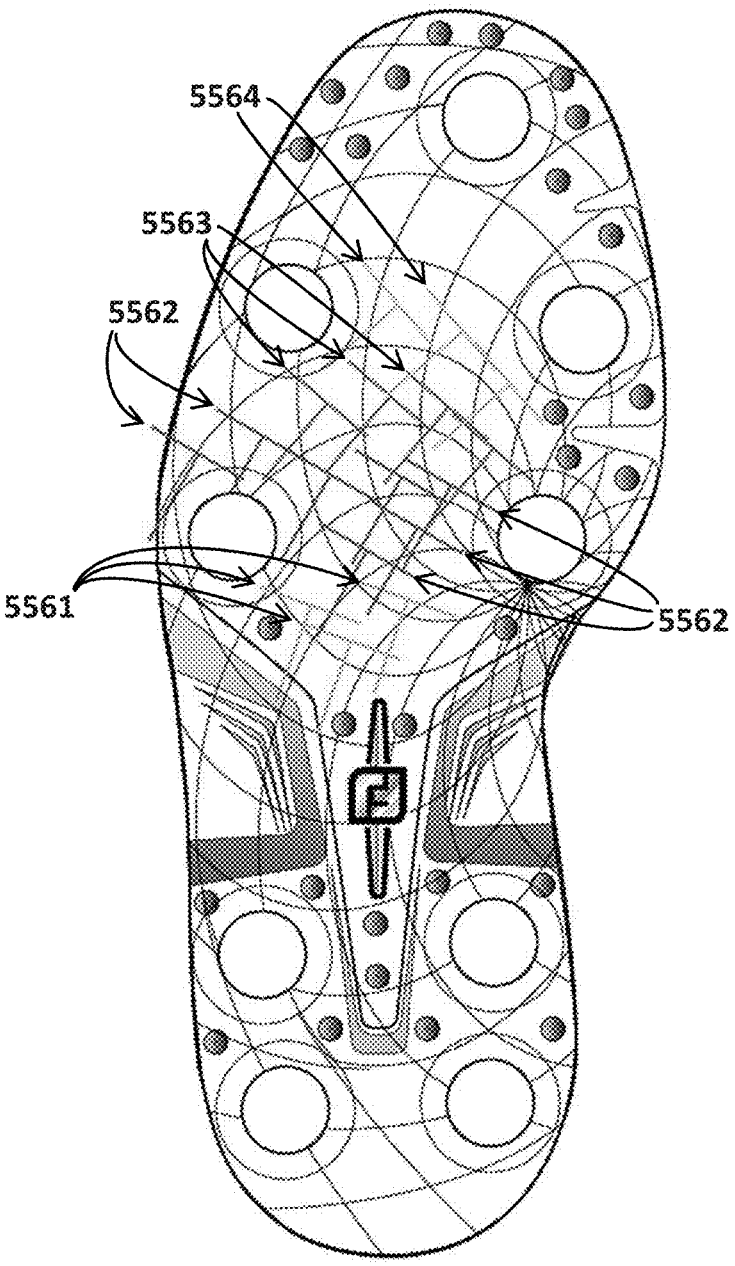
FIGS. 56A and 56B schematically illustrate various exemplary outsoles comprising traction members with sidewalls that are oriented to accommodate or manage force vectors that are directed in a plurality of different directions, in accordance with some embodiments.
Figure 56B:
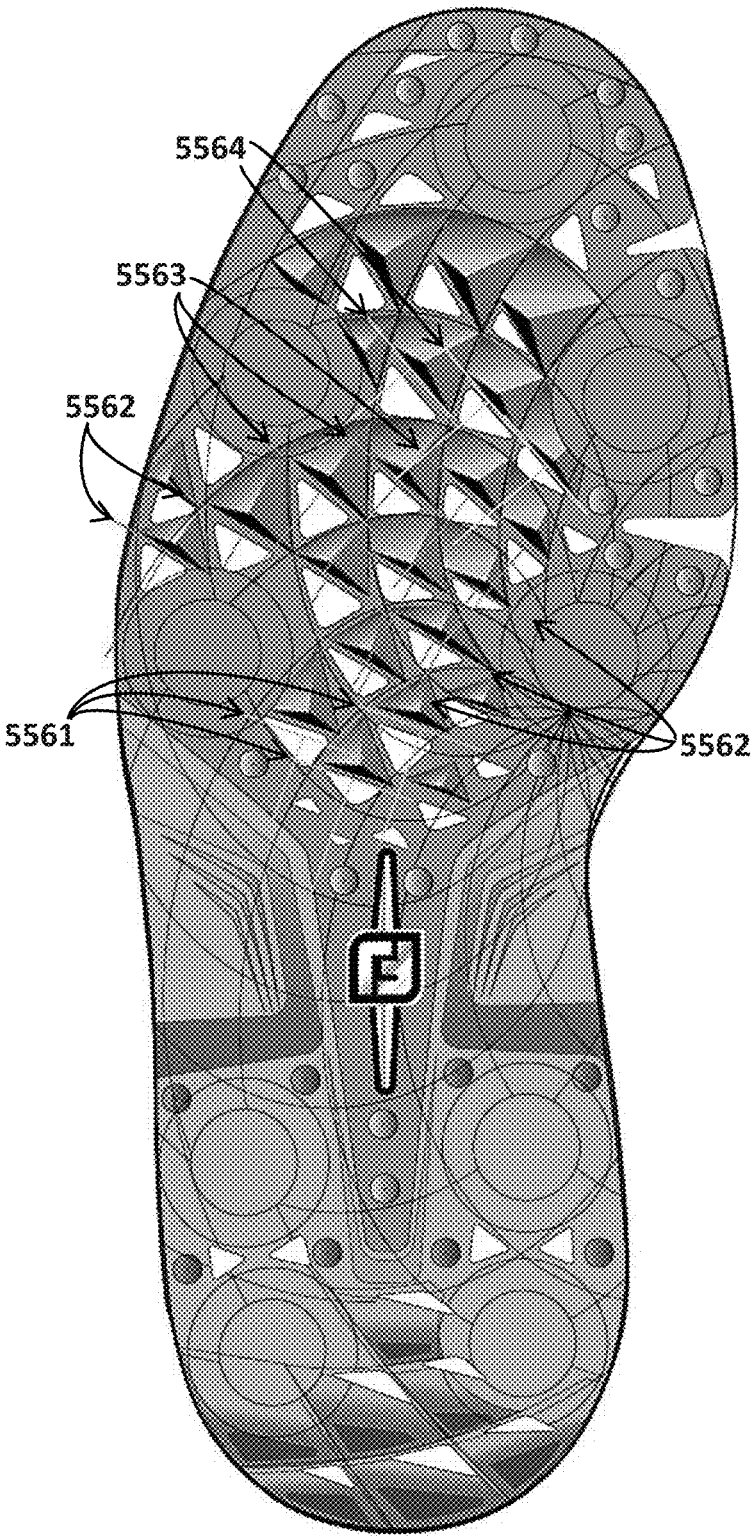

As shown in FIGS. 56A and 56B, in some cases, the traction members projecting from the tile pieces may have sidewalls that progressively change in orientation so that different traction members with different sidewall orientations can manage different ground reaction force vectors that are directed in different directions 5561, 5562, 5563, 5564. In some embodiments, the outsole may comprise a series of tiles arranged along one or more lateral curved pathways and/or one or more longitudinal curved pathways as described elsewhere herein. In some cases, adjacent traction elements in the series of tiles may have sidewalls that are aligned with and parallel to each other. In some cases, adjacent traction elements in the series of tiles may have sidewalls that are oriented in a same direction (e.g., perpendicular to the ground reaction forces associated with a particular type of stance, golf swing, or golf shot).

In some embodiments, the angular orientation of the sidewalls may progressively change as the traction members extend laterally and/or longitudinally across the forefoot, midfoot, and/or rearfoot region of the outsole. In some cases, the angular orientation of the sidewalls may change in a graduated, stepwise, or piecewise manner. In some cases, the angular orientation of the sidewalls may change over a constant number of traction elements (e.g., every n number of traction elements, where n is an integer greater than or equal to 1). In other cases, the angular orientation of the sidewalls may change irregularly or aperiodically over a different number of traction elements depending on the outsole section (e.g., every $n_1$ number of traction elements along a first outsole section and every $n_2$ number of traction elements along a second outsole section, where $n_1 \neq n_2$, and so on).

In some embodiments, the outsole may comprise multiple series of traction members with sidewalls that progressively change or vary in orientation in a graduated, piecewise, or stepwise manner. In some cases, the multiple series of traction members may be arranged along one or more same curved pathways. In some cases, the multiple series of traction members may be arranged along different curved pathways. In some cases, two or more adjacent traction members in the same series of traction members may have sidewalls with a same orientation. In some cases, two or more adjacent traction members in the same series of traction members may have sidewalls with different orientations.

Multi-Stance/Multi-Swing/Multi-Shot Traction

In some embodiments, the outsole may comprise a plurality of directional traction elements arranged across the outsole to provide traction for multiple different types of stances, swings, or shots. In some cases, the directional traction elements may include a first set of directional traction elements extending along a first curved pathway as described elsewhere herein. In some cases, the directional traction elements may include a second set of directional traction elements extending along a second curved pathway as described elsewhere herein. In some cases, the first set of directional traction elements may be oriented in a first direction to enhance traction in the first direction. In some cases, the second set of directional traction elements may be oriented in a second direction that is different than the first direction to enhance traction in the second direction. In some cases, the first direction may correspond to a direction in which forces are exerted or applied when a subject executes a golf swing with a first type of stance, or when the subject executes a first type of golf swing or a first type of golf shot. In some cases, the second direction may correspond to a direction in which forces are exerted or applied when a subject executes a golf swing with a second type of stance that is different than the first type of stance, or when the subject executes a second type of golf swing or hits a second type of golf shot that is different than the first type of golf swing or the first type of golf shot.

In some cases, the outsole may comprise a plurality of directionally aligned traction elements arranged across the outsole to provide traction for multiple different types of stances, swings, or shots. In some cases, the plurality of directionally aligned traction elements may include (i) a first set of directionally aligned traction elements with sidewalls that are oriented in a first direction to enhance traction in said first direction and (ii) a second set of directionally aligned traction elements with sidewalls that are oriented in a second direction to enhance traction in said second direction. In some cases, the second direction may be angularly offset from the first direction. In some cases, the sidewalls of the first set of directionally aligned traction elements may be oriented perpendicular to a first set of ground reaction force vectors associated with a first type of stance, swing, or golf shot. In some cases, the sidewalls of the second set of directionally aligned traction elements may be oriented perpendicular to a second set of ground reaction force vectors associated with a second type of stance, swing, or golf shot that is different than the first type of stance, swing, or golf shot.

Traction Member Structures

Figure 57:
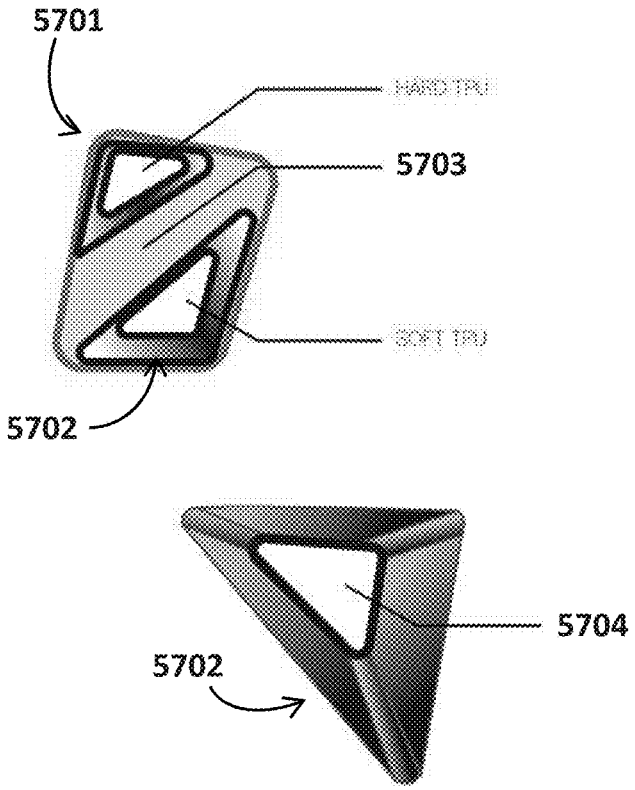
FIG. 57 schematically illustrates a detailed view of an exemplary traction member that can be formed within a tile piece of the outsole, in accordance with some embodiments.

FIG. 57 schematically illustrates a detailed view of an exemplary traction member that can be formed within a tile piece of the outsole. In some cases, the traction member may comprise a multi-surface traction member with one or more sidewalls configured to engage the ground surface under the shoe.

In some cases, a plurality of multi-surface traction members may be formed within each tile piece of the outsole. In some cases, the plurality of multi-surface traction members may include a first traction member 5701 positioned along a first corner or edge of the tile piece and a second traction member 5702 positioned along a second corner or edge of the tile piece. In some cases, the first traction member may comprise a relatively hard TPU material, and the second traction member may comprise a relatively soft TPU material.

In some cases, the first traction member 5701 and the second traction member 5702 may be spaced apart with a flex region 5703 disposed between and separating the first and second traction members. In some cases, the flex region 5703 may not or need not contain any protruding elements or structures. In some cases, the flex region 5703 may be configured as a non-protruding segment or section within the tile piece. In some cases, the flex region 5703 may be disposed along and/or between opposing sidewalls of the first traction member and the second traction member.

In some cases, the first traction member and/or the second traction member may have a plurality of sidewalls projecting from the base of the tile piece. In some cases, one or more sidewalls of the multi-surface traction member may be oriented to face the ground reaction forces vectors that are generated in response to the forces exerted by the subject's feet or the subject's shoe on the ground surface (e.g., when the subject is executing a golf-related action or movement).

In some cases, one or more sidewalls of the traction member(s) may be configured to extend from the sides or edges of the base of the tile piece and terminate at a predetermined distance from the base of the tile piece. In some cases, the distal end(s) of the first and/or second traction members may comprise a flat surface area or a plateau region 5704 that is configured to frictionally engage the ground surface under the shoe.

Figure 58:
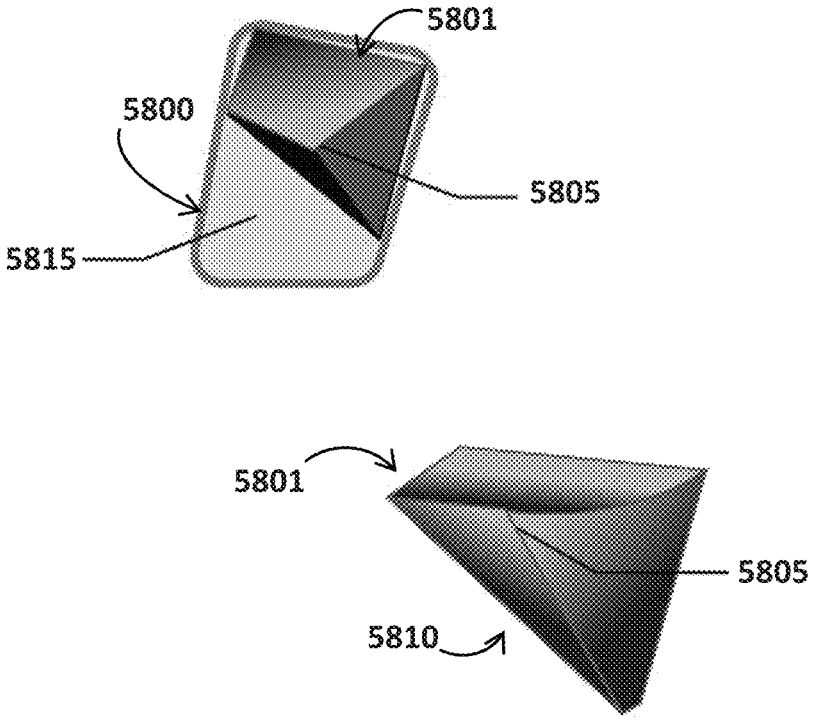
FIGS. 58 and 59 schematically illustrate detailed views of another exemplary traction member that can be formed within a tile piece of the outsole, in accordance with other embodiments.
Figure 59:
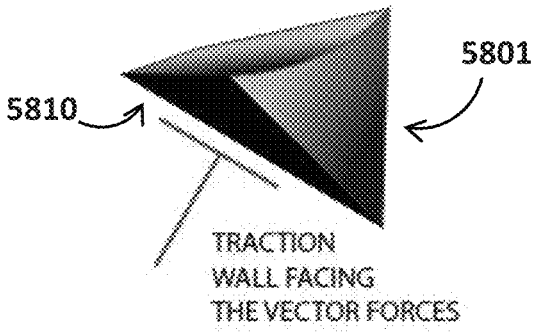

FIGS. 58 and 59 schematically illustrate a detailed view of another exemplary traction member that can be formed within a tile piece 5800 of the outsole. In some cases, the traction member may comprise a multi-surface traction member with one or more sidewalls configured to engage the ground surface under the shoe. In some cases, the multi-surface traction member may comprise one or more sidewalls that can provide a contact area for frictionally engaging or mechanically interlocking with the ground surface under the shoe.

In some cases, the multi-surface traction member may include a traction member 5801 positioned along one or more corners or edges of the tile piece. In some cases, the traction member may have a plurality of sidewalls projecting from the sides or edges of the base of the tile piece. In some cases, the plurality of sidewalls may be configured to extend from the base of the tile piece and terminate at a predetermined distance from the base of the tile piece. In some cases, the distal end of the traction member may comprise an apex region 5805. In some cases, the apex region 5805 may comprise a pointed end that is configured to penetrate through and/or mechanically interlock with the ground surface under the shoe.

In some cases, the sidewalls of the traction members may be configured to extend from the sides or edges of the tiles and converge at an apex to form a ground contacting or ground penetrating portion of the traction members. In some cases, the tiles may have n number of sides or edges, and the traction members may have m number of sidewalls extending from the sides or edges of the tiles and converging at the apex. In some cases, m may be less than n.

In some cases, the traction members may have a three-dimensional shape with a base having n number of sides or edges and m number of surfaces extending from the sides or edges of the base. In some cases, m may be less than n. In some cases, the traction members may be in the shape of a triangular pyramid with four (4) sides forming the base of the traction member and three (3) sidewalls extending from the base to form the ground contacting or ground penetrating portion of the traction member.

In some cases, the surfaces extending from the base of the traction member may correspond to one or more sidewalls of the traction member. In some cases, the one or more sidewalls may comprise at least one sidewall 5810 that is oriented perpendicular to the ground reaction forces that are generated in response to the forces exerted by the subject's feet or the subject's shoe on the ground surface under the shoe (e.g., when the subject is executing a golf-related action or movement).

Flex Windows

In some embodiments, the tile pieces of the outsole may include one or more flex regions 5815 configured to enhance the flexibility of the outsole. In some cases, the one or more flex regions 5815 may be configured to facilitate the bending or flexing of the traction member(s) formed within each tile piece. In some cases, the one or more flex regions 5815 may be configured to facilitate the bending or flexing of the outsole regions that do not contain any traction members.

In some cases, a traction member may be provided within a select portion of the tile piece without occupying a remaining surface area of the tile piece. In some cases, the remaining surface area of the tile piece may be configured as a flex region. In some cases, the flex region may not or need not contain any traction elements, protruding elements, or other structures projecting from the base of the tile piece. In some cases, the flex region may be configured as a non-protruding segment or section within the tile piece.

In some cases, the tile pieces may comprise one or more windows formed within the sides or edges of the tile pieces. In some cases, the one or more windows may be configured as flex regions for the tile pieces or the traction member(s) integrated with or formed within the tile pieces. In some cases, the one or more windows may be configured to extend between (i) a sidewall of a traction member provided within the tile piece and (ii) a corner, a side, or an edge of the tile piece that is opposite the sidewall of the traction member.

In some case, the one or more flex windows may correspond to a non-protruding portion or section of the tile piece. In some cases, the one or more flex windows may correspond to a portion or a section of the tile piece that does not include any traction members extending or projecting from the base of the tile piece. In some cases, the one or more flex windows may correspond to one or more flat or substantially flat areas formed in a portion or a section of the tile piece. In some cases, the one or more flex windows may correspond to one or more openings or cut out regions formed within or across the outsole or the outsole material.

In some cases, the one or more flex windows may be formed within the tiles that are positioned in the forefoot, midfoot, and/or rearfoot region of the outsole. In some cases, a first subset of tiles in the forefoot, midfoot, and/or rearfoot region may include one or more flex windows as described elsewhere herein (e.g., to enhance outsole flexibility in some select outsole regions). In some cases, a second subset of tiles in the forefoot, midfoot, and/or rearfoot region may not or need not include any flex windows (e.g., to preserve outsole stiffness or rigidity in other select outsole regions).

In some cases, the flex windows formed within the tiles may have different sizes and/or shapes to fine tune the flexibility of the outsole regions containing the flex windows. In some cases, the distribution or arrangement of flex windows may be asymmetric to promote higher flexibility in some outsole regions while preserving outsole stiffness or rigidity in other outsole regions. In some cases, the forefoot region of the outsole may have a greater number of flex windows per unit area or a greater number of flex windows per number of tile pieces than the midfoot and/or rearfoot region of the outsole. In some cases, the rearfoot region of the outsole may have a greater number of flex windows per unit area or a greater number of flex windows per number of tile pieces than the midfoot region of the outsole. In some cases, the rearfoot region of the outsole may have fewer flex windows per unit area or fewer flex windows per number of tile pieces than the forefoot region of the outsole.

Push/Pull Traction

Figure 60:
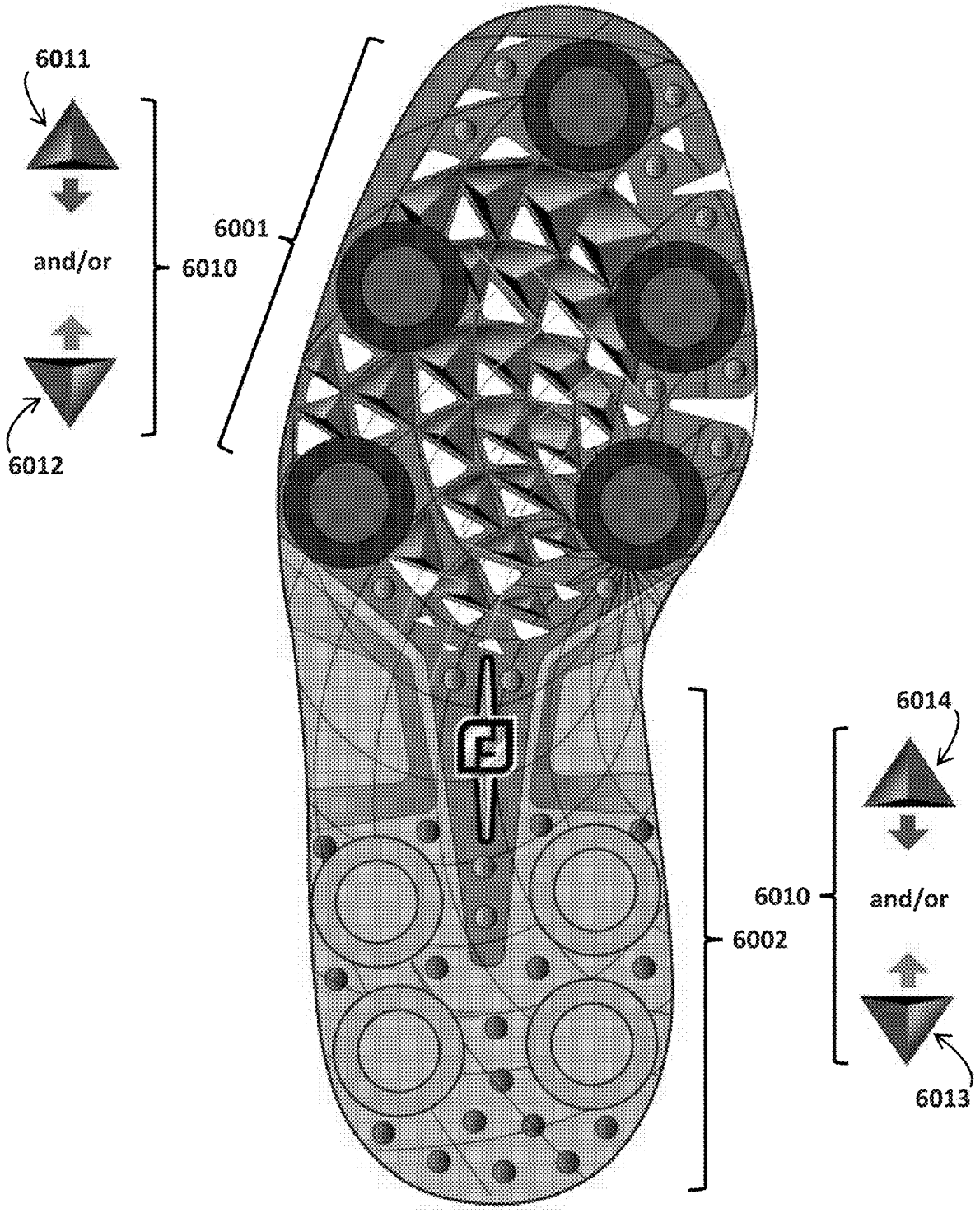
FIG. 60 schematically illustrates an example of an outsole with directional traction elements arranged in the forefoot, midfoot, and/or rearfoot region of the outsole to manage various force vectors associated with one or more golf-related actions or movements, in accordance with some embodiments.

Referring now to FIG. 60, in some embodiments, the outsole may comprise a plurality of directional traction elements 6010 with sidewalls that are oriented to accommodate or manage various ground reaction forces that are generated in response to the forces exerted by the subject's feet or the subject's shoe on the ground surface (e.g., when the subject is executing a golf-related action or movement). In some cases, the plurality of directional traction elements 6010 may be arranged along or across a forefoot region, a midfoot region, and/or a rearfoot region of the outsole.

In some embodiments, the forefoot region 6001 of the outsole may comprise one or more directional traction elements 6011 configured to provide optimal traction in one or more predetermined directions. In some cases, the one or more directional traction elements 6011 in the forefoot region of the outsole may have one or more sidewalls oriented towards the rearfoot region or the heel of the outsole to provide grip or traction when the subject is walking up a sloped ground surface. In some cases, the one or more directional traction elements in the forefoot region of the outsole may have one or more sidewalls oriented towards the rearfoot region or the heel of the outsole so that the subject can pull his or her trailing forefoot back against the ground surface as the subject executes a golf swing.

In some optional embodiments, the forefoot region of the outsole may comprise one or more other directional traction elements 6012 configured to provide optimal traction in one or more other predetermined directions. In some cases, the one or more other directional traction elements 6012 in the forefoot region of the outsole may have one or more sidewalls oriented towards the toe of the outsole so that the subject can push his or her lead forefoot forward against the ground surface for additional leverage as the subject executes a golf swing.

In some embodiments, the rearfoot region 6002 of the outsole may comprise a set of directional traction elements 6013 configured to provide optimal traction in one or more predetermined directions. In some cases, the directional traction elements in the rearfoot region of the outsole may have one or more sidewalls oriented towards the forefoot region or the toe of the outsole to provide grip or traction when the subject is walking down a sloped ground surface.

In some optional embodiments, the rearfoot region of the outsole may comprise one or more additional directional traction elements 6014 with one or more sidewalls oriented towards the heel of the outsole. In some cases, the sidewalls of the one or more additional directional traction elements may be oriented towards the heel of the outsole so that the subject can pull his or her rearfoot backwards against the ground surface as the subject executes a golf-related action or movement. In other embodiments, the rearfoot region of the outsole may not or need not comprise any additional directional traction elements with sidewalls that are oriented backwards towards the heel end of the outsole.

In some embodiments, the outsole may comprise a first plurality of directional traction elements in a forefoot region of the outsole and a second plurality of directional traction elements in a rearfoot region of the outsole. In some cases, the first plurality of directional traction elements and the second plurality of directional traction elements may both include traction elements with sidewalls oriented towards a toe end and/or a heel end of the outsole.

In some cases, the first plurality of directional traction elements may comprise one or more traction elements with sidewalls oriented towards a toe end and/or a heel end of the outsole. In some cases, the second plurality of directional traction elements may comprise one or more traction elements with sidewalls oriented towards a heel end and/or a toe end of the outsole.

In some cases, the first and second plurality of directional traction elements may comprise one or more traction elements with sidewalls oriented in a same direction. In other cases, the first and second plurality of directional traction elements may comprise traction elements with sidewalls oriented in different directions.

Omni-Directional Traction

In some embodiments, the outsoles described herein may include one or more omni-directional traction elements. In some cases, the omni-directional traction elements may be configured to manage force vectors oriented in multiple different directions. Although the directional traction elements disclosed herein may be better suited for managing force vectors in certain specific directions, the directional traction elements may not be able to manage other force vectors as effectively. For example, in some cases, the directional traction elements may not be optimized for force vectors that are angularly offset from the specific force vector directions that the directional traction elements are primarily configured to manage. In such cases, the inclusion of omni-directional traction elements may help to enhance the ability of the outsole to manage other important force vectors beyond those managed specifically by the directional traction elements.

In some cases, the omni-directional traction elements disclosed herein may be configured to manage a plurality of different force vectors associated with a variety of different golf-related actions or movements. In some cases, the omni-directional traction elements may be configured to manage (1) a first set of force vectors associated with traversing a course. In some cases, the force vectors associated with traversing a course may include force vectors that can change or vary depending on the terrain or topology of the course. In some cases, the omni-directional traction elements may be configured to manage (2) a second set of force vectors associated with the ground reaction forces generated during a golf swing. In some cases, the ground reaction forces generated during a golf swing may be disposed at an angle that can change or vary based on a subject's stance, as described in greater detail elsewhere herein. In some cases, the omni-directional traction elements may be configured to manage (3) a third set of force vectors associated with a lateral or rotational movement of the shoe relative to the ground surface. In some cases, the lateral or rotational movement of the shoe may be associated with a pushing or pulling motion or movement of the subject's left and/or right foot during a golf-related action or movement. Although the omni-directional traction elements may not have the directional bias or the precise directionality of directional traction elements, the omni-directional traction elements may still provide sufficient traction in multiple different directions so that the outsole can effectively engage with the ground surface regardless of the type of action or movement that the subject is performing, and regardless of the type of ground surface or the topology of the ground surface under the shoe.

In some embodiments, the outsoles described herein may include a plurality of omni-directional traction elements distributed or arranged across select portions of the outsole. In some cases, the plurality of omni-directional traction elements may include one or more omni-directional traction elements provided in the forefoot region of the outsole. In some cases, the omni-directional traction elements provided in the forefoot region of the outsole may be positioned within one or more tile pieces arranged across or within the forefoot region of the outsole. In some cases, the omni-directional traction elements provided in the forefoot region of the outsole may be arranged around one or more replaceable traction elements or one or more recessed receptacles for receiving or interlocking with one or more replaceable traction elements.

In some cases, the plurality of omni-directional traction elements may include one or more omni-directional traction elements provided in the midfoot and/or rearfoot region of the outsole. In some cases, the omni-directional traction elements provided in the midfoot and/or rearfoot region of the outsole may be positioned within one or more tile pieces arranged across or within the midfoot and/or rearfoot region of the outsole. In some cases, the omni-directional traction elements provided in the midfoot and/or rearfoot region(s) of the outsole may be arranged around one or more replaceable traction elements or one or more recessed receptacles for receiving or interlocking with the one or more replaceable traction elements.

Materials

In some embodiments, the outsole and/or the traction members provided on the outsole may comprise a plurality of different materials. For example, in some cases, the forefoot region of the outsole (and the traction members in the forefoot region of the outsole) may comprise a first material, and the midfoot or rearfoot region of the outsole (and the traction members in the midfoot or rearfoot region of the outsole) may comprise a second material that is different than the first material. In some cases, the first material and the second material may have a different material property (e.g., a different hardness, softness, stiffness, density, etc.). In some cases, the first material may comprise a thermoplastic polyurethane (TPU) material and/or a thermoplastic elastomer (TPE) material. In some cases, the second material may comprise a TPE material and/or a TPU material.

In some cases, the traction members in the forefoot, midfoot, and/or rearfoot region of the outsole may comprise one or more directional traction elements and/or one or more omni-directional traction elements. In some cases, the directional traction elements and the omni-directional traction elements may comprise a same type of material. In other cases, the directional and omni-directional traction elements may comprise different materials.

In some cases, the directional traction elements in the forefoot, midfoot, and/or rearfoot regions of the outsole may comprise a same type of material. In other cases, the directional traction elements in the forefoot, midfoot, and/or rearfoot regions of the outsole may comprise different materials or different types of materials.

In some cases, the omni-directional traction elements in the forefoot, midfoot, and/or rearfoot regions of the outsole may comprise a same type of material. In other cases, the omni-directional traction elements in the forefoot, midfoot, and/or rearfoot regions of the outsole may comprise different materials or different types of materials.

In some non-limiting embodiments, the directional traction elements and/or the omni-directional traction elements may comprise a dual-density compound. In some cases, the dual-density compound may comprise a relatively hard TPU material integrated with a relatively grippy rubber material. In some cases, the relatively hard TPU material may be embedded in the relatively grippy rubber material. In some cases, the relatively hard TPU material may be coated with the relatively grippy rubber material. In some cases, a portion or a section of the relatively hard TPU material may extend through or may be exposed through the relatively grippy rubber material to provide a multi-material traction interface between the ground surface and the outsole of the shoe. In some cases, the multi-material traction interface may be configured to enhance the frictional engagement and/or the mechanical interlocking that occurs between the traction elements of the shoe and the ground surface under the shoe.

Multi-Faceted Traction Elements

Figure 61:
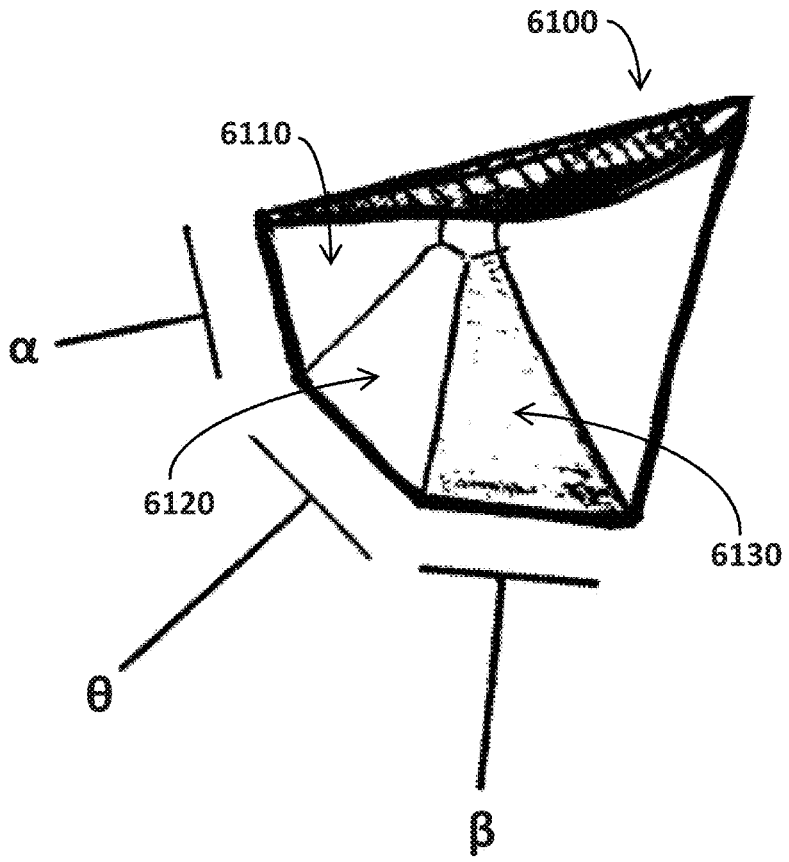
FIG. 61 schematically illustrates an example of a multi-faceted traction element with sidewalls configured to manage a plurality of different force vectors oriented in a plurality of different directions, in accordance with some embodiments.

Referring to FIG. 61, in some embodiments, the traction elements disclosed herein may comprise one or more multi-faceted traction elements 6100. In some cases, the one or more multi-faceted traction elements 6100 may comprise a plurality of sidewalls configured to provide traction in a plurality of different directions. In some cases, the multi-faceted traction elements may be configured to provide traction in a greater number of directions or across a wider range of directions than the directional elements described herein. In some cases, the multi-faceted traction elements may be configured to provide traction in a fewer number of directions or across a narrower range of directions than the omni-directional traction elements described herein. In some cases, the directional coverage of the multi-faceted traction elements may be between that of the directional traction elements (which may have sidewalls oriented to manage force vectors in just a single direction) and the omni-directional traction elements (which may have sidewalls that are configured to provide an equivalent amount of traction in multiple different directions or in any direction).

In some cases, the one or more multi-faceted traction elements 6100 may comprise a plurality of sidewalls oriented in different directions. In some non-limiting embodiments, the plurality of sidewalls may include n number of sidewalls, where n is an integer that is greater than or equal to 1. In some cases, the plurality of sidewalls may include at least 1, 2, 3, 4, 5, 6, 7, 8, 9, 10, or more sidewalls.

In some cases, each of the plurality of sidewalls may be oriented in a unique direction that is different than that of any other sidewall of the same traction element. In other cases, at least two or more sidewalls of the same traction element may be oriented in a same or common direction.

In some cases, the plurality of sidewalls may include a first sidewall 6110 oriented in a first direction. In some cases, the plurality of sidewalls may include a second sidewall 6120 oriented in a second direction. In some cases, the plurality of sidewalls may optionally include a third sidewall 6130 oriented in a third direction, and so on for n number of sidewalls.

In some cases, the first sidewall 6110 may be configured to manage a first set of force vectors that are disposed at an angle $\alpha$ relative to the lateral (horizontal) axis of the shoe. In some cases, the angle $\alpha$ may be at least about 60 degrees relative to the lateral (horizontal) axis of the shoe. In some cases, the angle $\alpha$ may be at least about 65 degrees relative to the lateral (horizontal) axis of the shoe. In some cases, the angle $\alpha$ may be at least about 70 degrees relative to the lateral (horizontal) axis of the shoe. In some cases, the angle $\alpha$ may be at least about 75 degrees relative to the lateral (horizontal) axis of the shoe. In some cases, the angle $\alpha$ may be at least about 80 degrees relative to the lateral (horizontal) axis of the shoe. In some cases, the first sidewall 6110 may be oriented perpendicular or orthogonal to the first set of force vectors.

In some cases, the second sidewall 6120 may be configured to manage a second set of force vectors that are disposed at an angle θ relative to the lateral (horizontal) axis of the shoe. In some cases, the angle θ may range from about 50 degrees to about 75 degrees relative to the lateral (horizontal) axis of the shoe. In some cases, the angle θ may range from about 55 degrees to about 70 degrees relative to the lateral (horizontal) axis of the shoe. In some cases, the angle θ may range from about 60 degrees to about 65 degrees relative to the lateral (horizontal) axis of the shoe. In some cases, the angle θ may be about 60 degrees, 61 degrees, 62 degrees, 63 degrees, 64 degrees, or 65 degrees relative to the lateral (horizontal) axis of the shoe. In some cases, the second sidewall 6120 may be oriented perpendicular or orthogonal to the second set of force vectors.

In some cases, the third sidewall 6130 may be configured to manage a third set of force vectors that are disposed at an angle β relative to the lateral (horizontal) axis of the shoe. In some cases, the angle β may be at most about 65 degrees relative to the lateral (horizontal) axis of the shoe. In some cases, the angle β may be at most about 60 degrees relative to the lateral (horizontal) axis of the shoe. In some cases, the angle β may be at most about 55 degrees relative to the lateral (horizontal) axis of the shoe. In some cases, the angle β may be at most about 50 degrees relative to the lateral (horizontal) axis of the shoe. In some cases, the angle R may be at most about 45 degrees relative to the lateral (horizontal) axis of the shoe. In some cases, the angle β may be at most about 40 degrees relative to the lateral (horizontal) axis of the shoe. In some cases, the third sidewall 6130 may be oriented perpendicular or orthogonal to the third set of force vectors.

In some cases, the first set of force vectors may be associated with a first type of stance, swing, or golf shot. In some cases, the second set of force vectors may be associated with a second type of stance, swing, or golf shot that is different than the first type of stance, swing, or golf shot. In some cases, the third set of force vectors may be associated with a third type of stance, swing, or golf shot. In some cases, the third type of stance, swing, or golf shot may be different than the first type of stance, swing, or golf shot. In some cases, the third type of stance, swing, or golf shot may be different than the second type of stance, swing, or golf shot.

In some cases, the sidewalls of the multi-faceted traction element(s) may collectively accommodate multiple different sets of force vectors so that the multi-faceted traction element(s) can provide traction in multiple different types of scenarios. For example, the multi-faceted traction element(s) may be configured to provide traction as a subject traverses different types of ground surfaces. Additionally, the multi-faceted traction element(s) may be configured to provide traction as the subject traverses different terrains or topologies. Furthermore, the multi-faceted traction element(s) may be configured to provide traction during golf-related actions or movements that are executed using different stances. The multi-faceted traction element(s) disclosed herein may be configured to provide traction across all of these different scenarios, each of which may require or benefit from traction in one or more specific directions or in multiple different directions depending on the subject and the particular actions or movements of the subject in each scenario.

VARIATIONS

In some cases, the traction elements disclosed herein may comprise a plurality of multi-faceted traction elements. In some cases, the plurality of multi-faceted traction elements may include a first multi-faceted traction element with a first set of sidewalls oriented in a first set of directions. In some cases, the plurality of multi-faceted traction elements may include a second multi-faceted traction element with a second set of sidewalls oriented in a second set of directions. In some cases, the first set of directions and the second set of directions may include one or more same directions. In other cases, the first set of directions and the second set of directions may include one or more different directions. In some cases, the first multi-faceted traction element and the second multi-faceted traction element may have sidewalls that are directionally aligned along one or more common directions. In other cases, the first multi-faceted traction element and the second multi-faceted traction element may not or need not have sidewalls that are directionally aligned along one or more common directions.

In some cases, the first multi-faceted traction element and the second multi-faceted traction element may be arranged along a same curved pathway extending across the outsole. In some cases, the first multi-faceted traction element and the second multi-faceted traction element may be arranged between a same set of curved pathways extending across the outsole.

In some cases, the first multi-faceted traction element and the second multi-faceted traction element may be arranged along different curved pathways extending across the outsole. In some cases, the first multi-faceted traction element and the second multi-faceted traction element may be arranged between different sets of curved pathways extending across the outsole.

In some cases, the first multi-faceted traction element and the second multi-faceted traction element may be positioned within a single tile. In other cases, the first multi-faceted traction element and the second multi-faceted traction element may be positioned within different tiles.

In some cases, the first multi-faceted traction element and the second multi-faceted traction element may be positioned adjacent to each other. In other cases, the first multi-faceted traction element and the second multi-faceted traction element may not or need not be positioned adjacent to each other. For example, in some cases, the first multi-faceted traction element and the second multi-faceted traction element may be spaced apart and separated by one or more gaps, and one or more additional traction elements may be positioned within the gaps between the first and second multi-faceted traction elements. In some cases, the one or more additional traction elements may include one or more directional traction elements. In other cases, the one or more additional traction elements may include one or more omni-directional traction elements. In some alternative cases, the one or more additional traction elements may include a combination of directional and omni-directional traction elements.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It also should be understood the terms, "first", "second", "third", "top", "bottom", "upper", "lower", "downward", "upward", "right', "left", "middle" "proximal", "distal", "lateral", "medial", "anterior", "posterior", and the like are arbitrary terms used to refer to one position of an element based on one perspective and should not be construed as limiting the scope of the invention.

It is understood that the shoe materials, designs, and structures described and illustrated herein represent only some embodiments of the invention. It is appreciated by those skilled in the art that various changes and additions can be made to materials, designs, and structures without departing from the spirit and scope of this invention. It is intended that all such embodiments be covered by the appended claims.

What is claimed is:

1. A golf shoe, comprising:

an upper;

a midsole; and an outsole comprising:

(i) a first set of spiral pathways with a first plurality of spiral segments radiating from a first point of origin, wherein each segment in the first plurality of spiral segments has a different degree of curvature;

(ii) a second set of spiral pathways with a second plurality of spiral segments radiating from a second point of origin, wherein each segment in the second plurality of spiral segments has a different degree of curvature, wherein the first set of spiral pathways and the second set of spiral pathways are inversely related and superimposed to form a plurality of tiles across the outsole, the plurality of tiles having a plurality of sides or edges formed by a plurality of sub-segments associated with the first plurality of spiral segments and the second plurality of spiral segments; and (iii) a plurality of traction members with sidewalls extending from the sides or edges of the tiles to form a ground contacting or ground penetrating portion of the traction members, wherein the traction members are arranged along or between different spiral segments, wherein the traction members comprise (i) a first set of directional traction elements arranged along a first curved pathway extending laterally between a medial side and a lateral side of the outsole and (ii) a second set of directional traction elements arranged along a second curved pathway extending laterally alongside the first curved pathway, wherein the first set of directional traction elements and/or the second set of directional traction elements include a plurality of directionally aligned traction elements with sidewalls that are oriented in a same direction.

2. The golf shoe of claim 1, wherein the plurality of directionally aligned traction elements include two or more adjacent traction elements positioned in different tiles that are arranged along one of the first curved pathway or the second curved pathway.

3. The golf shoe of claim 2, wherein the adjacent traction elements are positioned in two different neighboring tiles with a common side or edge.

4. The golf shoe of claim 1, wherein the plurality of directionally aligned traction elements include two or more adjacent traction elements positioned in different tiles that are arranged along different curved pathways.

5. The golf shoe of claim 4, wherein the adjacent traction elements include a first directional traction element arranged along the first curved pathway and a second directional traction element arranged along the second curved pathway.

6. The golf shoe of claim 1, wherein the first curved pathway is parallel to the second curved pathway.

7. The golf shoe of claim 1, wherein the first curved pathway and the second curved pathway are vertically offset from each other.

8. The golf shoe of claim 1, wherein the first curved pathway and the second curved pathway are located within a forefoot region of the outsole.

9. The golf shoe of claim 8, wherein an angular orientation of the sidewalls progressively changes as the traction members extend across the forefoot region of the outsole towards a midfoot region of the outsole.

10. The golf shoe of claim 1, wherein the directional traction elements arranged along the first curved pathway are oriented in a first direction to enhance traction in said first direction, and wherein the directional traction elements arranged along the second curved pathway are oriented in a second direction that is different than the first direction to enhance traction in said second direction.

11. The golf shoe of claim 1, wherein the plurality of directionally aligned traction elements include (i) a first set of directionally aligned traction elements with sidewalls that are oriented in a first direction to enhance traction in said first direction and (ii) a second set of directionally aligned traction elements with sidewalls that are oriented in a second direction to enhance traction in said second direction, wherein said second direction is angularly offset from said first direction.

12. The golf shoe of claim 11, wherein the sidewalls of the first set of directionally aligned traction elements are oriented perpendicular to a first set of force vectors associated with a first type of stance, swing, or golf shot.

13. The golf shoe of claim 12, wherein the sidewalls of the second set of directionally aligned traction elements are oriented perpendicular to a second set of force vectors associated with a second type of stance, swing, or golf shot that is different than the first type of stance, swing, or golf shot.

14. The golf shoe of claim 1, wherein the sidewalls of the traction members are configured to extend from the sides or edges of the tiles and converge at an apex to form the ground contacting or ground penetrating portion of the traction members.

15. The golf shoe of claim 14, wherein the tiles have n number of sides or edges, and wherein the traction members have m number of sidewalls extending from the sides or edges of the tiles and converging at the apex, wherein m is less than n.

16. The golf shoe of claim 1, wherein the ground contacting or ground penetrating portion of the traction members comprises a pointed end configured to penetrate through and mechanically interlock with a ground surface under the golf shoe.

17. The golf shoe of claim 1, wherein the tiles comprise one or more windows formed within the sides or edges of the tiles.

18. The golf shoe of claim 17, wherein the one or more windows are configured to extend between a sidewall of the traction members and a corner or an edge of the tiles opposite the sidewall of the traction members.

19. The golf shoe of claim 1, further comprising a first plurality of directional traction elements in a forefoot region of the outsole and a second plurality of directional traction elements in a rearfoot region of the outsole, wherein the first plurality of directional traction elements and the second plurality of directional traction elements both include traction elements with sidewalls oriented towards a toe end of the outsole.

20. The golf shoe of claim 19, wherein the first plurality of directional traction elements further comprises one or more traction elements with sidewalls oriented towards a heel end of the outsole.

* * * * *